US011730227B2

(12) United States Patent
Durocher et al.

(10) Patent No.: US 11,730,227 B2
(45) Date of Patent: Aug. 22, 2023

(54) ADJUSTABLE HELMET

(71) Applicant: BAUER HOCKEY LTD., Blainville (CA)

(72) Inventors: Jacques Durocher, St-Jerome (CA); Marie-Claude Genereux, Ste-Therese (CA); Hugo Martin, Montreal (CA); Charles-Antoine Desrochers, Prevost (CA)

(73) Assignee: BAUER HOCKEY LLC, Exeter, NH (US)

( * ) Notice: Subject to any disclaimer, the term of this patent is extended or adjusted under 35 U.S.C. 154(b) by 189 days.

(21) Appl. No.: 16/764,453

(22) PCT Filed: Nov. 21, 2018

(86) PCT No.: PCT/CA2018/051480
§ 371 (c)(1),
(2) Date: May 15, 2020

(87) PCT Pub. No.: WO2019/100153
PCT Pub. Date: May 31, 2019

(65) Prior Publication Data

US 2020/0337408 A1 Oct. 29, 2020

Related U.S. Application Data

(60) Provisional application No. 62/697,135, filed on Jul. 12, 2018, provisional application No. 62/589,263, filed on Nov. 21, 2017.

(51) Int. Cl.
*A42B 3/32* (2006.01)
*A42B 3/06* (2006.01)

(52) U.S. Cl.
CPC ..... *A42B 3/324* (2013.01); *A42B 3/06* (2013.01)

(58) Field of Classification Search
CPC ..... A42B 3/322; A42B 3/324; A42B 3/32; A42B 3/06
See application file for complete search history.

(56) References Cited

U.S. PATENT DOCUMENTS 3,107,356 A * 10/1963 Pestronk ..... A42B 3/324 2/420
3,579,637 A * 5/1971 Aileo ..... A42B 3/324 2/418

(Continued)

FOREIGN PATENT DOCUMENTS

CA 1147501 6/1983
CA 1154552 10/1983

(Continued)

OTHER PUBLICATIONS

International Search Report and Written Opinion dated Feb. 28, 2019, in connection with International Patent Application PCT/CA2018/051480, 19 pages.

(Continued)

*Primary Examiner* — Heather Mangine
*Assistant Examiner* — Raquel M. Weis

(57) ABSTRACT

A helmet for protecting a head of a user, in which the helmet is adjustable to adjust how it fits on the user's head, including by adjusting dimensions of the helmet independently from one another (e.g., adjusting the helmet longitudinally and laterally in independent ways) and/or having a self-adjusting padded interface with the user's head to better fit on the user's head (e.g., depending on a shape and/or a size of the user's head).

42 Claims, 52 Drawing Sheets

(56) References Cited

U.S. PATENT DOCUMENTS 4,404,690 A * 9/1983 Farquharson ..... A42B 3/28 2/420
4,477,929 A * 10/1984 Mattsson ..... A42B 3/324 2/418
4,539,715 A * 9/1985 Clement ..... A44B 11/12 2/420
5,012,533 A * 5/1991 Raffler ..... A42B 3/066 2/420
5,511,250 A * 4/1996 Field ..... A42B 3/127 2/418
5,956,776 A * 9/1999 Chartrand ..... A42B 3/324 2/420
6,108,824 A * 8/2000 Fournier ..... A42B 3/324 2/418
6,298,497 B1 * 10/2001 Chartrand ..... A42B 3/12 2/425
6,647,556 B2 * 11/2003 Grepper ..... A42B 3/324 2/418
6,665,884 B1 * 12/2003 Demps ..... A42B 3/127 2/418
6,934,972 B2 * 8/2005 Desjardins ..... A42B 3/324 2/418
6,966,075 B2 * 11/2005 Racine ..... A42B 3/324 2/418
6,981,284 B2 * 1/2006 Durocher ..... A42B 3/12 2/425
7,634,820 B2 * 12/2009 Rogers ..... A42B 3/324 2/425
7,870,618 B2 * 1/2011 Pilon ..... A42B 3/324 2/418
7,954,178 B2 * 6/2011 Durocher ..... A42B 3/324 2/418
8,095,995 B2 * 1/2012 Alexander ..... A42B 3/324 2/410
8,146,177 B2 * 4/2012 Mangone ..... A42B 3/324 2/410
8,296,868 B2 * 10/2012 Belanger ..... A42B 3/324 2/420
8,510,870 B2 * 8/2013 Rogers ..... A42B 3/324 2/418
8,832,870 B2 * 9/2014 Belanger ..... A42B 3/324 2/420
9,314,060 B2 * 4/2016 Giles ..... A63B 71/1225
9,345,282 B2 * 5/2016 Durocher ..... A63B 71/10
9,642,409 B2 * 5/2017 Roesler ..... A42B 3/06
2002/0007508 A1 * 1/2002 Grepper ..... A42B 3/324 2/420
2004/0117897 A1 * 6/2004 Udelhofen ..... A42B 3/324 2/421
2004/0172739 A1 * 9/2004 Racine ..... A42B 3/324 2/418
2005/0034222 A1 * 2/2005 Durocher ..... A42B 3/12 2/421
2005/0034223 A1 * 2/2005 Durocher ..... A42B 3/324 2/425
2007/0079429 A1 * 4/2007 Pilon ..... A42B 3/324 2/410
2007/0169251 A1 * 7/2007 Rogers ..... A42B 3/324 2/418
2007/0199136 A1 * 8/2007 Brine, III ..... A42B 3/12 2/410
2007/0266482 A1 * 11/2007 Alexander ..... A42B 3/324 2/418
2008/0189835 A1 * 8/2008 Mangone ..... A42B 3/324 2/420
2009/0044315 A1 * 2/2009 Belanger ..... A42B 3/324 2/420
2010/0050323 A1 * 3/2010 Durocher ..... A42B 3/085 2/425
2011/0271426 A1 * 11/2011 Roesler ..... A42B 3/324 2/410
2012/0011639 A1 * 1/2012 Beauchamp ..... A42B 3/324 2/414
2013/0025031 A1 * 1/2013 Laperriere ..... B29C 69/02 2/414
2013/0025032 A1 * 1/2013 Durocher ..... A42B 3/324 2/414
2013/0025033 A1 * 1/2013 Durocher ..... A63B 71/10 2/417
2013/0036531 A1 * 2/2013 Belanger ..... A42B 3/324 2/425
2013/0067643 A1 * 3/2013 Musal ..... A42B 3/324 2/424
2013/0067645 A1 * 3/2013 Musal ..... A63B 71/10 2/424
2013/0318691 A1 * 12/2013 Krick ..... A42B 3/221 2/10
2014/0109300 A1 * 4/2014 Durocher ..... A42B 3/324 2/414
2015/0000015 A1 * 1/2015 Beauchamp ..... A42B 3/324 2/418
2015/0282550 A1 * 10/2015 Musal ..... A42B 3/324 2/414
2016/0235151 A1 * 8/2016 Durocher ..... A42B 3/324
2017/0049178 A1 * 2/2017 Durocher ..... A42B 3/127
2017/0079363 A1 * 3/2017 Durocher ..... A42B 3/324
2017/0273386 A1 * 9/2017 Kuo ..... A42B 3/0466
2019/0048165 A1 * 2/2019 Krick ..... A42C 2/007
2019/0166947 A1 * 6/2019 Laperrière ..... B32B 3/30

FOREIGN PATENT DOCUMENTS

| | | |
|---|---|---|
| CA | 2321399 | 3/2002 |
| CA | 2804937 | 9/2009 |
| CA | 2783079 | 1/2013 |
| CA | 2944737 | 10/2015 |
| WO | 2019100153 | 5/2019 |

OTHER PUBLICATIONS

Examiner's Report dated Jun. 18, 2021 in connection with Canadian Patent Application No. 3,082,850, 5 pages.

Examiner's Report dated Feb. 18, 2022 in connection with Canadian Patent Application No. 3,082,850, 3 pages.

* cited by examiner

ADJUSTABLE HELMET

CROSS-REFERENCE TO RELATED APPLICATIONS

This application claims priority from U.S. Provisional Patent Application 62/589,263 filed on Nov. 21, 2017 and U.S. Provisional Patent Application 62/697,135 filed on Jul. 12, 2018, which are incorporated by reference herein.

FIELD

This disclosure relates generally to helmets and, more particularly, to helmets providing protection against impacts (e.g., while engaged in sports or other activities).

BACKGROUND

Helmets are worn in sports (e.g., hockey, lacrosse, football, baseball, etc.) and other activities (e.g., motorcycling, industrial work, military activities, etc.) to protect their users against head injuries. To that end, helmets typically comprise a rigid outer shell and inner padding to absorb energy when impacted.

As users' heads can have various shapes and sizes, helmets may have adjustment systems to adjust how they fit. For example, a hockey helmet may have an adjustment system allowing parts of the hockey helmet, including parts of its outer shell, to move relative to one another in order to adjust how it fits. While they are useful, adjustment systems of helmets may sometimes be limited in their capacity to adjust how the helmets fit.

Various types of impacts are possible. For example, high- and low-energy impacts may occur during sports or other activities. Although various forms of protection have been developed, existing techniques may not always be adequate or optimal in some cases, such as for certain types of impacts.

For these and other reasons, there is a need for improvements in helmets, such as for their adjustability and/or impact protection.

SUMMARY

According to various aspects, this disclosure relates to a helmet for protecting a head of a user, in which the helmet is adjustable to adjust how it fits on the user's head, including by adjusting dimensions of the helmet independently from one another (e.g., adjusting the helmet longitudinally and laterally in independent ways) and/or having a self-adjusting padded interface with the user's head to better fit on the user's head (e.g., depending on a shape and/or a size of the user's head).

For example, according to an aspect, this disclosure relates to a helmet for protecting a head of a user. The helmet comprises an outer shell, inner padding disposed within the outer shell, and an adjustment system configured to adjust a fit of the helmet on the user's head. The adjustment system comprises a longitudinal adjustment subsystem configured to adjust a longitudinal dimension of the helmet in a longitudinal direction of the helmet and a lateral adjustment subsystem configured to adjust a lateral dimension of the helmet in a lateral direction of the helmet. The longitudinal adjustment subsystem and the lateral adjustment subsystem are operable independently from one another to adjust the longitudinal dimension of the helmet and the lateral dimension of the helmet independently from one another over at least part of a range of adjustability of the longitudinal dimension of the helmet and at least part of a range of adjustability of the lateral dimension of the helmet.

According to another aspect, this disclosure relates to a helmet for protecting a head of a user. The helmet comprises an outer shell, inner padding disposed within the outer shell, and an adjustment system configured to adjust a fit of the helmet on the user's head. The adjustment system comprises a longitudinal adjustment subsystem configured to adjust a longitudinal dimension of the outer shell in a longitudinal direction of the helmet, and a lateral adjustment subsystem configured to adjust a lateral dimension of the outer shell in a lateral direction of the helmet. The longitudinal adjustment subsystem and the lateral adjustment subsystem are operable independently from one another to adjust the longitudinal dimension of the outer shell and the lateral dimension of the outer shell independently from one another over at least part of a range of adjustability of the longitudinal dimension of the outer shell and at least part of a range of adjustability of the lateral dimension of the outer shell.

According to another aspect, this disclosure relates to a helmet for protecting a head of a user. The helmet defines a cavity to receive the user's head. The helmet comprises an outer shell, inner padding disposed within the outer shell, and an adjustment system configured to adjust a fit of the helmet on the user's head. The adjustment system comprises a longitudinal adjustment subsystem configured to adjust a longitudinal dimension of the cavity of the helmet in a longitudinal direction of the helmet, and a lateral adjustment subsystem configured to adjust a lateral dimension of the cavity of the helmet in a lateral direction of the helmet. The longitudinal adjustment subsystem and the lateral adjustment subsystem are operable independently from one another to adjust the longitudinal dimension of the cavity of the helmet and the lateral dimension of the cavity of the helmet independently from one another over at least part of a range of adjustability of the longitudinal dimension of the cavity of the helmet and at least part of a range of adjustability of the lateral dimension of the cavity of the helmet.

According to another aspect, this disclosure relates to a helmet for protecting a head of a user. The helmet comprises an outer shell, inner padding disposed within the outer shell, and an adjustment system configured to adjust a fit of the helmet on the user's head. The adjustment system comprises a plurality of actuators manually operable independently from one another to adjust a longitudinal dimension of the outer shell in a longitudinal direction of the helmet and a lateral dimension of the outer shell in a lateral direction of the helmet.

According to another aspect, this disclosure relates to a helmet for protecting a head of a user. The helmet comprises an outer shell that comprises a plurality of shell members movable relative to one another. The helmet also comprises inner padding disposed within the outer shell and an adjustment system configured to adjust a fit of the helmet on the user's head. The adjustment system comprises a plurality of locks operable to selectively lock and unlock the shell members relative to one another in order to selectively allow and prevent movement of the shell members relative to one another for adjusting a longitudinal dimension of the outer shell in a longitudinal direction of the helmet and a lateral dimension of the outer shell in a lateral direction of the helmet.

According to another aspect, this disclosure relates to a helmet for protecting a head of a user. The helmet comprises an outer shell and inner padding disposed within the outer shell. The helmet also comprises an occipital pad mechanism comprising an occipital pad configured to engage an occipital region of the user's head. The occipital pad is configured to be biased away from a rear part of the outer shell and manually adjustable relative to the outer shell.

According to another aspect, this disclosure relates to a helmet for protecting a head of a user. The helmet comprises an outer shell and inner padding disposed within the outer shell. The inner padding comprises a plurality of self-adjustable pads configured to self-adjust when the helmet is donned in order to conform to regions of the user's head that contact the self-adjustable pads.

According to another aspect, this disclosure relates to a helmet for protecting a head of a user. The helmet comprises an outer shell and inner padding disposed within the outer shell. The inner padding comprises a self-adjustable pad configured to self-adjust when the helmet is donned in order to conform to a region of the user's head that contacts the self-adjustable pad. The self-adjustable pad comprises an inner side configured to contact the region of the user's head. The inner side of the self-adjustable pad is concave to define a concavity towards the user's head and a radius of curvature of the concavity of the inner side of the self-adjustable pad is configured to increase when the self-adjustable pad engages the region of the user's head as the helmet is donned.

These and other aspects of this disclosure will now become apparent to those of ordinary skill in the art upon review of the following description of embodiments in conjunction with the accompanying drawings.

BRIEF DESCRIPTION OF THE DRAWINGS

A detailed description of embodiments is provided below, by way of example only, with reference to the accompanying drawings, in which.

It is to be expressly understood that the description and drawings are only for purposes of illustrating certain embodiments, are an aid for understanding, and are not limiting.

DETAILED DESCRIPTION OF EMBODIMENTS

FIGS. 1 to 5 show an example of an embodiment of a helmet 10 for protecting a head 11 of a user. In this embodiment, the helmet 10 is a sports helmet for protecting the head 11 of the user who is a sports player. More particularly, in this embodiment, the helmet 10 is a hockey helmet for protecting the head 11 of the user who is a hockey player. In other embodiments, the helmet 10 may be any other type of helmet for other sports (e.g., lacrosse, football, baseball, bicycling, skiing, snowboarding, horseback riding, etc.) and activities other than sports (e.g., motorcycling, industrial applications, military applications, etc.) in which protection against head injury is desired.

In this embodiment, as further discussed later, the helmet 10 is adjustable to adjust how it fits on the user's head 11, including by adjusting dimensions of the helmet 10 independently from one another (e.g., adjusting the helmet 10 longitudinally and laterally in independent ways) and/or having a self-adjusting padded interface with the user's head 11 to better fit on the user's head 11 (e.g., depending on a shape and/or a size of the user's head 11).

The helmet 10 defines a cavity 13 for receiving the user's head 11 and is configured to protect the user's head 11 when the helmet 10 is impacted (e.g., when the helmet 10 hits a board or an ice or other skating surface of a hockey rink or is struck by a puck or a hockey stick). In this embodiment, the helmet 10 is designed to provide protection against various types of impacts, such as a linear impact in which an impact force is generally oriented to pass through a center of gravity of the user's head 11 and imparts a linear acceleration to the user's head 11 and a rotational impact in which an impact force imparts an angular acceleration to the user's head 11. The helmet 10 is also designed to protect against high-energy impacts and low-energy impacts.

Figure 63:
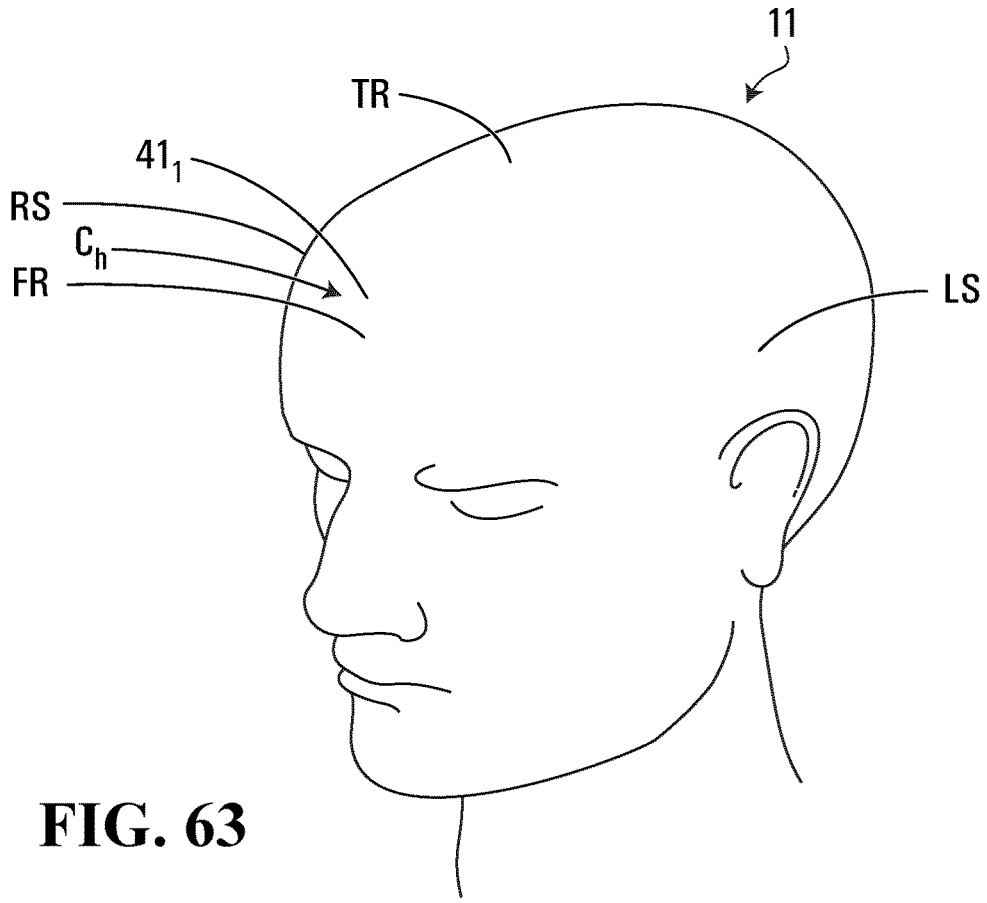
FIGS. 63 and 64 show the head of the user.
Figure 64:
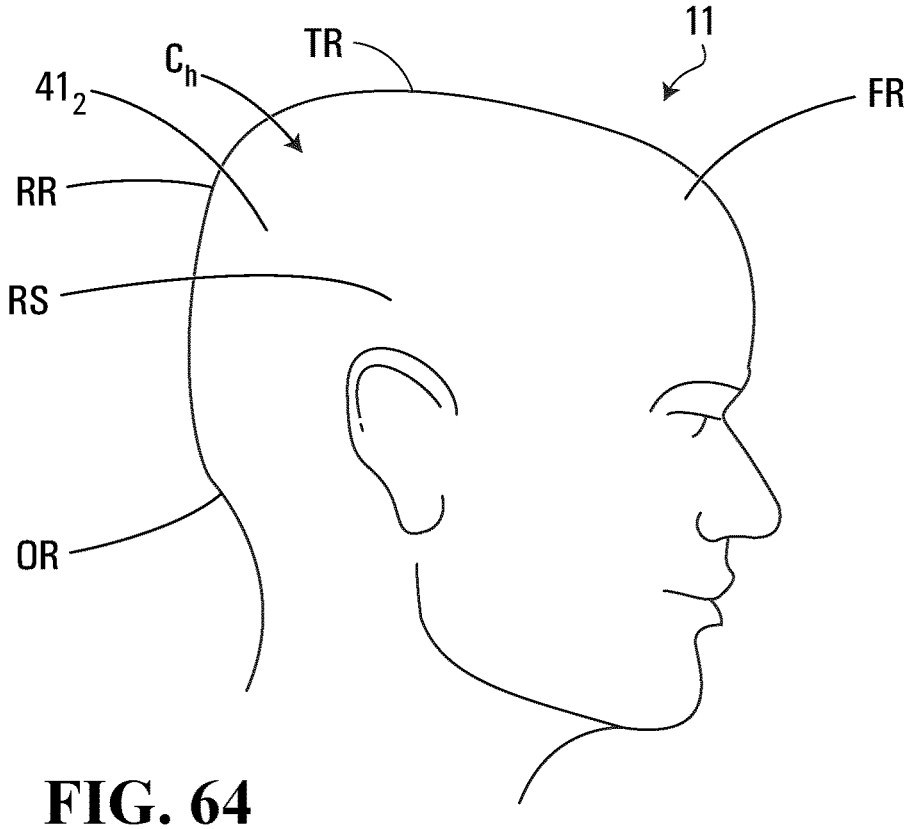
Figure 65A:
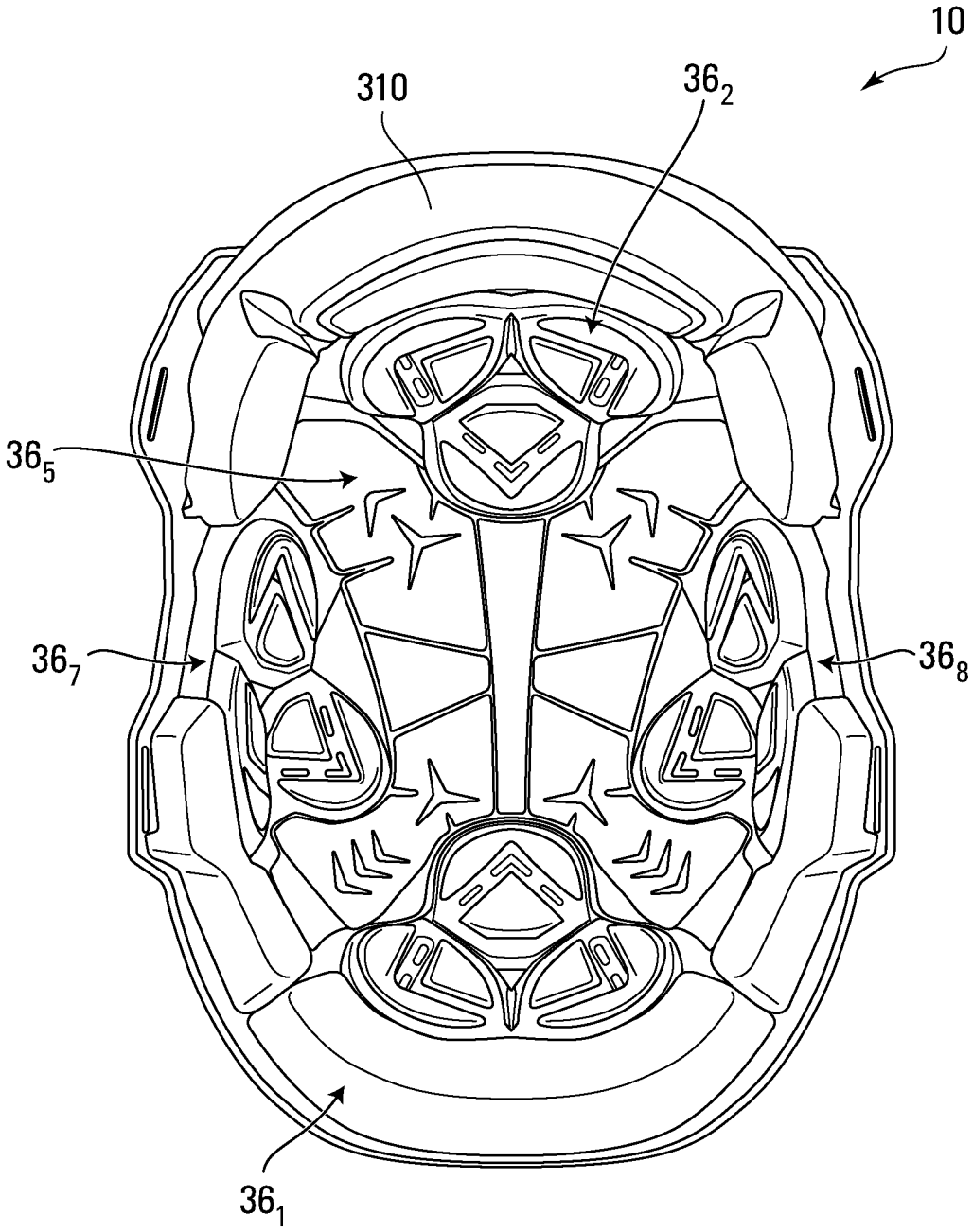
FIG. 65A shows the inside of the helmet with an example of the inner padding mounted inside the helmet and including self-adjustable pads configured to self-adjust when the helmet is donned.
Figure 65B:
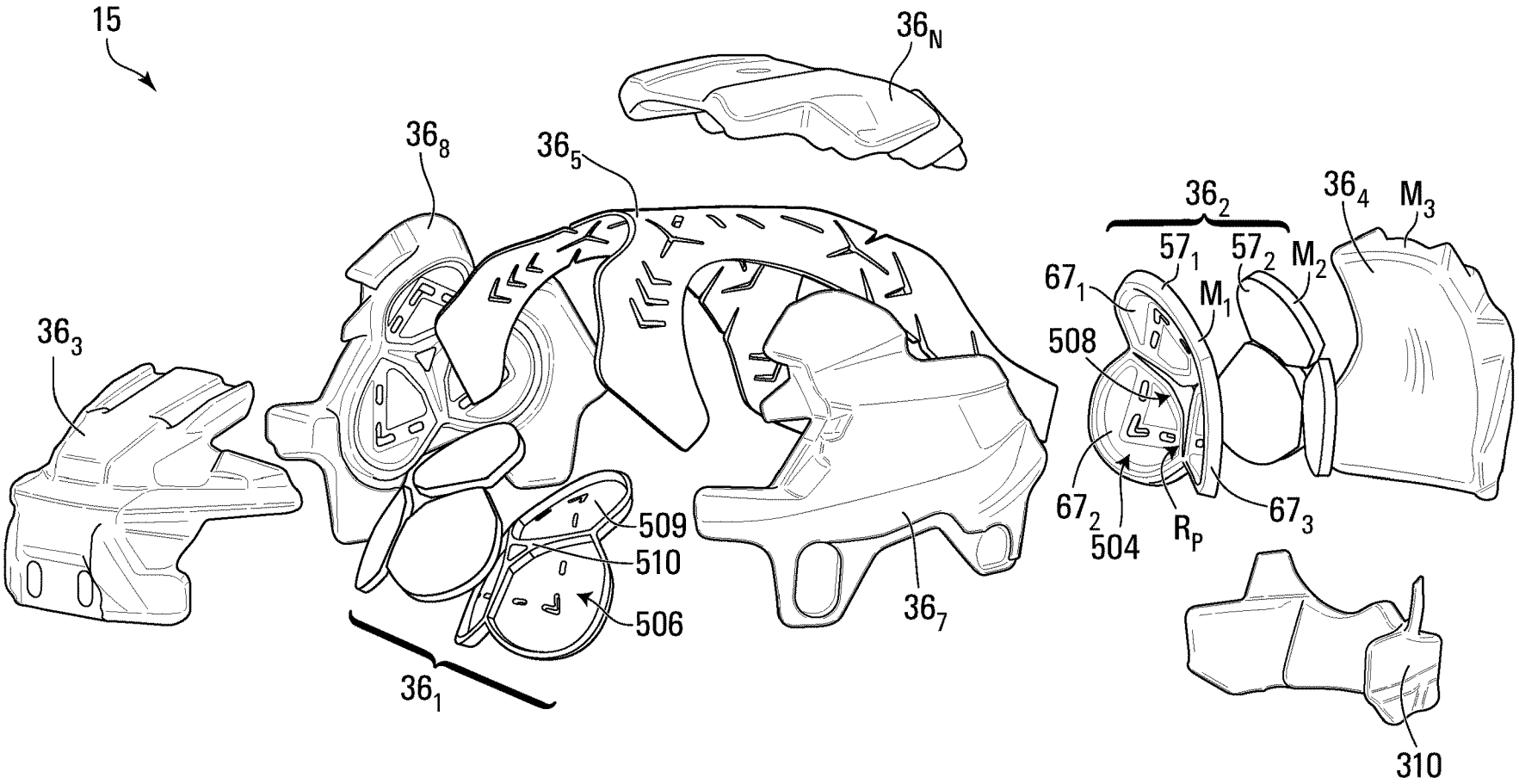
FIG. 65B shows an exploded view of the inner padding including self-adjustable pads configured to self-adjust when the helmet is donned according to the example shown in FIG. 65A.
Figure 66:
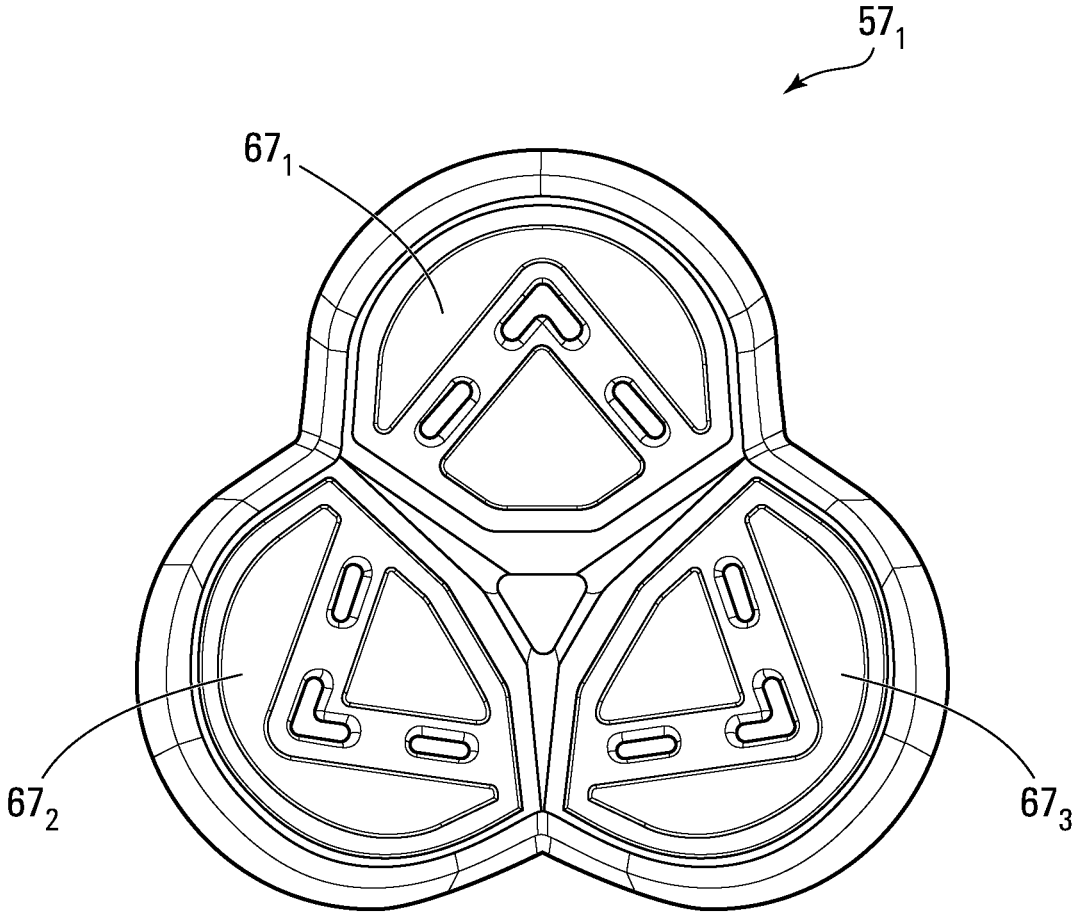
FIGS. 66 and 67 show respectively a front view and a rear view of a padding layer of a given one of the self-adjustable pads according to the example shown in FIGS. 65A and 65B.
Figure 67:
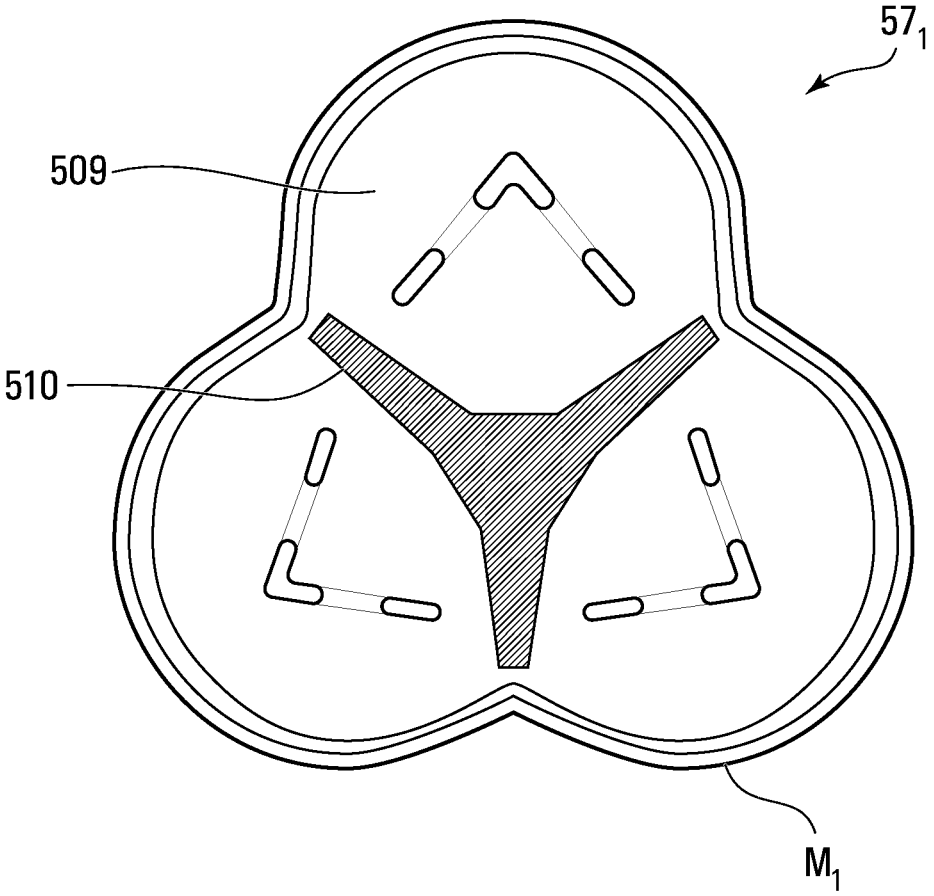
Figure 68:
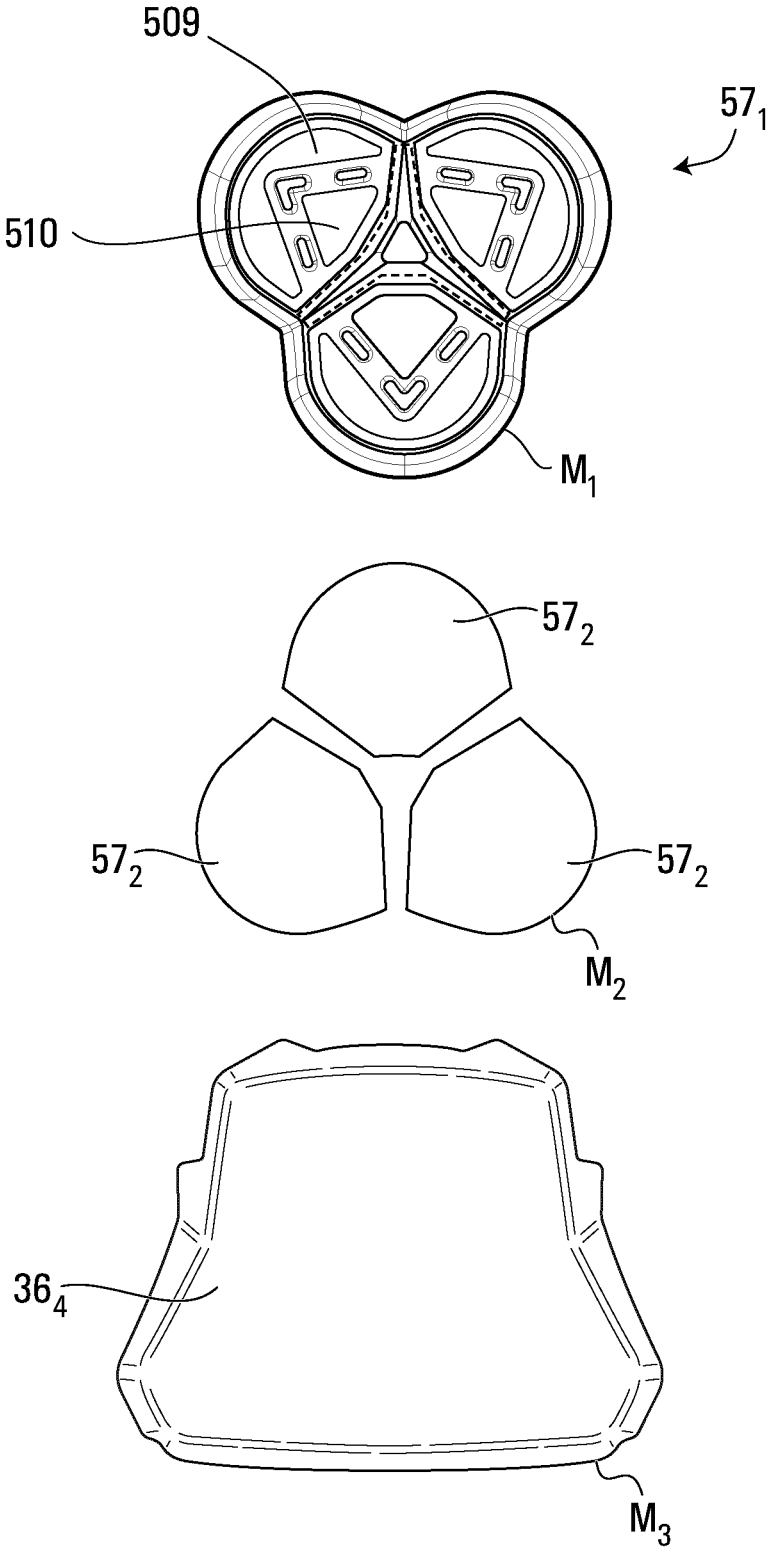
FIGS. 68 and 69 show exploded views of a given one of the self-adjustable pads according to the example shown in FIGS. 65A and 65B.
Figure 69:
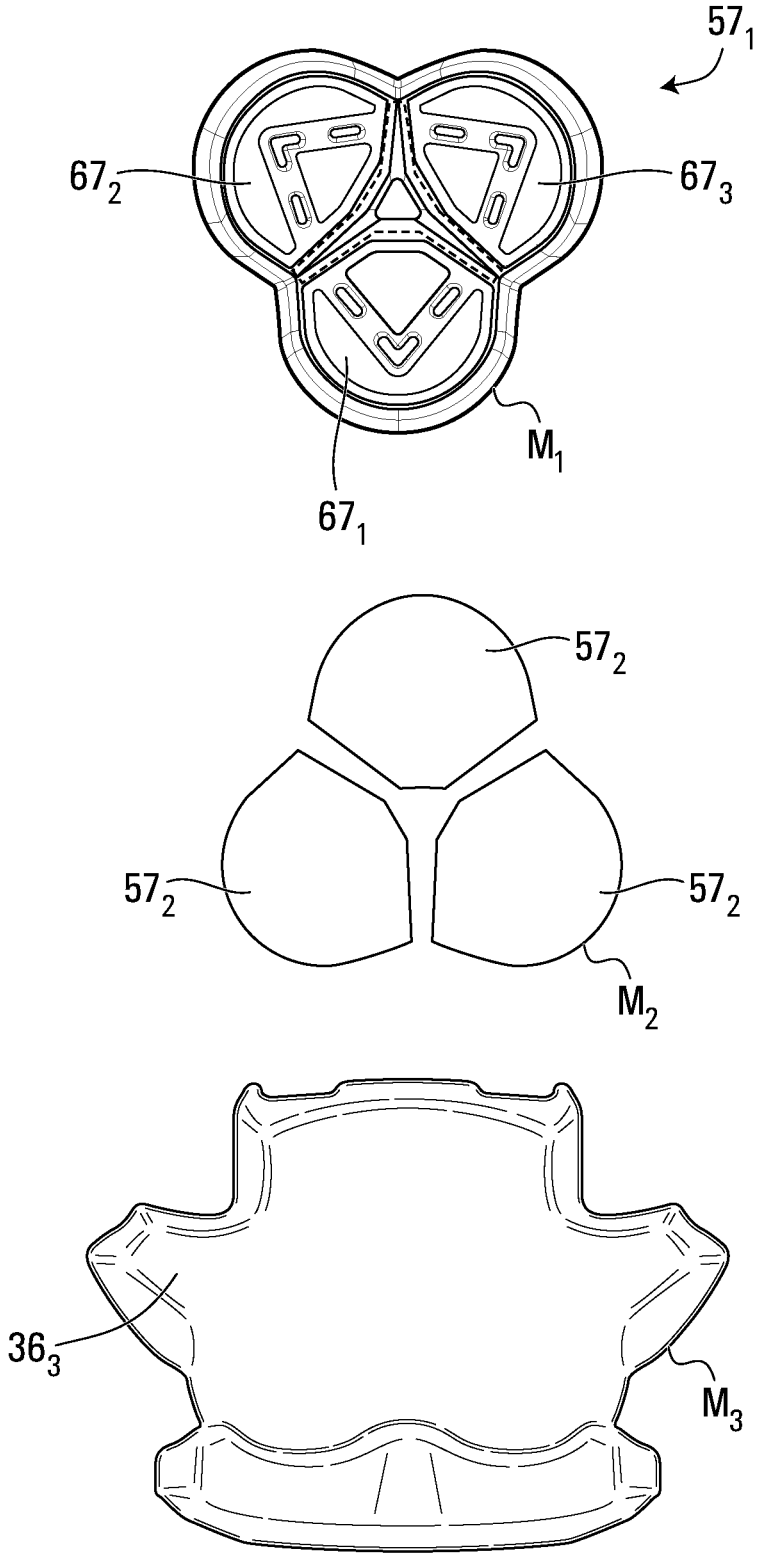
Figure 70:
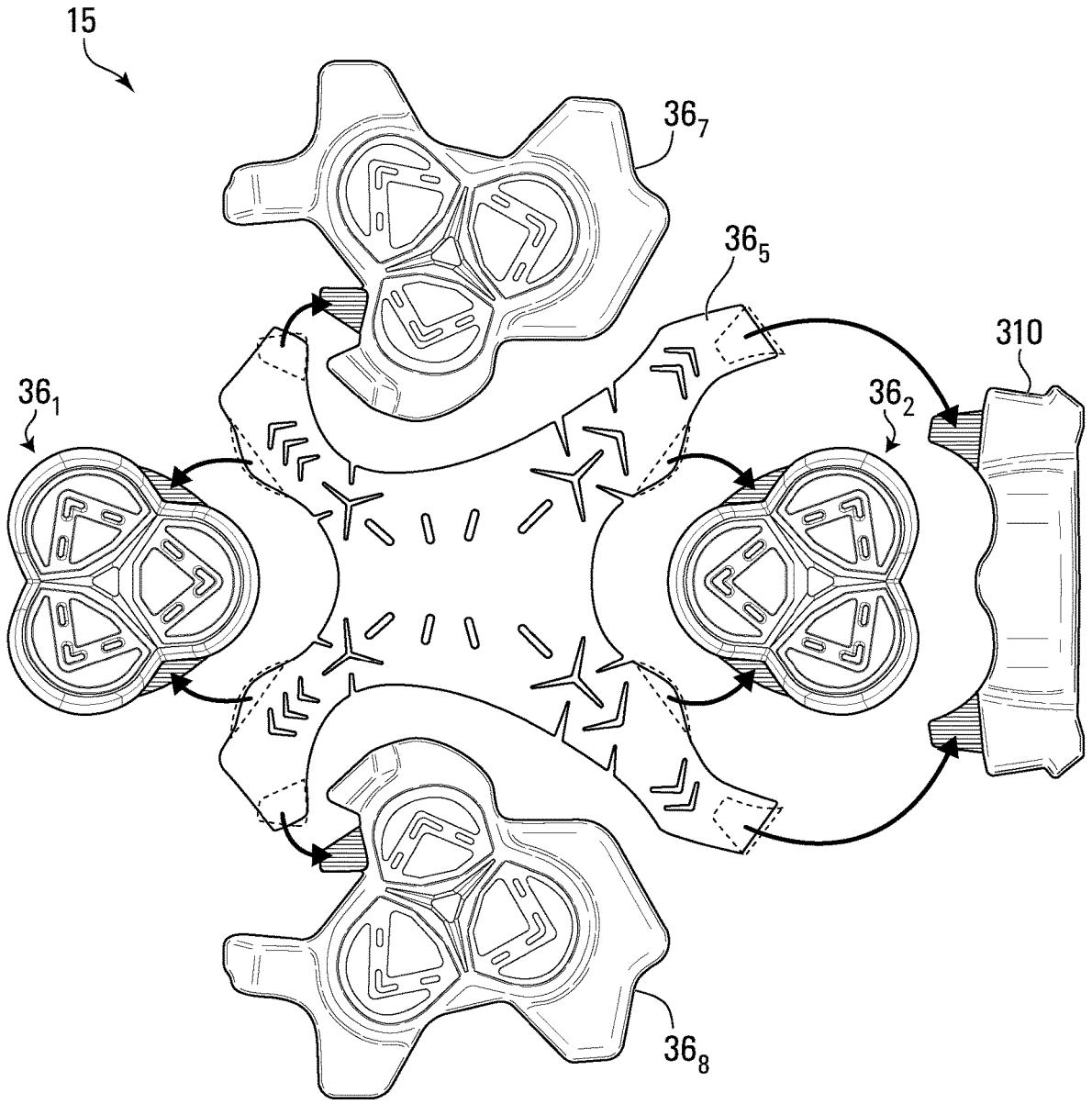
FIG. 70 shows a front exploded view of pads of the inner padding according to the example shown in FIGS. 65A and 65B.
Figure 71:
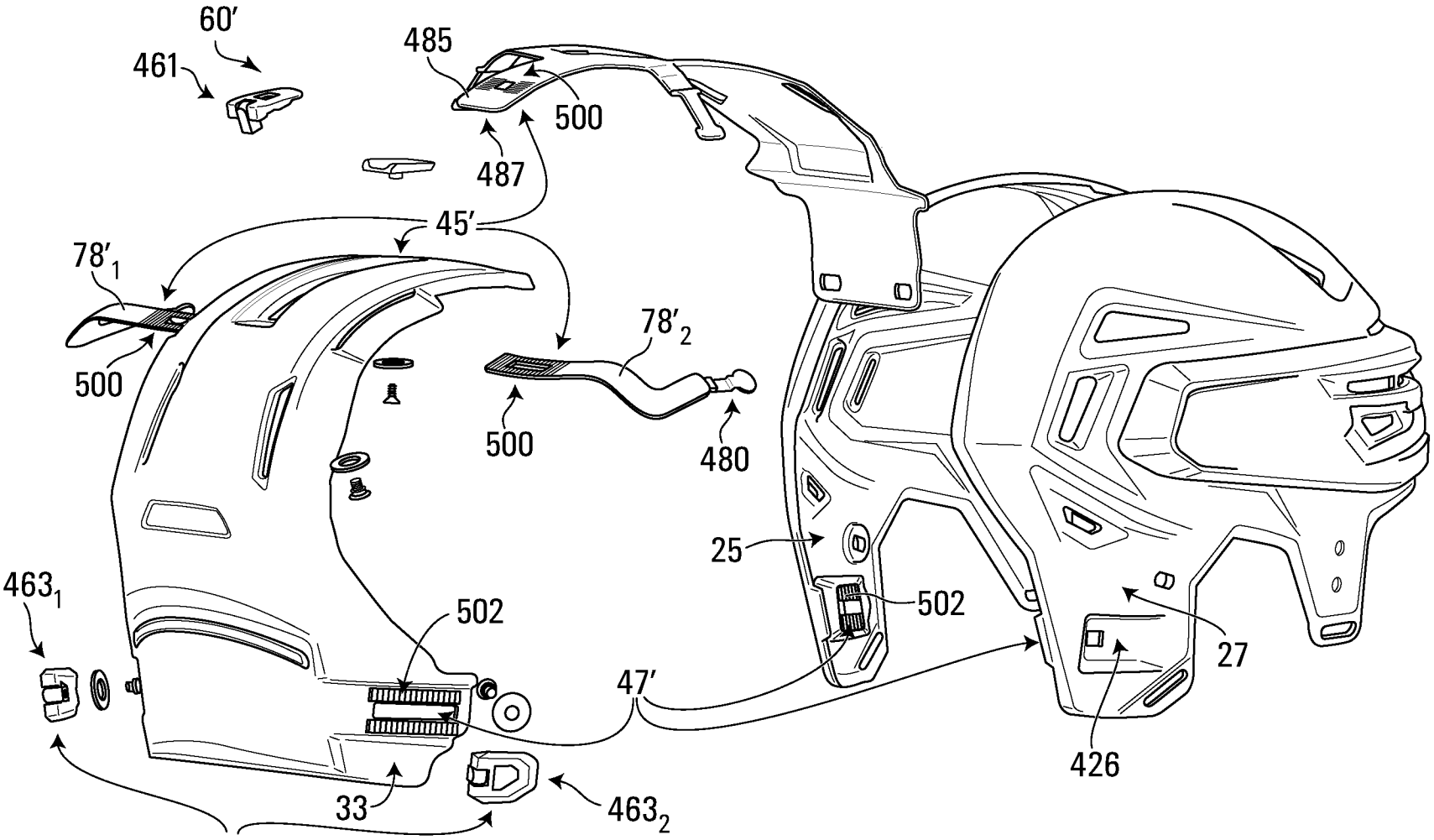
FIG. 71 shows an exploded view of another example of shell members of an outer shell of the helmet including another example of implementation of the adjustment system.
Figure 73:
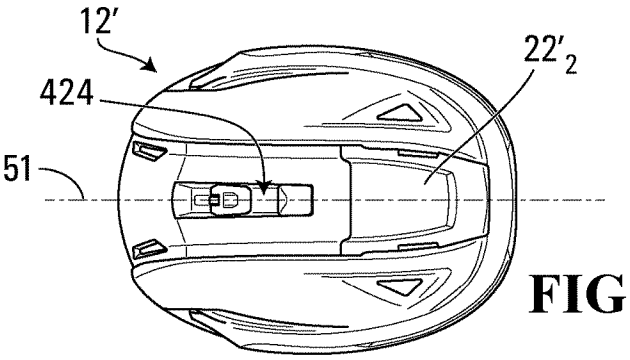
FIGS. 72 to 76 show respectively a rear, top, side, bottom and front view of the shell members according to the example shown in FIG. 71.
Figure 74:
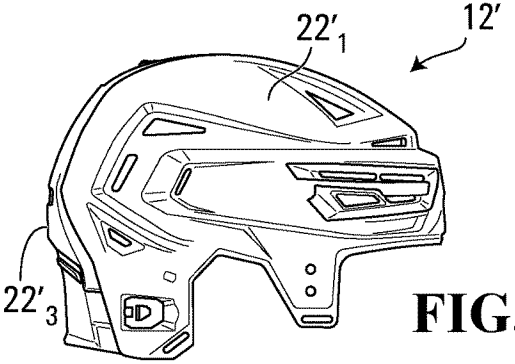

Various regions of the user's head 11 are protected by the helmet 10. As shown in FIGS. 63 and 64, the user's head 11 comprises a front region FR, a top region TR, lateral side regions LS, RS, and a rear region RR. The front region FR includes a forehead and a front top part of the head 11 and generally corresponds to a frontal bone region of the head 11. The lateral side regions LS, RS are on right and left lateral sides of the head 11, including above the user's ears. The rear region RR is opposite to the front region FR and includes a rear upper part of the head 11 and a rear lower part of the head 11, which includes an occipital region OR of the head 11 around and under the head's occipital protuberance.

The helmet 10 comprises an external surface 18 and an internal surface 20 that contacts the user's head 11 when the helmet 10 is worn. Also, the helmet 10 has a longitudinal axis 51, a lateral axis 53, and a vertical axis 55 which are respectively generally parallel to a dorsoventral axis, a dextrosinistral axis, and a cephalocaudal axis of the user when the helmet 10 is worn and which respectively define a longitudinal direction, a lateral direction, and a vertical direction of the helmet 10. A length L of the helmet 10 is a dimension of the helmet 10 in its longitudinal direction, a width W of the helmet 10 is a dimension of the helmet 10 in its lateral direction, and a height H of the helmet 10 is a dimension of the helmet 10 in its vertical direction.

Figure 19:
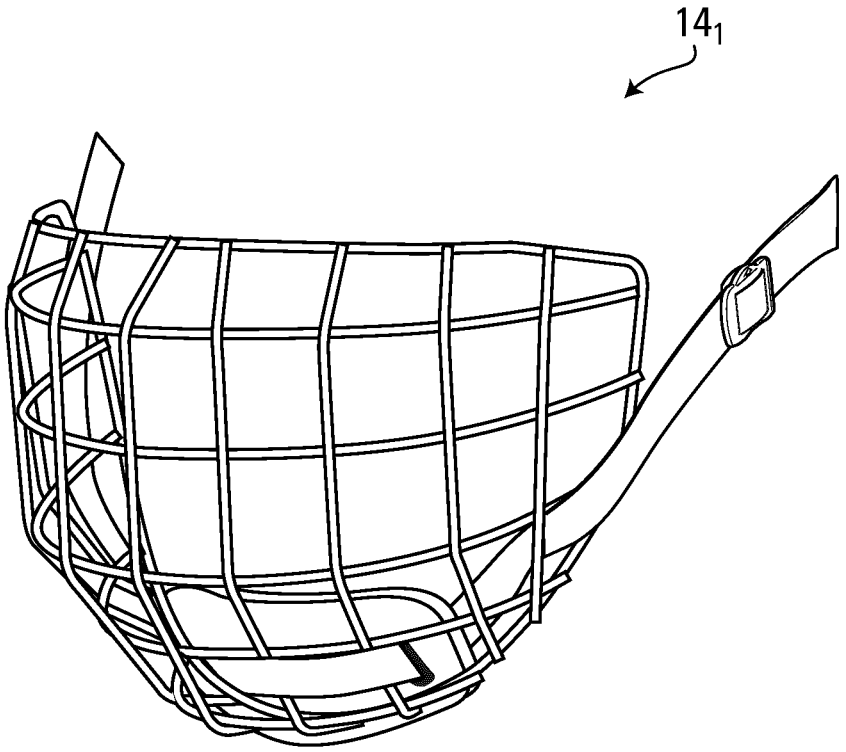
FIGS. 19 and 20 show examples of a faceguard that may be provided on the helmet.
Figure 20:
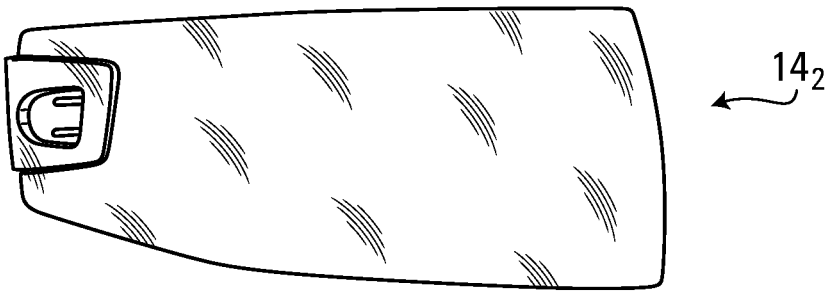

In this embodiment, the helmet 10 comprises an outer shell 12 and inner padding 15. The helmet 10 also comprises a chinstrap 16 for securing the helmet 10 to the user's head 11. As shown in FIGS. 19 and 20, the helmet 10 may also comprise a faceguard $\mathbf{14}_1$ to protect at least part of the user's face (e.g., a grid (sometimes referred to as a "cage") or a visor $\mathbf{14}_2$ (sometimes referred to as a "shield")).

The outer shell 12 provides strength and rigidity to the helmet 10. To that end, the outer shell 12 comprises rigid material. For example, in various embodiments, the outer shell 12 may comprise thermoplastic material such as polyethylene (PE), polyamide (nylon), or polycarbonate, of thermosetting resin, or of any other suitable material. The outer shell 12 includes an inner surface 17 facing the inner padding 15 and an outer surface 19 opposite the inner surface 17. The outer surface 19 of the outer shell 12 constitutes at least part of the external surface 18 of the helmet 10.

In this embodiment, the outer shell 12 comprises a plurality of shell members $\mathbf{22}_1$-$\mathbf{22}_3$ that are connected to one another. In this example, with additional reference to FIGS. 6 to 18, the shell member $\mathbf{22}_1$ is a front shell member, the shell member $\mathbf{22}_3$ is a rear shell member, and the shell member $\mathbf{22}_2$ is a top shell member disposed between the front shell member $\mathbf{22}_1$ and the rear shell member $\mathbf{22}_3$.

More particularly, in this embodiment, the front shell member $\mathbf{22}_1$ comprises a front portion 23 configured to face the front region FR of the user's head 11 and lateral side portions 25, 27 extending rearwardly from the front portion 23 and configured to face the lateral side regions LS, RS of the user's head 11. The front shell member $\mathbf{22}_1$ comprises a gap 49 between the lateral side portions 25, 27.

Also, in this embodiment, the rear shell member $\mathbf{22}_3$ comprises an upper portion 29 configured to face the top region TR of the user's head 11 and a rear portion 31 configured to face the rear region RR of the user's head 11, which includes an upper rear portion 30 configured to face the upper rear part of the user's head 11 and a lower rear portion 37 configured to face the rear lower part of the user's head 11, including the occipital region OR of the user's head 11. The upper rear portion 30 protrudes rearwardly from the upper portion 29 and the lower rear portion 37 of the rear shell member $\mathbf{22}_3$ and forms a domed shape that generally conforms to the rear region RR of the user's head 11. The domed shape of the upper rear portion 30 of the rear shell member $\mathbf{22}_3$ interacts with the rearmost portions of the lateral portions 25, 27 of the front shell member $\mathbf{22}_1$ while the helmet 10 is adjusted laterally, as discussed later. The rear shell member $\mathbf{22}_3$ also comprises lateral side portions 33, 35 extending forwardly from the lower rear portion 37 and configured to face the lateral side regions LS, RS of the user's head 11. The rear shell member $\mathbf{22}_3$ overlies the gap 49 of the front shell member $\mathbf{22}_1$. In this example, the rear shell member $\mathbf{22}_3$ extends across the gap 49 of the front shell member $\mathbf{22}_1$ so that the gap 49 is concealed (i.e., unapparent) externally of the helmet 10. Also, in this embodiment, the lateral side portions 25, 27 of the front shell member $\mathbf{22}_1$ overlap with the lateral side portions 33, 35 of the rear shell member $\mathbf{22}_3$. A degree of overlap between the lateral side portions 25, 27 of the front shell member $\mathbf{22}_1$ and the lateral side portions 33, 35 of the rear shell member $\mathbf{22}_3$ may vary while the helmet 10 is adjusted to adjust how it fits on the user's head 11.

Furthermore, in this embodiment, the top shell member $\mathbf{22}_2$ comprises a top portion 24 configured to face the top region TP of the user's head 11 and a front portion 28 configured to face the front region FR of the user's head. The top shell member $\mathbf{22}_2$ overlies the gap 49 of the front shell member $\mathbf{22}_1$. In this example, the top portion 24 of the top shell member $\mathbf{22}_2$ extends across the gap 49 of the front shell member $\mathbf{22}_1$ so that the gap 49 is concealed (i.e., unapparent) externally of the helmet 10. Also, in this embodiment, the top shell member $\mathbf{22}_2$ overlaps with the rear shell member $\mathbf{22}_3$ and with the lateral side portions 25, 27 of the front shell member $\mathbf{22}_1$. A degree of overlap between the rear shell member $\mathbf{22}_3$ and the top shell member $\mathbf{22}_2$ and/or a degree of overlap between the front shell member $\mathbf{22}_1$ and the top shell member $\mathbf{22}_2$ may vary while the helmet 10 is adjusted to adjust how it fits on the user's head 11.

In this example of implementation, the outer shell 12 comprises a plurality of ventilation holes $\mathbf{39}_1$-$\mathbf{39}_V$ allowing air to circulate around the user's head 11 for added comfort.

The outer shell 12 may be implemented in various other ways in other embodiments.

Figure 21:
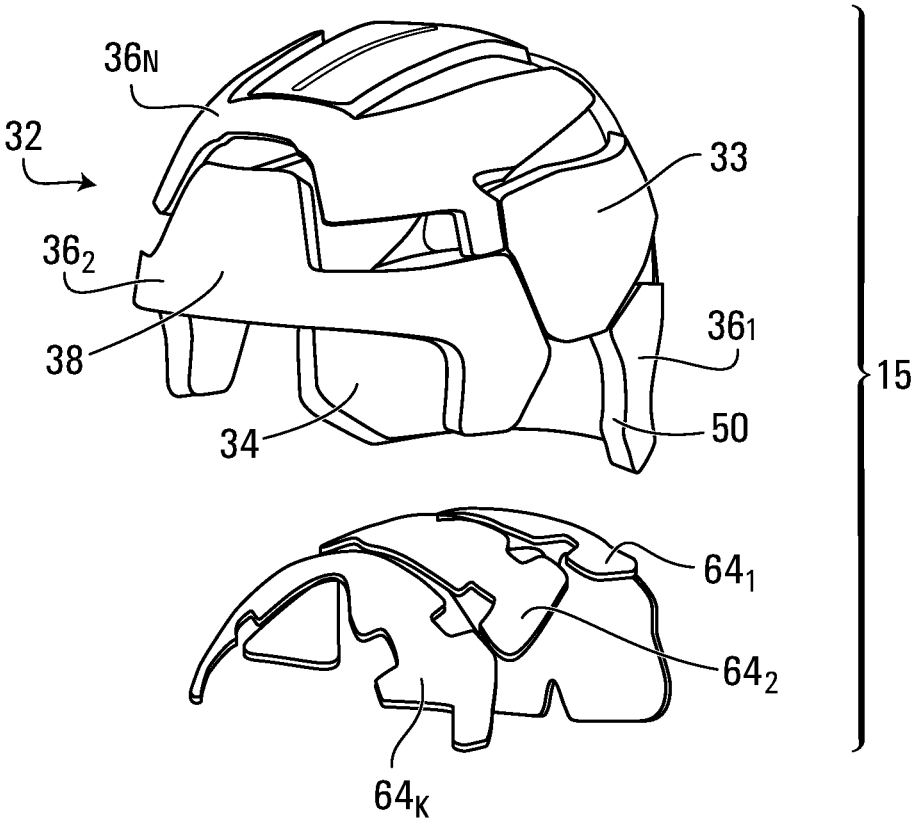
FIG. 21 shows an exploded view of an example of inner padding.

The inner padding 15 is disposed between the outer shell 12 and the user's head 11 in use to absorb impact energy when the helmet 10 is impacted. More particularly, as shown in FIG. 21, the inner padding 15 comprises a shock-absorbing structure 32 that includes an outer surface 38 facing towards the outer shell 12 and an inner surface 34 facing towards the user's head 11. The shock-absorbing structure 32 comprises a plurality of pads $\mathbf{36}_1$-$\mathbf{36}_N$ to absorb impact energy. The pads $\mathbf{36}_1$-$\mathbf{36}_N$ are responsible for absorbing at least a bulk of the impact energy transmitted to the inner padding 15 when the helmet 10 is impacted and can therefore be referred to as "absorption" pads.

For example, in this embodiment, each of the pads $\mathbf{36}_1$-$\mathbf{36}_N$ comprises a shock-absorbing material 50. For instance, in some cases, the shock-absorbing material 50 may include a polymeric cellular material, such as a polymeric foam (e.g., expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material), or expanded polymeric microspheres (e.g., Expancel™ microspheres commercialized by Akzo Nobel). In some cases, the shock-absorbing material 50 may include an elastomeric material (e.g., a rubber such as styrene-butadiene rubber or any other suitable rubber; a polyurethane elastomer such as thermoplastic polyurethane (TPU); any other thermoplastic elastomer; etc.). In some cases, the shock-absorbing material 50 may include a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments. In other embodiments, a given one of the pads $\mathbf{36}_1$-$\mathbf{36}_N$ may comprise an arrangement (e.g., an array) of shock absorbers that are configured to deform when the helmet 10 is impacted. For instance, in some cases, the arrangement of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

In addition to the absorption pads $\mathbf{36}_1$-$\mathbf{36}_N$, in this embodiment, the inner padding 15 comprises a plurality of comfort pads $\mathbf{64}_1$-$\mathbf{64}_K$ which are configured to provide comfort to the user's head. In this embodiment, when the helmet 10 is worn, the comfort pads $\mathbf{64}_1$-$\mathbf{64}_K$ are disposed between the absorption pads $\mathbf{36}_1$-$\mathbf{36}_N$ and the user's head 11 to contact the user's head 11. The comfort pads $\mathbf{64}_1$-$\mathbf{64}_K$ may comprise any suitable soft material providing comfort to the user. For example, in some embodiments, the comfort pads $\mathbf{64}_1$-$\mathbf{64}_K$ may comprise polymeric foam such as polyvinyl chloride (PVC) foam, polyurethane foam (e.g., PORON XRD foam commercialized by Rogers Corporation), vinyl nitrile foam or any other suitable polymeric foam material. In some embodiments, given ones of the comfort pads $\mathbf{64}_1$-$\mathbf{64}_K$ may be secured (e.g., adhered, fastened, etc.) to respective ones of the absorption pads $\mathbf{36}_1$-$\mathbf{36}_N$. In other embodiments, given ones of the comfort pads $\mathbf{64}_1$-$\mathbf{64}_K$ may be mounted such that they are movable relative to the absorption pads $\mathbf{36}_1$-$\mathbf{36}_N$. For example, in some embodiments, given ones of the comfort pads $\mathbf{64}_1$-$\mathbf{64}_K$ may be part of a floating liner as described in U.S. Patent Application Publication 2013/0025032, which, for instance, may be implemented as the SUSPEND-TECH™ liner found in the BAUER™ RE-AKT™ and RE-AKT 100™ helmets made available by Bauer Hockey, LLC. The comfort pads $\mathbf{64}_1$-$\mathbf{64}_K$ may assist in absorption of energy from impacts, in particular, low-energy impacts.

The helmet 10 comprises an adjustment system 40 configured to adjust a fit of the helmet 10 on the user's head 11. With additional reference to FIGS. 4 and 22 to 29, the adjustment system 40 allows the fit of the helmet 10 to be adjusted by adjusting one or more dimensions of the helmet 10, including: (1) a longitudinal dimension of the helmet 10 in the longitudinal direction of the helmet 10, such as a longitudinal dimension $D_{LS}$ of the outer shell 12 in the longitudinal direction of the helmet 10 and/or a longitudinal dimension $D_{LC}$ of the cavity 13 of the helmet 10 in the longitudinal direction of the helmet; and (2) a lateral dimension of the helmet 10 in the lateral direction of the helmet 10, such as a lateral dimension $D_{TS}$ of the outer shell 12 in the lateral direction of the helmet 10 and/or a lateral dimension $D_{TC}$ of the cavity 13 of the helmet 10 in the lateral direction of the helmet 10. This may allow the helmet 10 to better fit on the user's head, such as depending on the shape and/or the size of the user's head 11.

In this embodiment, the outer shell 12 and the inner padding 15 are adjustable by operating the adjustment system 40 to adjust the fit of the helmet 10 on the user's head 11. More particularly, in this embodiment, the shell members $\mathbf{22}_1$-$\mathbf{22}_3$ are movable relative to one another and respective ones of the pads $\mathbf{36}_1$-$\mathbf{36}_N$, $\mathbf{64}_1$-$\mathbf{64}_K$ are movable relative to one another by operating the adjustment system 40 to adjust the fit of the helmet 10 on the user's head 11. In this example, the adjustment system 40 is configured to allow movement of the shell members $\mathbf{22}_1$-$\mathbf{22}_3$ relative to one another and movement of respective ones of the pads $\mathbf{36}_1$-$\mathbf{36}_N$, $\mathbf{64}_1$-$\mathbf{64}_K$ relative to one another in the longitudinal direction of the helmet 10 and/or the lateral direction of the helmet 10.

More particularly, in this embodiment, the adjustment system 40 comprises a longitudinal adjustment subsystem 42 configured to adjust the longitudinal dimension $D_{LS}$ of the outer shell 12 and the longitudinal dimension $D_{LC}$ of the cavity 13 of the helmet 10 and a lateral adjustment subsystem 44 configured to adjust the lateral dimension $D_{TS}$ of the outer shell 12 and the lateral dimension $D_{TC}$ of the cavity 13 of the helmet 10. That is, the longitudinal adjustment subsystem 42 is configured to adjust the longitudinal dimension $D_{LS}$ of the outer shell 12 and the longitudinal dimension $D_{LC}$ of the cavity 13 of the helmet 10 such that each of the longitudinal dimension $D_{LS}$ of the outer shell 12 and the longitudinal dimension $D_{LC}$ of the cavity 13 of the helmet 10 is at least primarily (i.e., primarily or entirely) adjustable by operating the longitudinal adjustment subsystem 42, while the lateral adjustment subsystem 44 is configured to adjust the lateral dimension $D_{TS}$ of the outer shell 12 and the lateral dimension $D_{TC}$ of the cavity 13 of the helmet 10 such that each of the lateral dimension $D_{TS}$ of the outer shell 12 and the lateral dimension $D_{TC}$ of the cavity 13 of the helmet 10 is at least primarily (i.e., primarily or entirely) adjustable by operating the lateral adjustment subsystem 44.

In this example of implementation, the longitudinal adjustment subsystem 42 and the lateral adjustment subsystem 44 are operable independently from one another to adjust the longitudinal dimension $D_{LS}$ of the outer shell 12 and the lateral dimension $D_{TS}$ of the outer shell 12 independently from one another over at least part of a range of adjustability of the longitudinal dimension $D_{LS}$ of the outer shell 12 and at least part of a range of adjustability of the lateral dimension $D_{TS}$ of the outer shell 12, and/or to adjust the longitudinal dimension $D_{LC}$ of the cavity 13 of the helmet 10 and the lateral dimension $D_{TC}$ of the cavity 13 of the helmet 10 independently from one another over at least part of a range of adjustability of the longitudinal dimension $D_{LC}$ of the cavity 13 of the helmet 10 and at least part of a range of adjustability of the lateral dimension $D_{TC}$ of the cavity 13 of the helmet 10.

Figure 22:
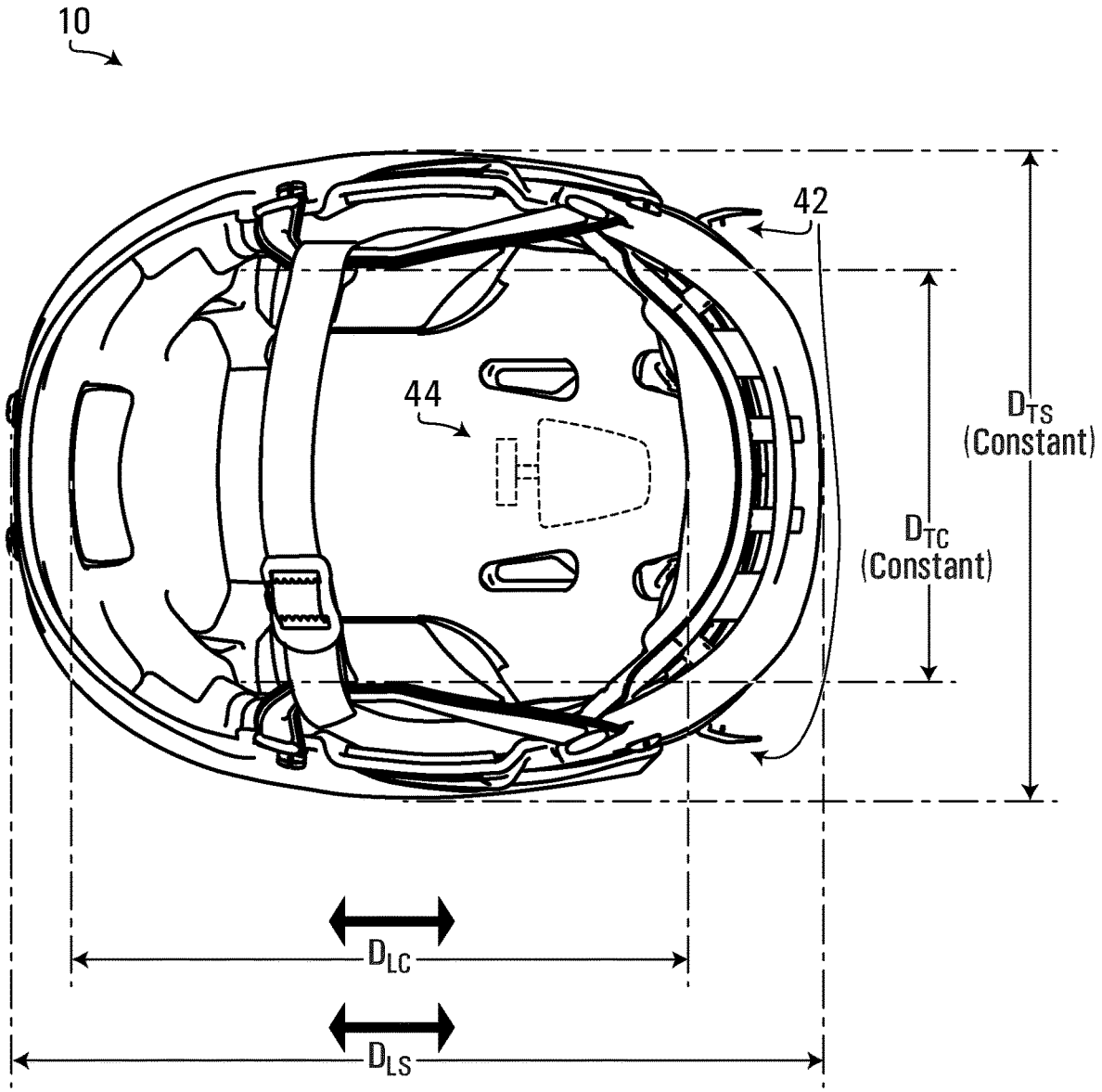
FIGS. 22 to 29 show lateral and longitudinal dimensions changes of the helmet independent from one another.
Figure 23:
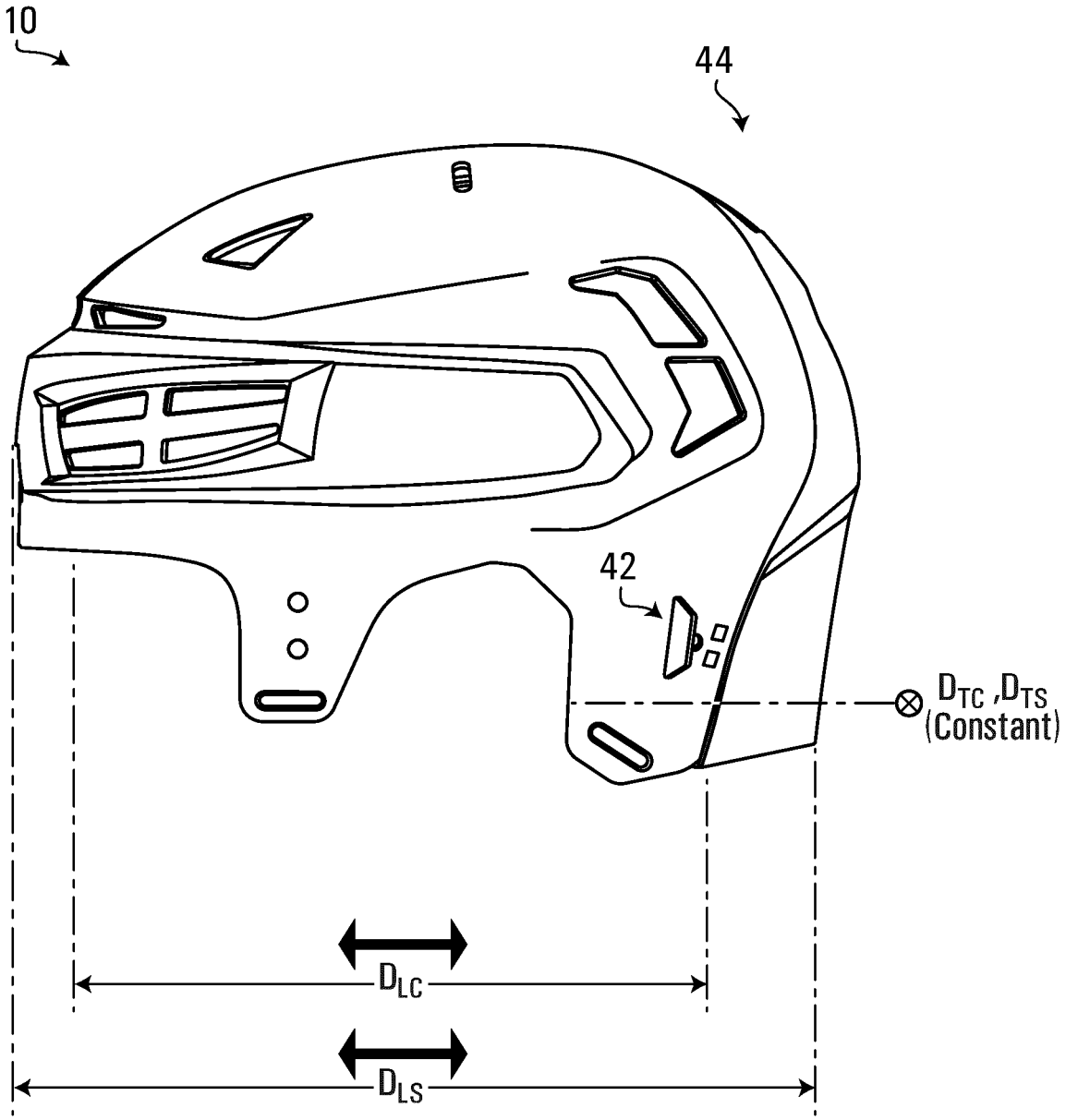
Figure 24:
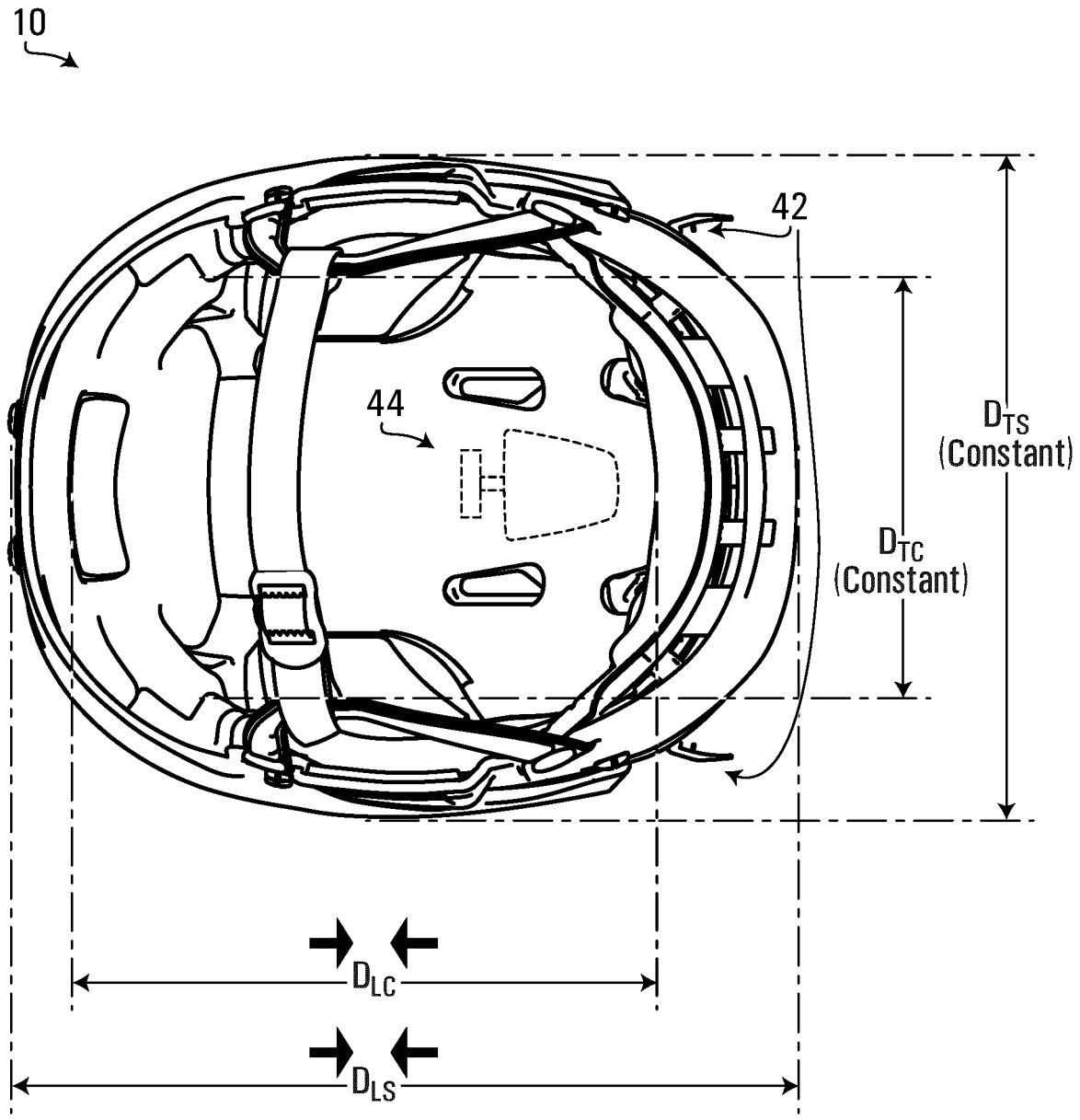
Figure 25:
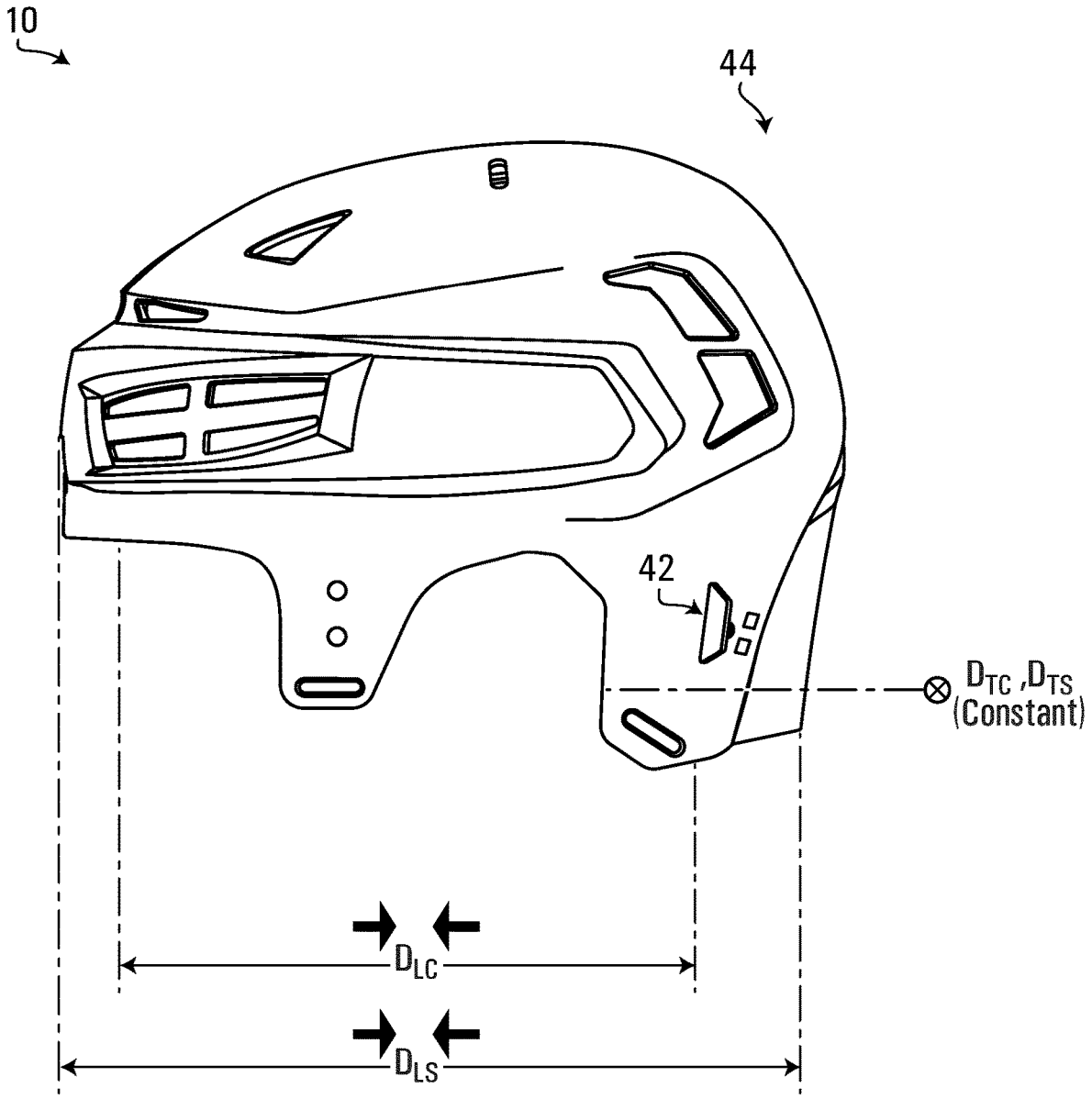
Figure 26:
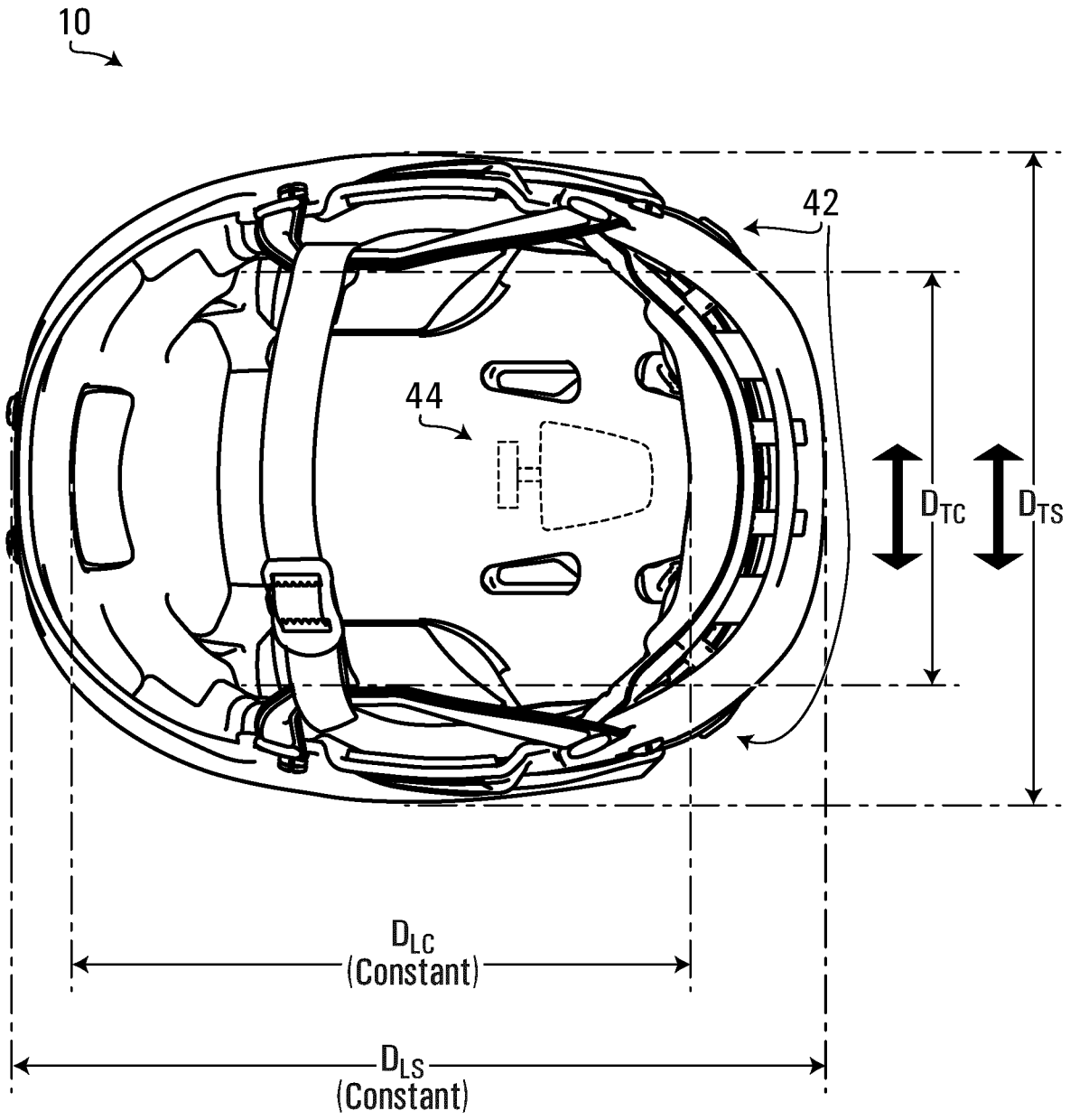
Figure 27:
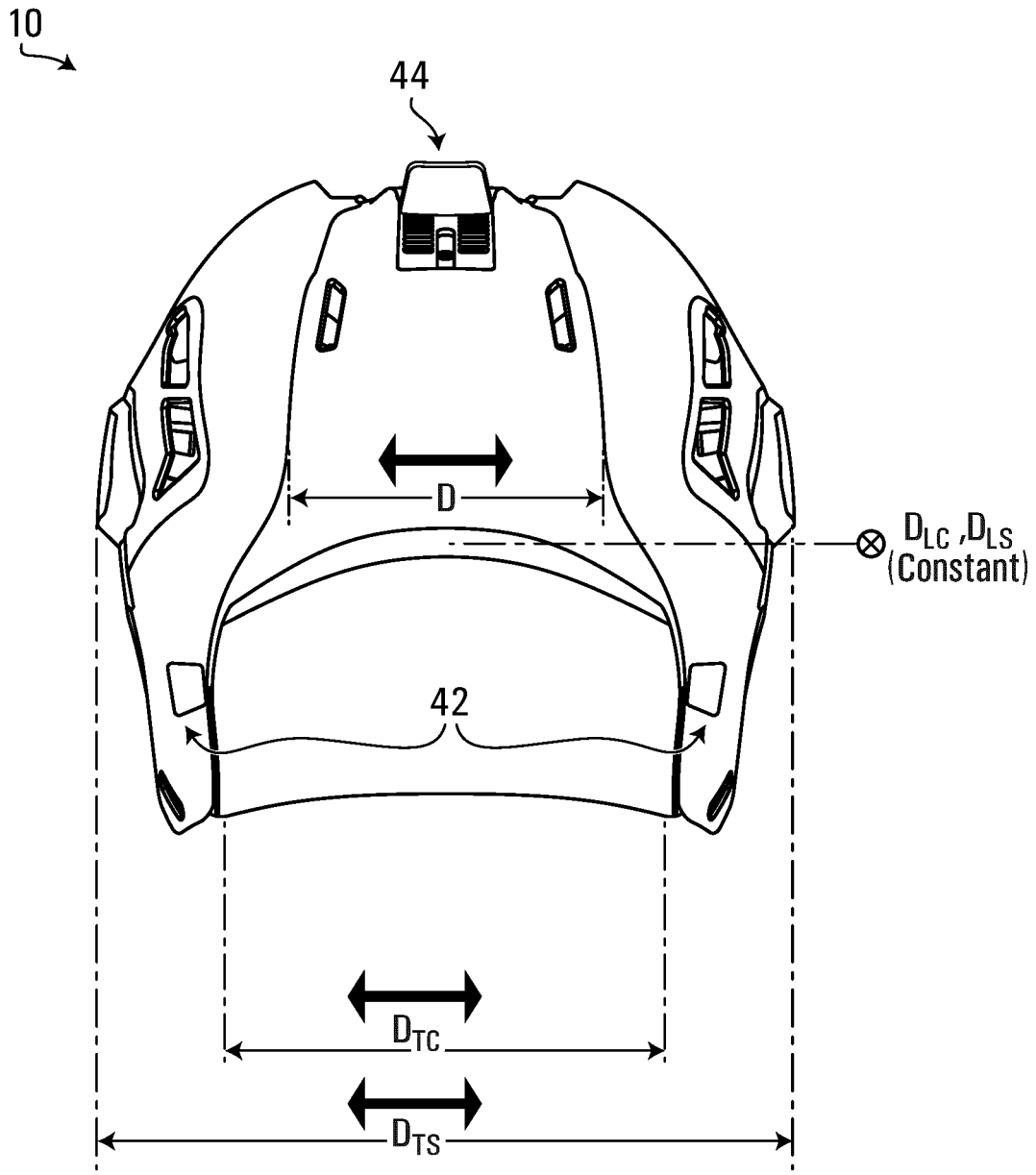
Figure 28:
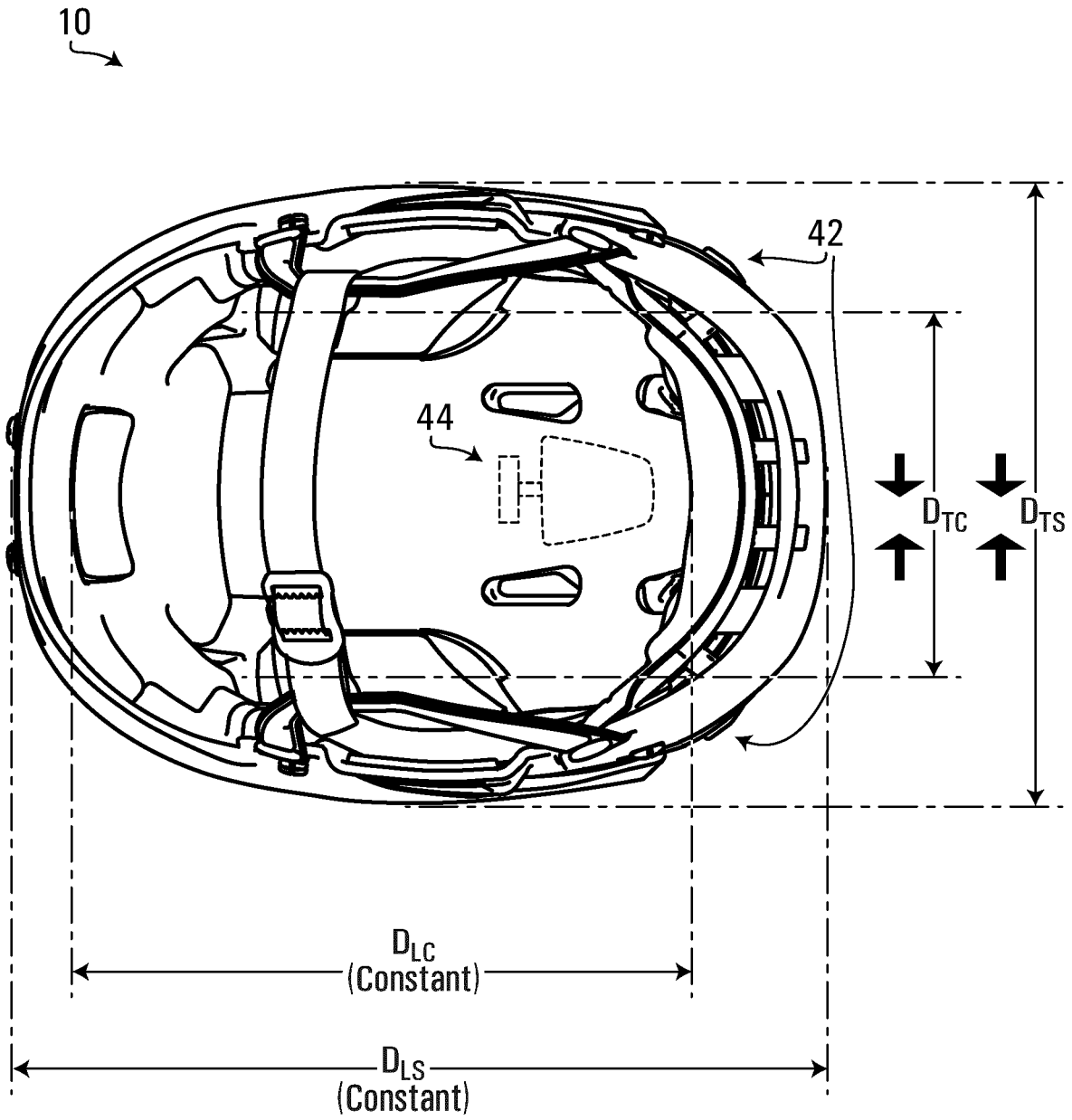
Figure 29:
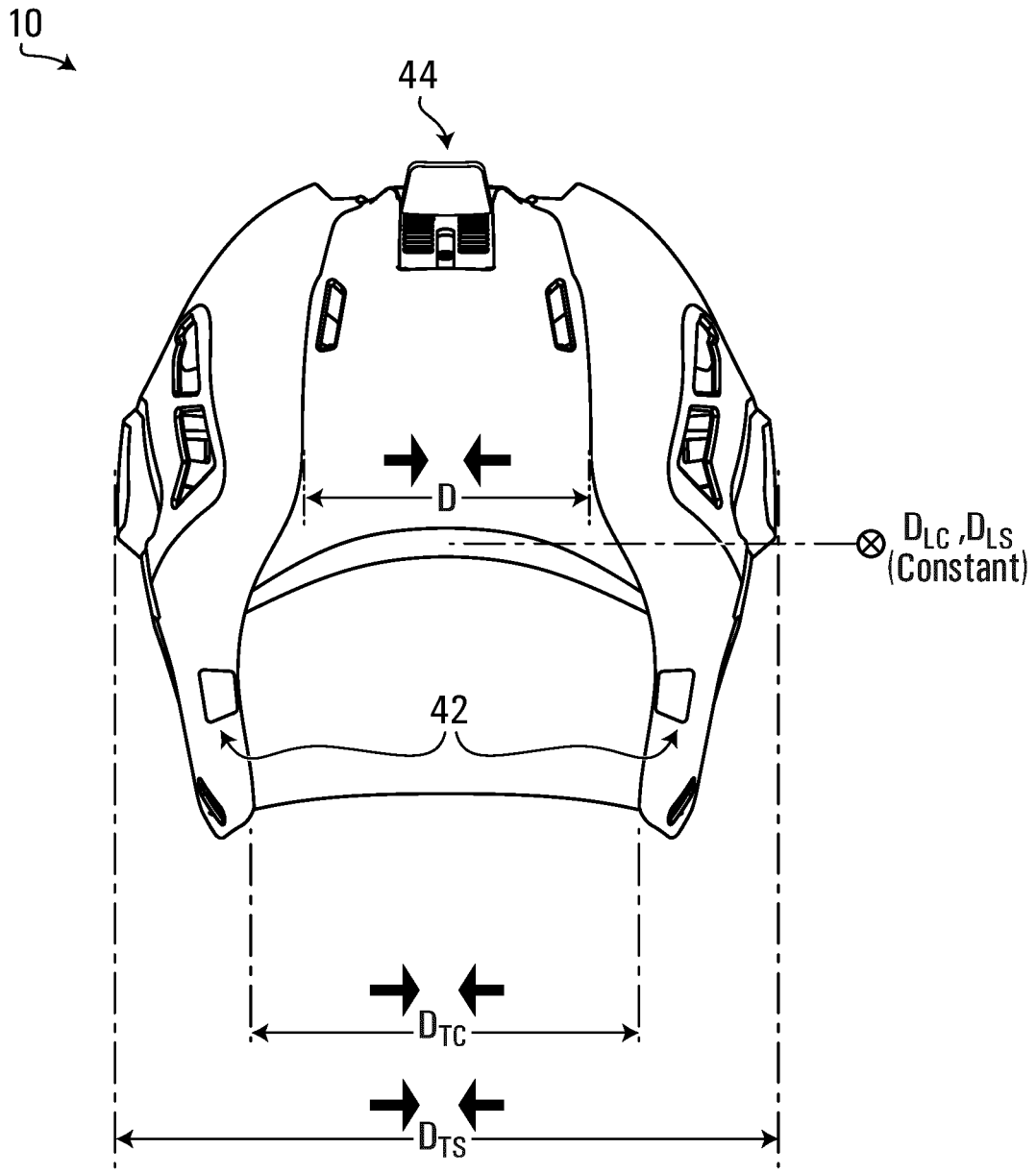

For example, in this embodiment, as shown in FIGS. 22 to 29, the longitudinal adjustment subsystem 42 and the lateral adjustment subsystem 44 may be operated to:

a) increase the longitudinal dimension $D_{LS}$ of the outer shell 12 and the longitudinal dimension $D_{LC}$ of the cavity 13 of the helmet 10 while the lateral dimension $D_{TS}$ of the outer shell 12 and the lateral dimension $D_{TC}$ of the cavity 13 of the helmet 10 remain constant, as shown in FIGS. 22 and 23;

b) decrease the longitudinal dimension $D_{LS}$ of the outer shell 12 and the longitudinal dimension $D_{LC}$ of the cavity 13 of the helmet 10 while the lateral dimension $D_{TS}$ of the outer shell 12 and the lateral dimension $D_{TC}$ of the cavity 13 of the helmet 10 remain constant, as shown in FIGS. 24 and 25;

c) increase the lateral dimension $D_{TS}$ of the outer shell 12 and the lateral dimension $D_{TC}$ of the cavity 13 of the helmet 10 while the longitudinal dimension $D_{LS}$ of the outer shell 12 and the longitudinal dimension $D_{LC}$ of the cavity 13 of the helmet 10 remain constant, as shown in FIGS. 26 and 27; and d) decrease the lateral dimension $D_{TS}$ of the outer shell 12 and the lateral dimension $D_{TC}$ of the cavity 13 of the helmet 10 while the longitudinal dimension $D_{LS}$ of the outer shell 12 and the longitudinal dimension $D_{LC}$ of the cavity 13 of the helmet 10 remain constant, as shown in FIGS. 28 and 29.

In some embodiments, the longitudinal dimension $D_{LS}$ of the outer shell 12 and the lateral dimension $D_{TS}$ of the outer shell 12 may be adjustable independently from one another over at least 20%, in some cases at least 30%, and in some cases at least 40% of the range of adjustability of the longitudinal dimension $D_{LS}$ of the outer shell 12 and/or at least 20%, in some cases at least 30%, and in some cases at least 40% of the range of adjustability of the lateral dimension $D_{TS}$ of the outer shell 12, and/or the longitudinal dimension $D_{LC}$ of the cavity 13 of the helmet 10 and the lateral dimension $D_{TC}$ of the cavity 13 of the helmet 10 may be adjustable independently from one another over at least 20%, in some cases at least 30%, and in some cases at least 40% of the range of adjustability of the longitudinal dimension $D_{LC}$ of the cavity 13 of the helmet 10 and/or at least 20%, in some cases at least 30%, and in some cases at least 40% of the range of adjustability of the lateral dimension $D_{TC}$ of the cavity 13 of the helmet 10.

In this example of implementation, although this may be minimized to significantly favor independent adjustability, depending on how they are set, during adjustment of the fit of the helmet 10, operation of the longitudinal adjustment subsystem 42 and the lateral adjustment subsystem 44 may cause the longitudinal dimension $D_{LS}$ of the outer shell 12 and the lateral dimension $D_{TS}$ of the outer shell 12 to be adjusted simultaneously and dependently on one another over at least part of the range of adjustability of the longitudinal dimension $D_{LS}$ of the outer shell 12 and at least part of the range of adjustability of the lateral dimension $D_{TS}$ of the outer shell 12, and/or may cause the longitudinal dimension $D_{LC}$ of the cavity 13 of the helmet 10 and the lateral dimension $D_{TC}$ of the cavity 13 of the helmet 10 to be adjusted simultaneously and dependently on one another over at least part of the range of adjustability of the longitudinal dimension $D_{LC}$ of the cavity 13 of the helmet 10 and at least part of the range of adjustability of the lateral dimension $D_{TC}$ of the cavity 13 of the helmet 10. That is, adjustment of the longitudinal dimension $D_{LS}$ of the outer shell 12 may simultaneously induce adjustment of the lateral dimension $D_{TS}$ of the outer shell 12 in dependence upon the adjustment of the longitudinal dimension $D_{LS}$ of the outer shell 12 or vice versa, and adjustment of the longitudinal dimension $D_{LC}$ of the cavity 13 of the helmet 10 may simultaneously induce adjustment of the lateral dimension $D_{TC}$ of the cavity 13 of the helmet 10 in dependence upon the adjustment of the longitudinal dimension $D_{LC}$ of the cavity 13 of the helmet 10 or vice versa.

Figure 30:
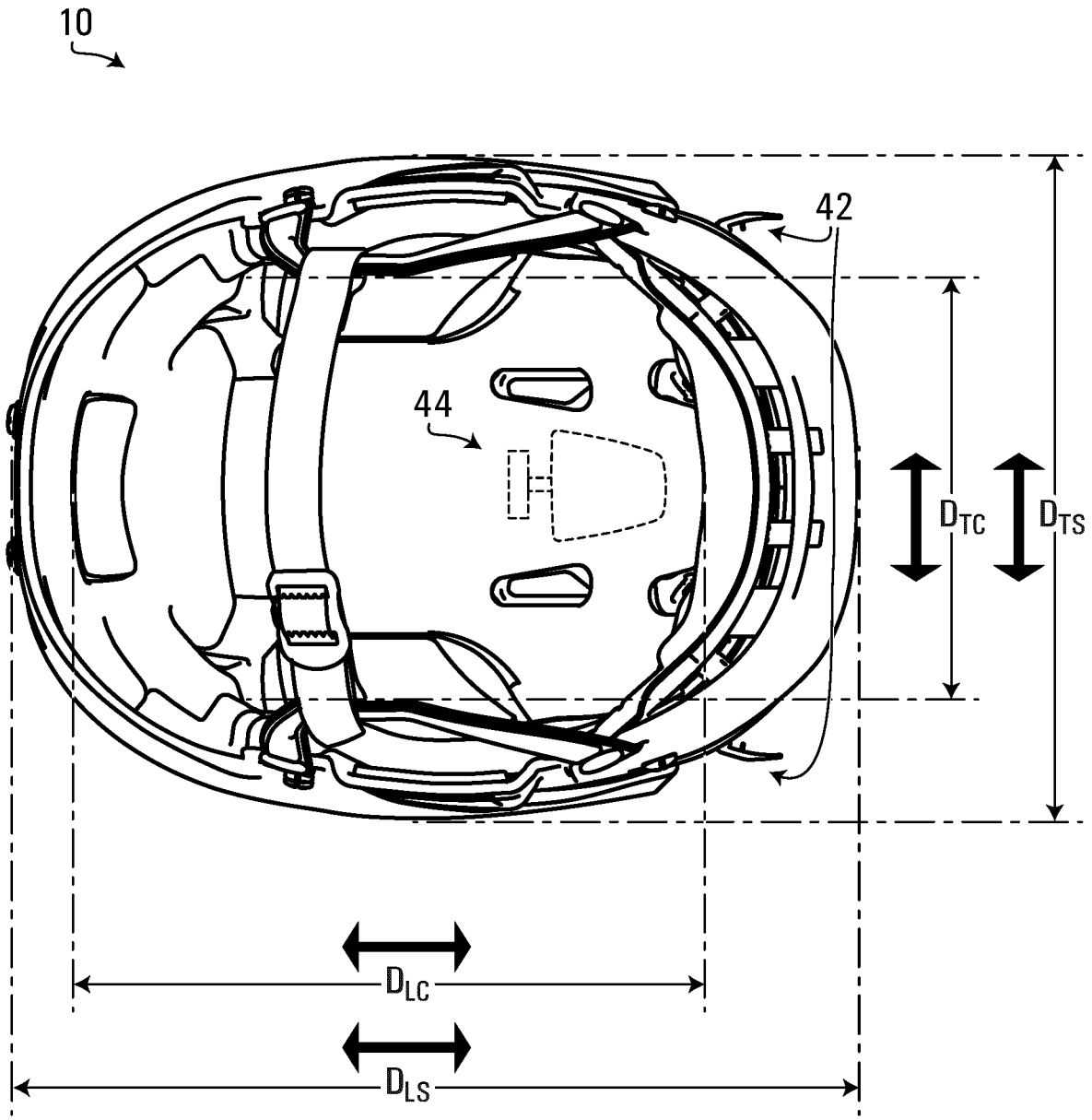
FIGS. 30 to 33 show lateral and longitudinal dimensions changes of the helmet dependent on one another.
Figure 31:
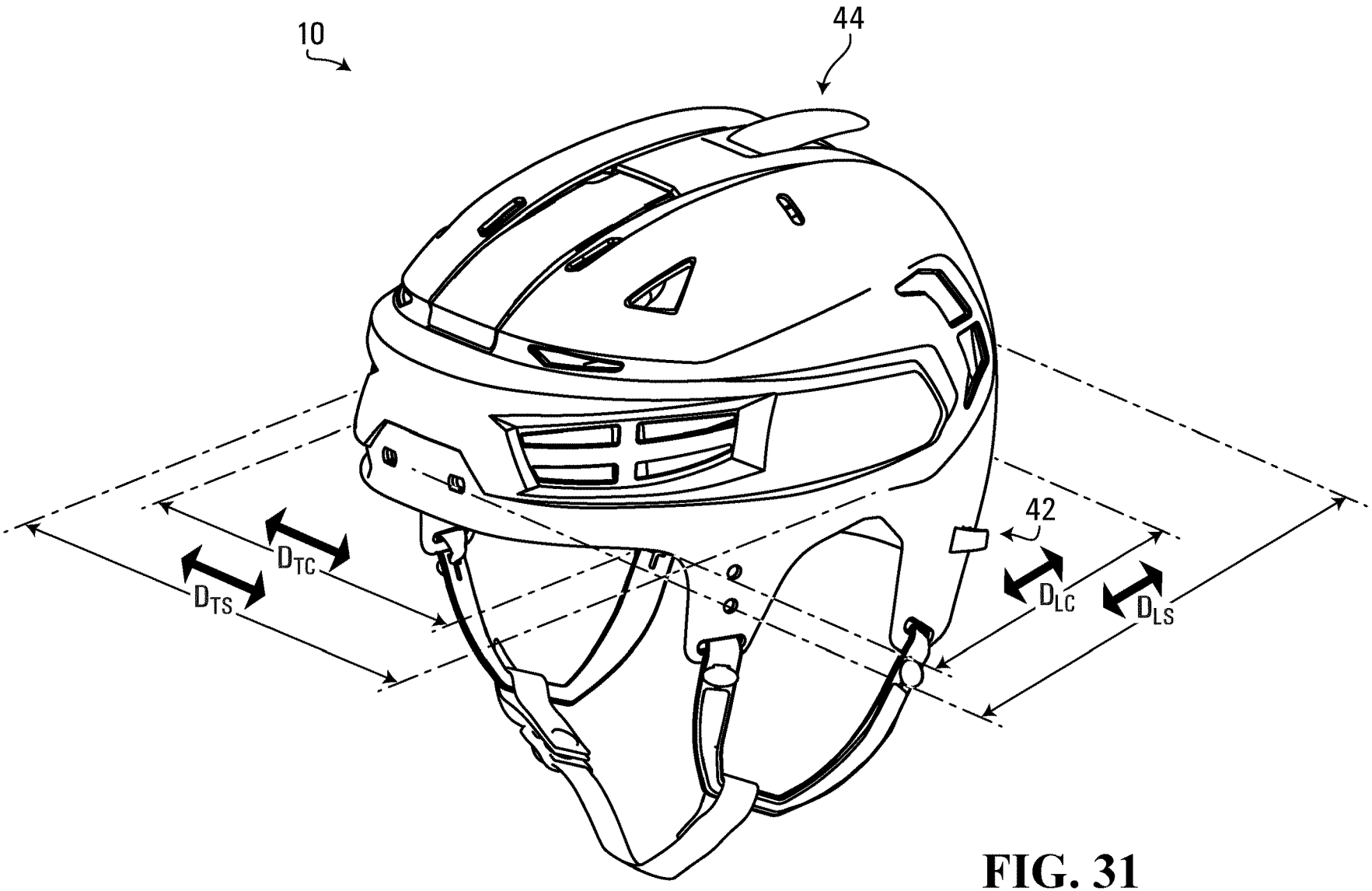
Figure 32:
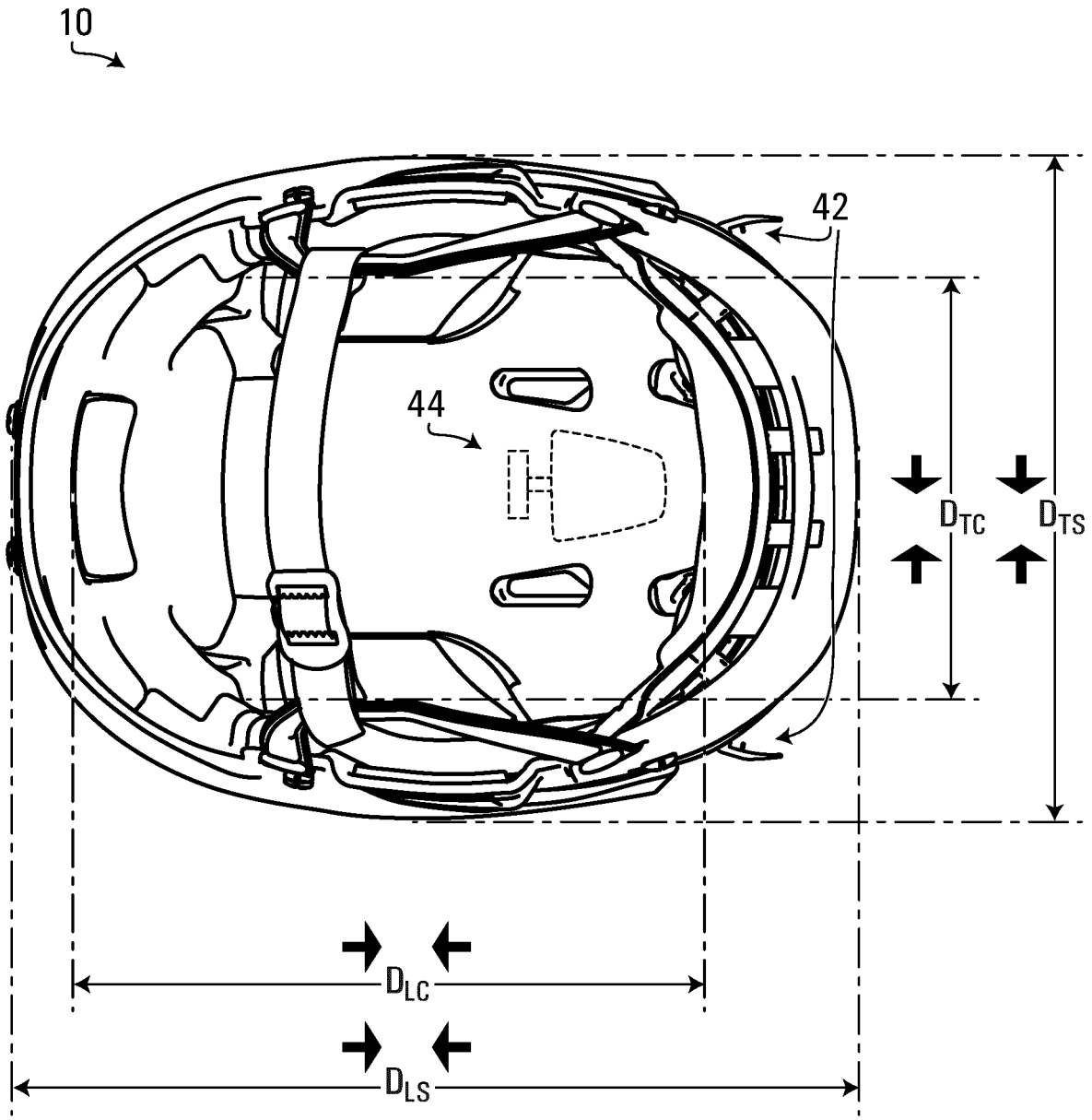
Figure 33:
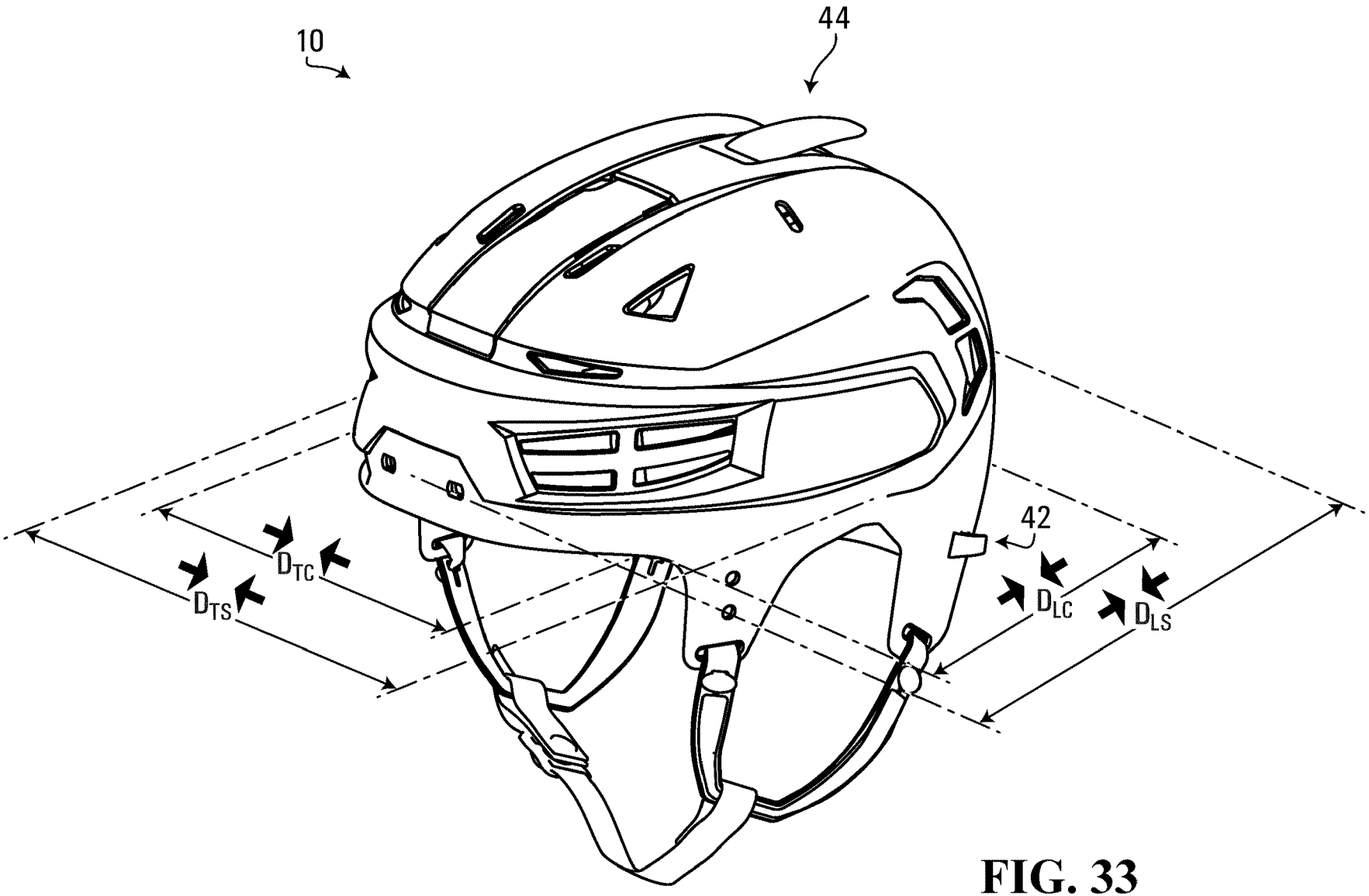
Figure 34:
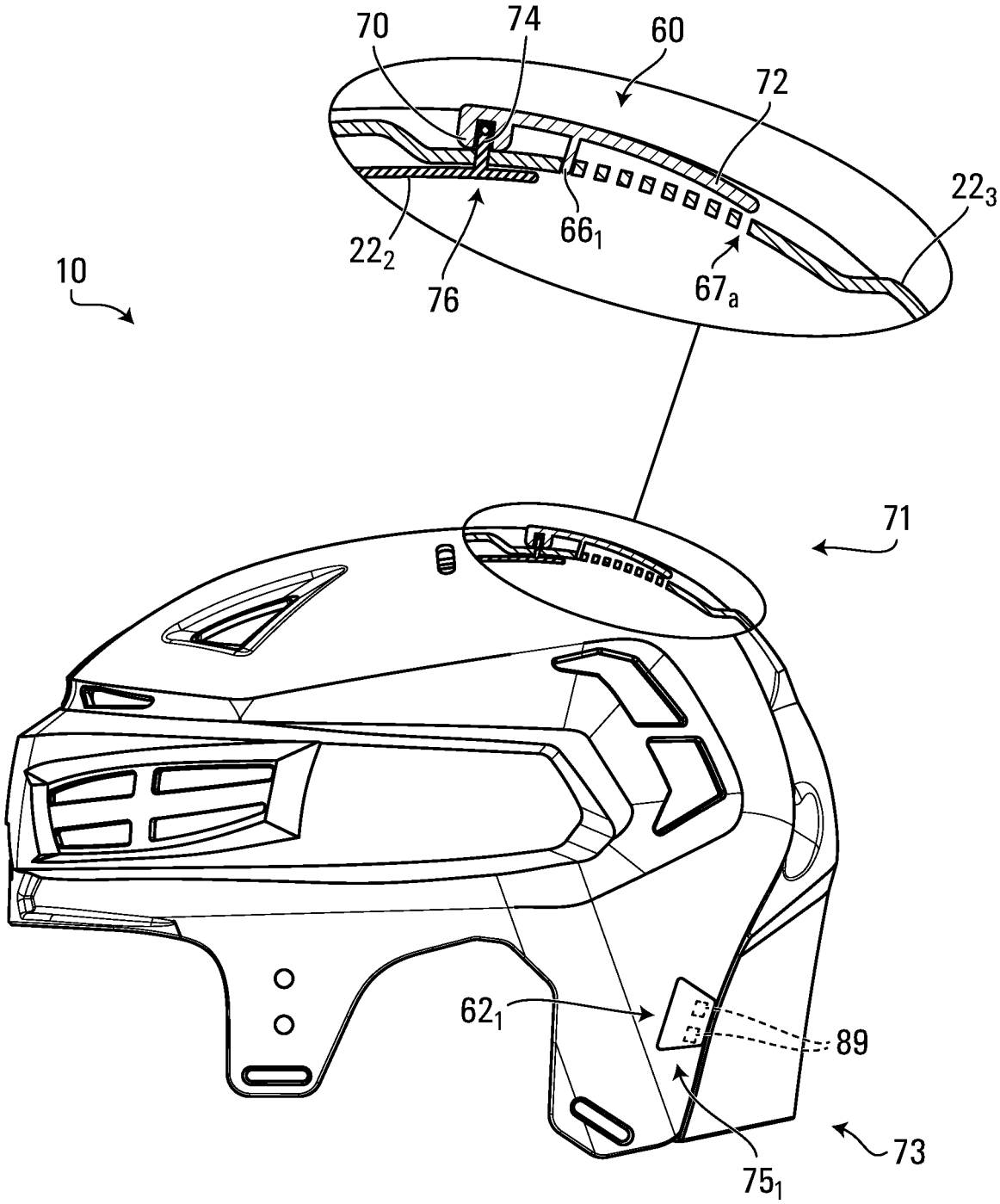
FIGS. 34 to 41 show an example of implementation of the adjustment system.
Figure 35:
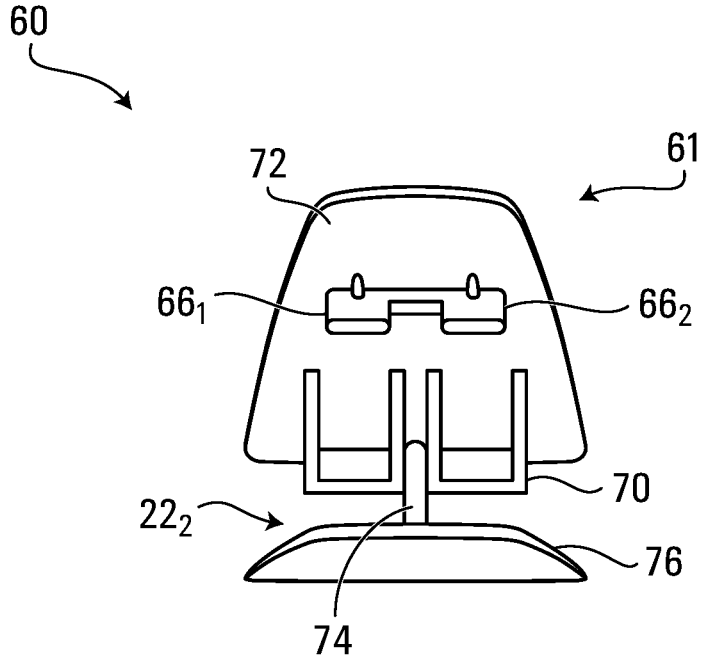
Figure 36:
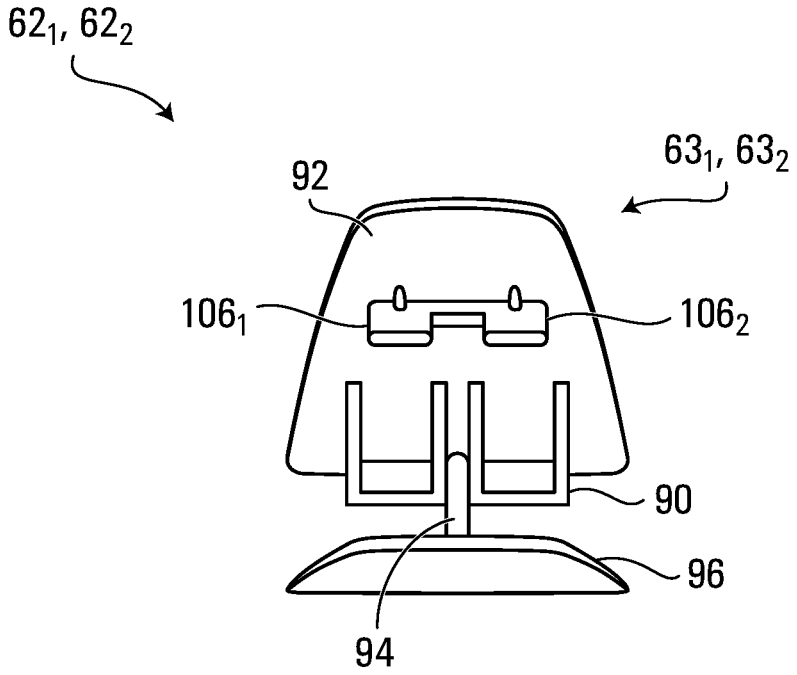
Figure 37:
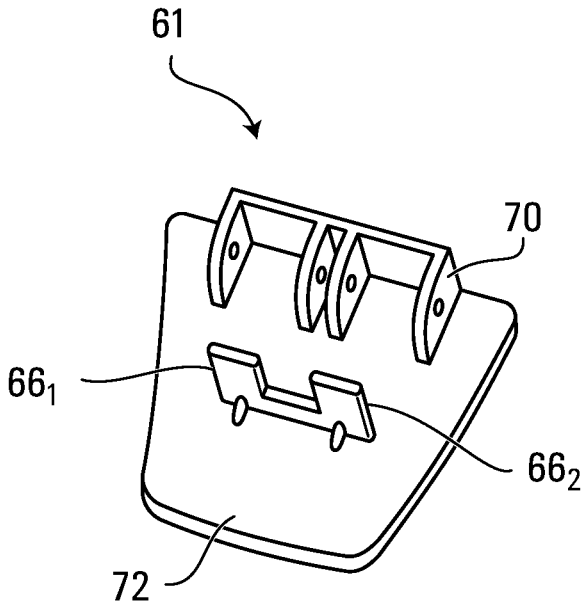
Figure 38:
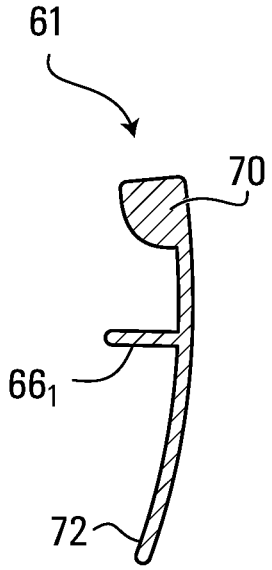
Figure 39:
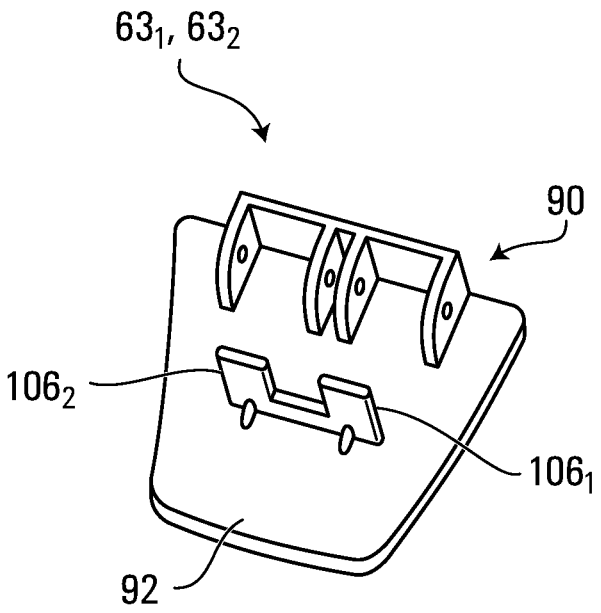
Figure 40:
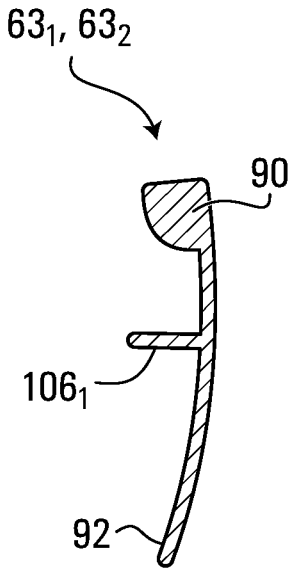
Figure 41:
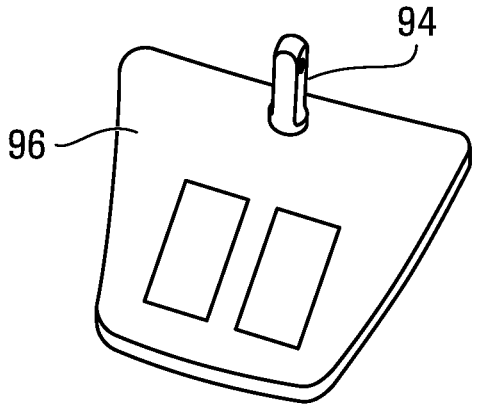
Figure 42:
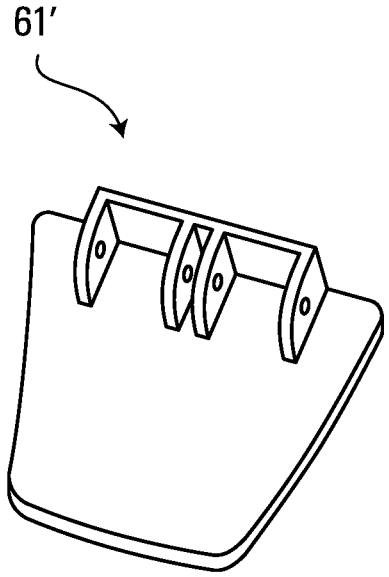
FIGS. 42 to 45 show another example of implementation of the locks.
Figure 43:
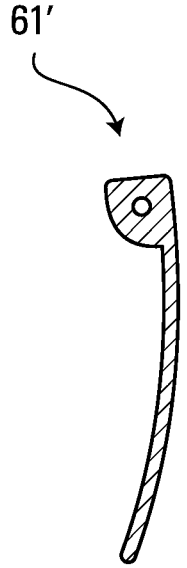
Figure 44:
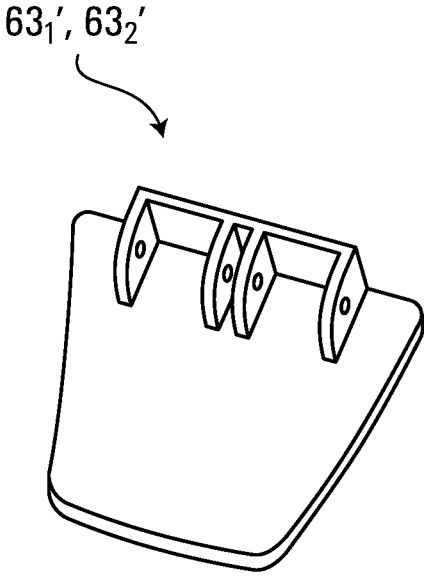
Figure 45:
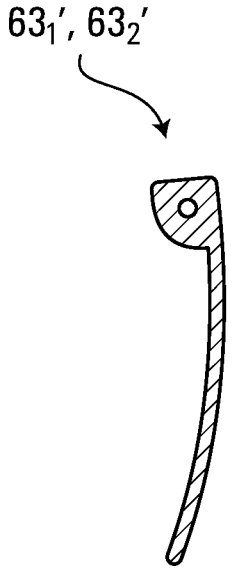
Figure 46:
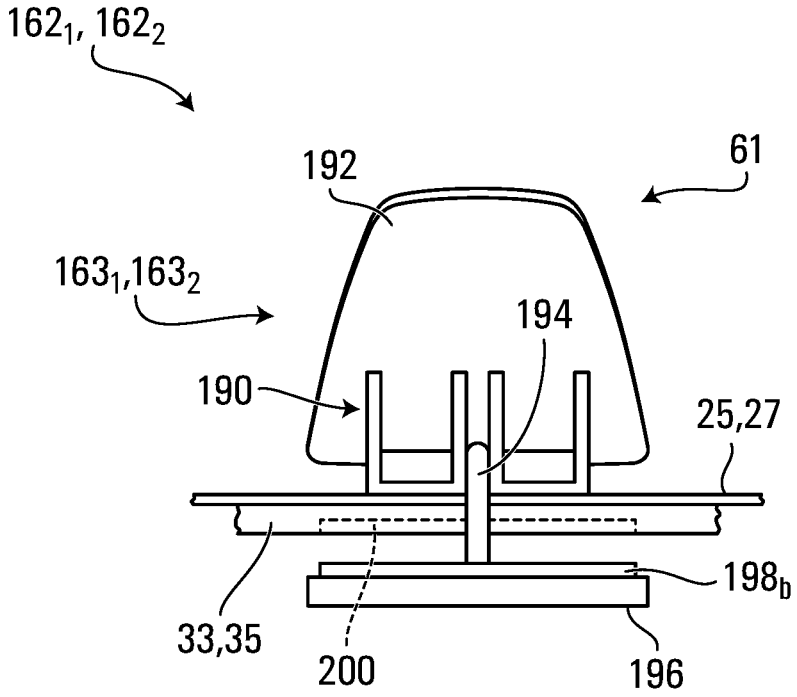
FIGS. 46 to 49 show another example of implementation of the longitudinal adjustment subsystem.
Figure 47:
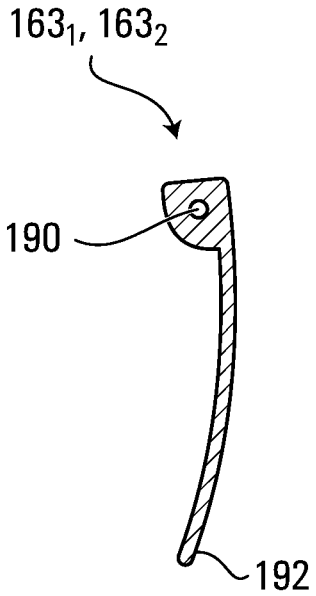
Figure 48:
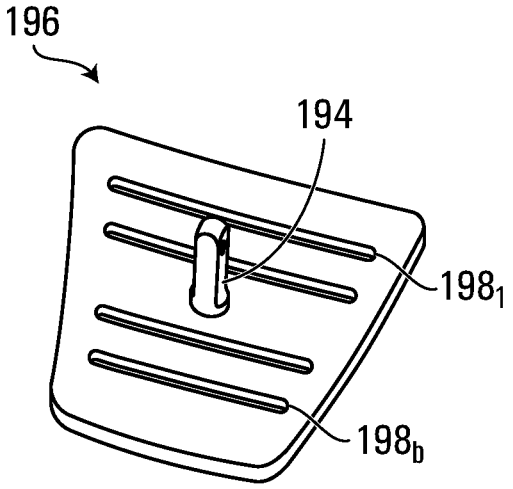
Figure 49:
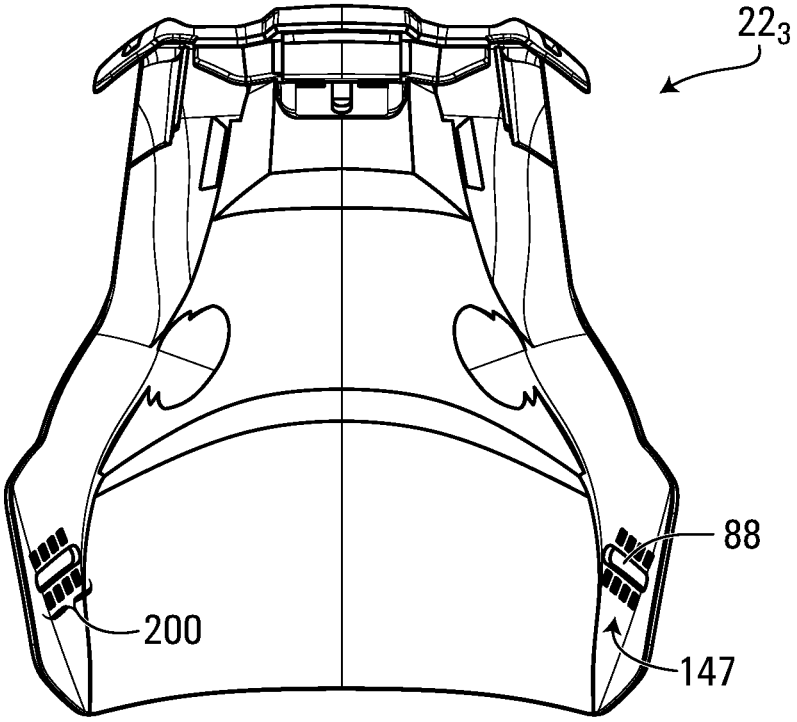
Figure 50:
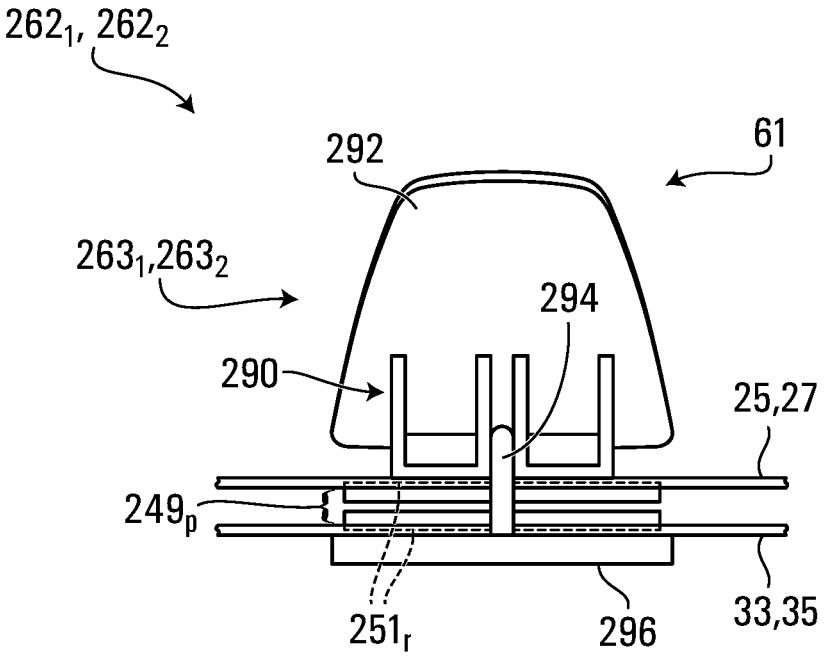
FIGS. 50 to 54 show another example of implementation of the longitudinal adjustment subsystem.
Figure 51:
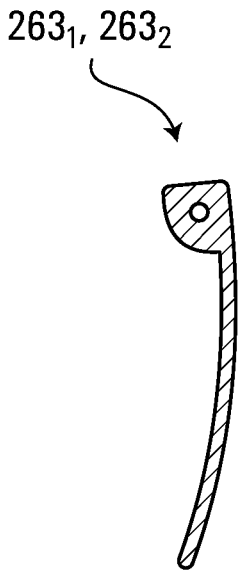
Figure 52:
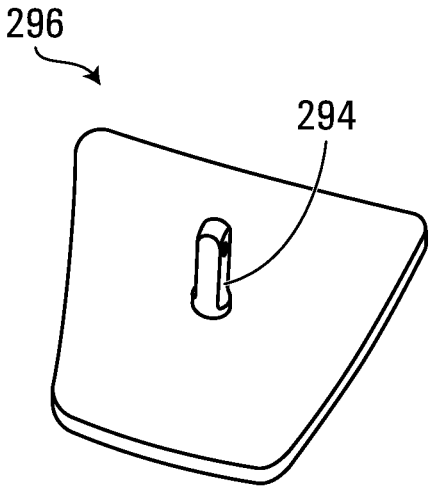
Figure 53:
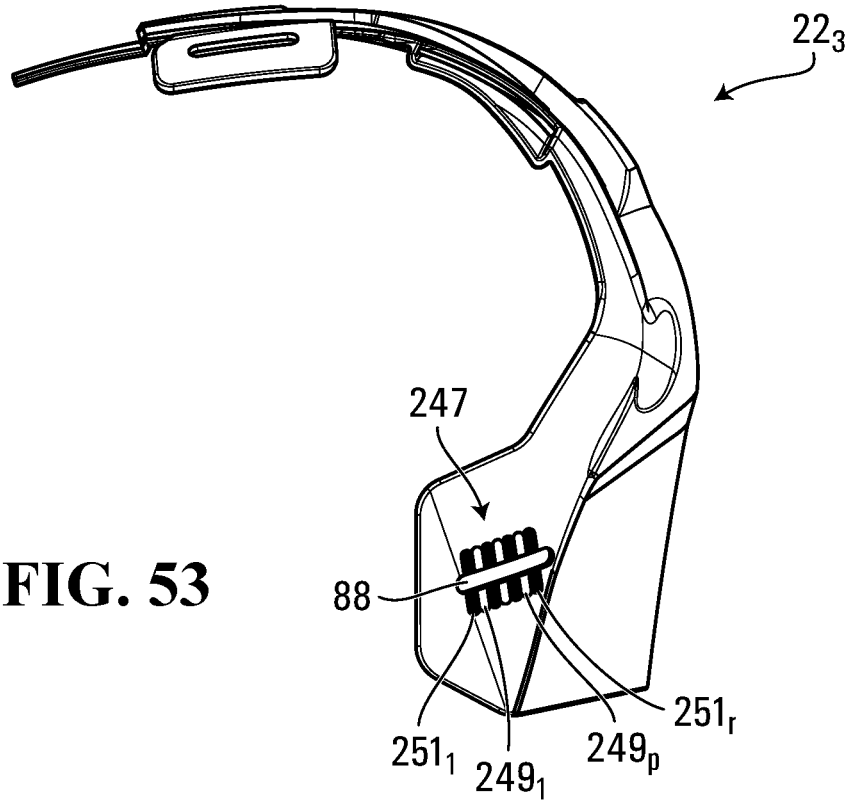
Figure 54:
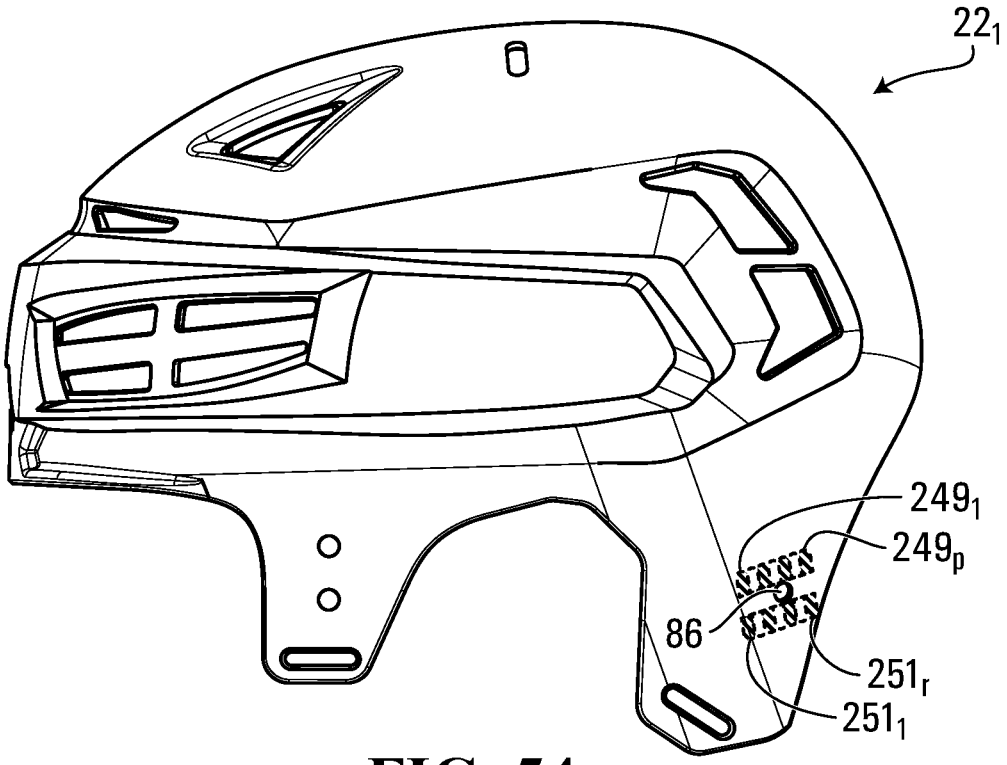
Figure 55:
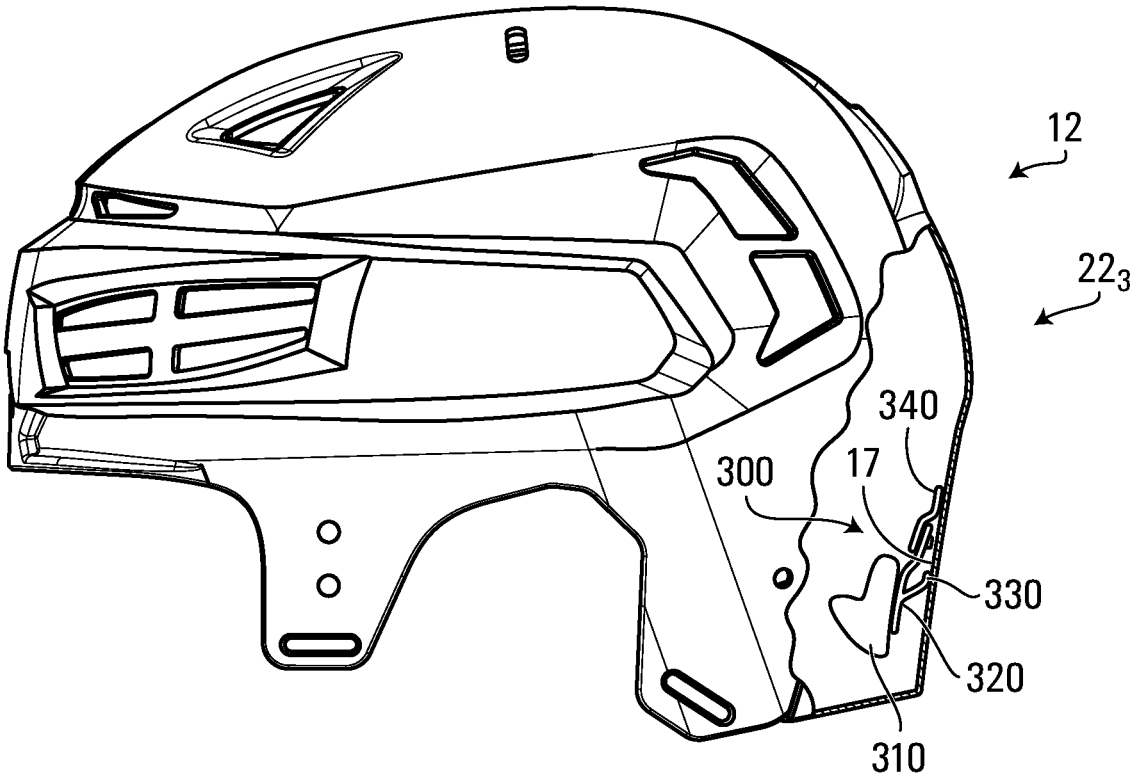
FIGS. 55 to 62 show an example of implementation of the occipital pad mechanism.
Figure 56:
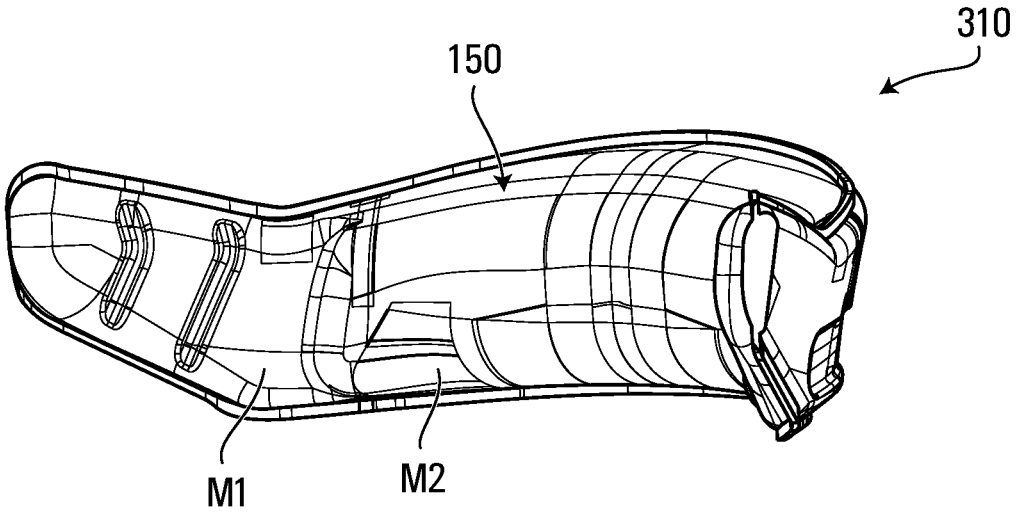
Figure 57:
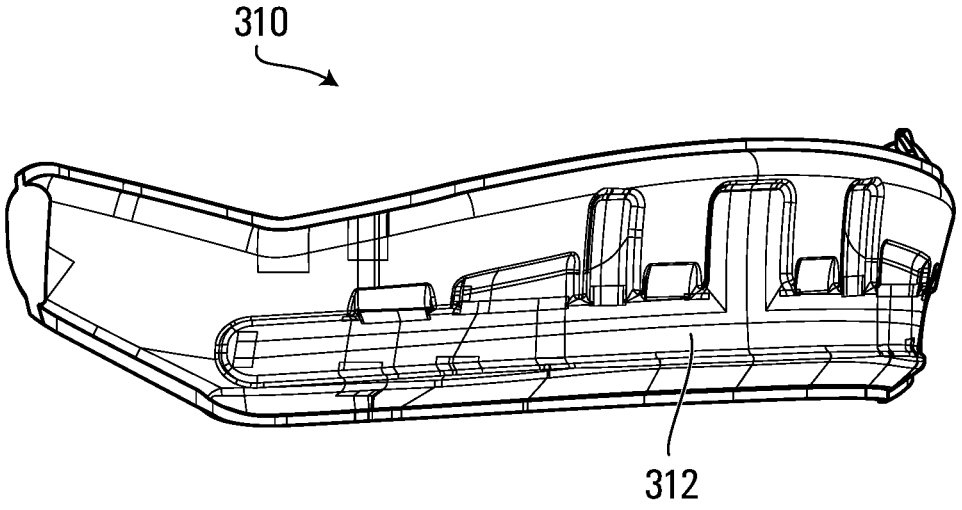
Figure 58:
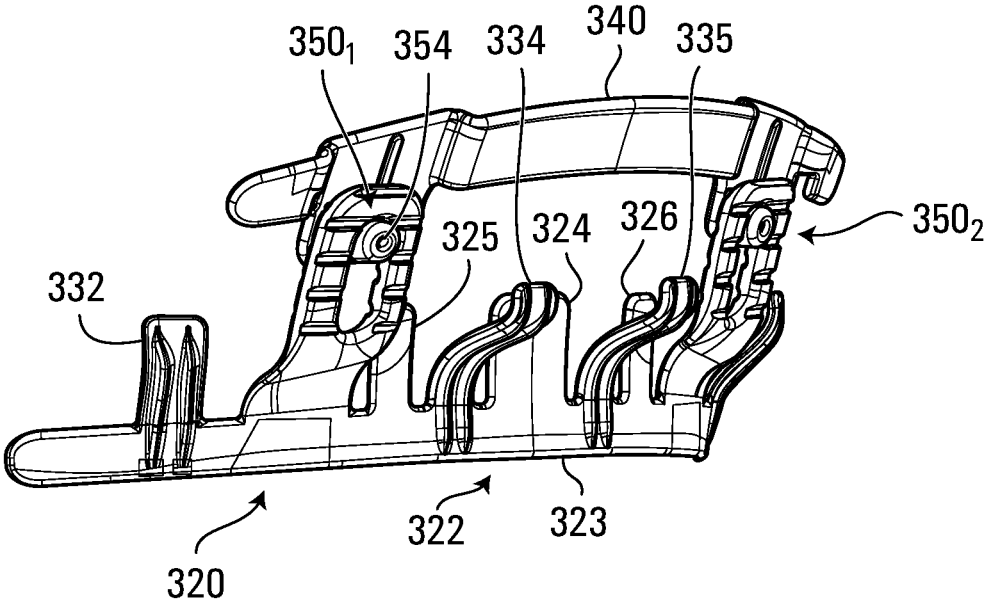
Figure 59:
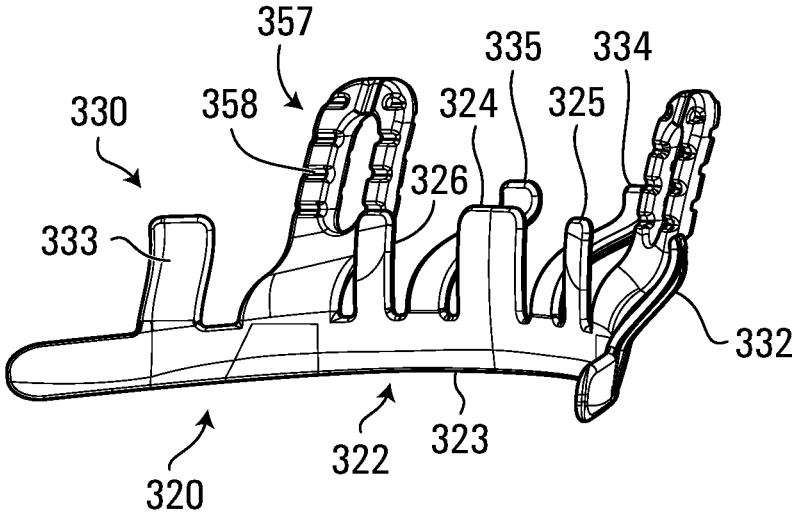
Figure 60:
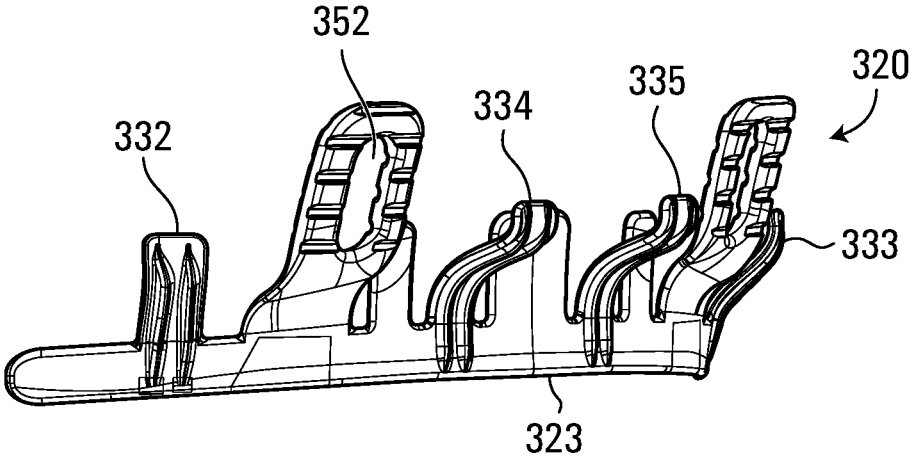
Figure 61:
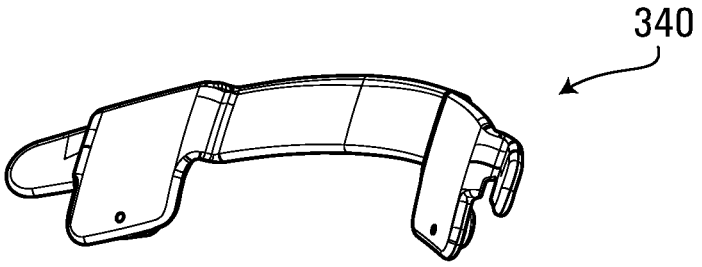
Figure 62:
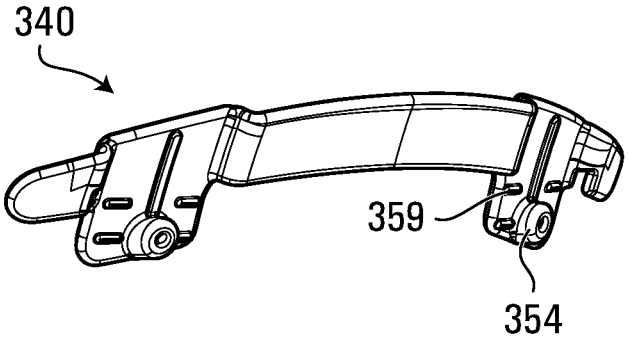

For example, in this embodiment, as shown in FIGS. 30 to 33, operation of the longitudinal adjustment subsystem 42 and the lateral adjustment subsystem 44 may:

a) increase the longitudinal dimension $D_{LS}$ of the outer shell 12 and the longitudinal dimension $D_{LC}$ of the cavity 13 of the helmet 10 while also increasing the lateral dimension $D_{TS}$ of the outer shell 12 and the lateral dimension $D_{TC}$ of the cavity 13 of the helmet 10, as shown in FIGS. 30 and 31, or vice versa; and b) decrease the longitudinal dimension $D_{LS}$ of the outer shell 12 and the longitudinal dimension $D_{LC}$ of the cavity 13 of the helmet 10 while also decreasing the lateral dimension $D_{TS}$ of the outer shell 12 and the lateral dimension $D_{TC}$ of the cavity 13 of the helmet 10, as shown in FIGS. 32 and 33, or vice versa.

In some embodiments, the longitudinal dimension $D_{LS}$ of the outer shell 12 and the lateral dimension $D_{TS}$ of the outer shell 12 may be adjustable simultaneously and dependently on one another over no more than 20%, in some cases no more than 15%, and in some cases no more than 10% of the range of adjustability of the longitudinal dimension $D_{LS}$ of the outer shell 12 and/or no more than 20%, in some cases no more than 15%, and in some cases at least 10% of the range of adjustability of the lateral dimension $D_{TS}$ of the outer shell 12, and/or the longitudinal dimension $D_{LC}$ of the cavity 13 of the helmet 10 and the lateral dimension $D_{TC}$ of the cavity 13 of the helmet 10 may be adjustable simultaneously and dependently on one another over no more than 30%, in some cases no more than 20%, and in some cases no more than 10% of the range of adjustability of the longitudinal dimension $D_{LC}$ of the cavity 13 of the helmet 10 and/or no more than 30%, in some cases no more than 20%, and in some cases no more than 10% of the range of adjustability of the lateral dimension $D_{TC}$ of the cavity 13 of the helmet 10.

With continued reference to FIGS. 34 to 41, in this embodiment, the adjustment system 40 comprises a plurality of actuators 60, $\mathbf{62}_1$, $\mathbf{62}_2$ that are manually operable by the user to adjust the fit of the helmet 10. Each of the actuators 60, $\mathbf{62}_1$, $\mathbf{62}_2$ is manually operable in that it can be operated toollessly (i.e., without using any tool such as a screwdriver or other tool engaging it). The actuators 60, $\mathbf{62}_1$, $\mathbf{62}_2$ are operable independently from one another.

In this embodiment, the actuator 60 is disposed in an upper portion 71 of the helmet 10 while the actuators $\mathbf{62}_1$, $\mathbf{62}_2$ are disposed in a lower portion 73 of the helmet 10. In this example, the actuator 60 is a central actuator disposed in a central region 77 of the upper portion 71 of the helmet 10 and the actuators $\mathbf{62}_1$, $\mathbf{62}_2$ are lateral actuators respectively disposed in lateral regions $\mathbf{75}_1$, $\mathbf{75}_2$ of the lower portion 73 of the helmet 10 that are opposite to one another.

More particularly, in this embodiment, the actuators $\mathbf{62}_1$, $\mathbf{62}_2$ are configured to adjust the longitudinal dimension $D_{LS}$ of the outer shell 12 and the longitudinal dimension $D_{LC}$ of the cavity 13 of the helmet 10 such that each of the longitudinal dimension $D_{LS}$ of the outer shell 12 and the longitudinal dimension $D_{LC}$ of the cavity 13 of the helmet 10 is at least primarily (i.e., primarily or entirely) adjustable by operating the actuators $\mathbf{62}_1$, $\mathbf{62}_2$, whereas the actuator 60 is configured to adjust the lateral dimension $D_{TS}$ of the outer shell 12 and the lateral dimension $D_{TC}$ of the cavity 13 of the helmet 10 such that each of the lateral dimension $D_{TS}$ of the outer shell 12 and the lateral dimension $D_{TC}$ of the cavity 13 of the helmet 10 is at least primarily (i.e., primarily or entirely) adjustable by operating the actuator 60.

The actuators 60, $\mathbf{62}_1$, $\mathbf{62}_2$ may be implemented in any suitable way. In this embodiment, the actuators 60, $\mathbf{62}_1$, $\mathbf{62}_2$ respectively comprise a plurality of locks 61, $\mathbf{63}_1$, $\mathbf{63}_2$ that are operable to selectively lock and unlock the shell members $\mathbf{22}_1$-$\mathbf{22}_3$ relative to one another in order to selectively allow and prevent movement of the shell members $\mathbf{22}_1$-$\mathbf{22}_3$ relative to one another, and thus movement of the pads $\mathbf{36}_1$-$\mathbf{36}_N$, $\mathbf{64}_1$-$\mathbf{64}_K$ connected to the shell members $\mathbf{22}_1$-$\mathbf{22}_3$ relative to one another, so as to adjust the fit of the helmet 10. Each of the locks 61, $\mathbf{63}_1$, $\mathbf{63}_2$ is movable by the user between a locked position, in which it engages a lock-engaging part of the helmet 10 to prevent adjacent ones of the shell members $\mathbf{22}_1$-$\mathbf{22}_3$ from moving relative to one another, and an unlocked position, in which it is disengaged from the lock-engaging part of the helmet 10 to allow the adjacent ones of the shell members $\mathbf{22}_1$-$\mathbf{22}_3$ to move relative to one another so as to adjust the fit of the helmet 10.

More particularly, in this embodiment, the lock 61 is movable by the user between its locked position, in which it engages a lock-engaging part 45 associated with the rear shell member $\mathbf{22}_3$ to prevent the top shell member $\mathbf{22}_2$ and the rear shell member $\mathbf{22}_3$ from moving relative to one another, and its unlocked position, in which it is disengaged from the lock-engaging part 45 associated with the rear shell member $\mathbf{22}_3$ to allow the top shell member $\mathbf{22}_2$ and the rear shell member $\mathbf{22}_3$ to move relative to one another. When the lock 61 is in its unlocked position, the user can manually move the top shell member $\mathbf{22}_2$ and the rear shell member $\mathbf{22}_3$ relative to one another by pushing or pulling on at least one of the top shell member $\mathbf{22}_2$ and the rear shell member $\mathbf{22}_3$. While the top shell member $\mathbf{22}_2$ and the rear shell member $\mathbf{22}_3$ are moving relative to one another, the domed surface of the upper rear portion 30 of the rear shell member $\mathbf{22}_3$ interacts with the rearmost portions of the lateral portions 25, 27 of the front shell member $\mathbf{22}_1$ such that a distance D between the rearmost portions of the lateral portions 25, 27 of the front shell member $\mathbf{22}_1$ may vary to adjust the lateral dimension $D_{TS}$ of the outer shell 12 and the lateral dimension $D_{TC}$ of the cavity 13 of the helmet 10. More particularly, the distance D between the rearmost portions of the lateral portions 25, 27 of the front shell member $\mathbf{22}_1$:

a) increases when the domed surface of the upper rear portion 30 is pushed outwardly towards the rearmost portions of the lateral portions 25, 27, thereby increasing the lateral dimension $D_{TS}$ of the outer shell 12 and/or the lateral dimension $D_{TC}$ of the cavity 13 of the helmet 10; and b) decreases when the domed surface of the upper rear portion 30 is retracted inwardly towards the front portion 23 of the front shell member $\mathbf{22}_1$.

In this embodiment, the lock 61 resides on the rear shell member $\mathbf{22}_3$ and is pivotable relative to the rear shell member $\mathbf{22}_3$ and the top shell member $\mathbf{22}_2$ between its locked position and its unlocked position. More particularly, in this embodiment, the lock 61 comprises a pivotable handle 72 that is manually operable by the user to move the lock 61 from its locked position to its unlocked position and vice versa. Also, in this embodiment, the lock 61 comprises a cam 70. The handle 72 is mounted on a cam post 74 extending through an opening 80 (e.g. a slot) in the rear shell member $\mathbf{22}_3$. The cam post 74 is attached to a cam plate 76 located beneath the rear shell member $\mathbf{22}_3$. The cam plate 76 can be implemented in any suitable way. For instance, in this embodiment, a rearmost portion of the top shell member $\mathbf{22}_2$ forms the cam plate 76 itself (i.e. the cam plate 76 is integrally part of the top shell member $\mathbf{22}_2$). In other embodiments, the cam plate 76 may be a separate part attached (e.g., fastened or bonded) to an end of the cam post 74. In such embodiments, the cam plate 76 is located inwardly relative to the rearmost portion of the top shell member $\mathbf{22}_2$ (i.e. the cam post 74 extends through an opening 82 in the rearmost portion of the top shell member $\mathbf{22}_2$, and the rearmost portion of the top shell member $\mathbf{22}_2$ is sandwiched between the cam plate 76 and an inner surface of the rear shell member $\mathbf{22}_3$).

In this embodiment, the lock 61 also comprises a plurality of locking projections $\mathbf{66}_1$, $\mathbf{66}_2$ configured to be received in a locking void 65 of the lock-engaging part 45 of the helmet 10 when the lock 61 is in the locked position, as will be discussed later. The locking projections $\mathbf{66}_1$, $\mathbf{66}_2$ of the lock 61 may be viewed as locking teeth disposed side-by-side. In other embodiments, there may be more locking projections or a single locking projection such as the locking projections $\mathbf{66}_1$, $\mathbf{66}_2$.

Figure 1:
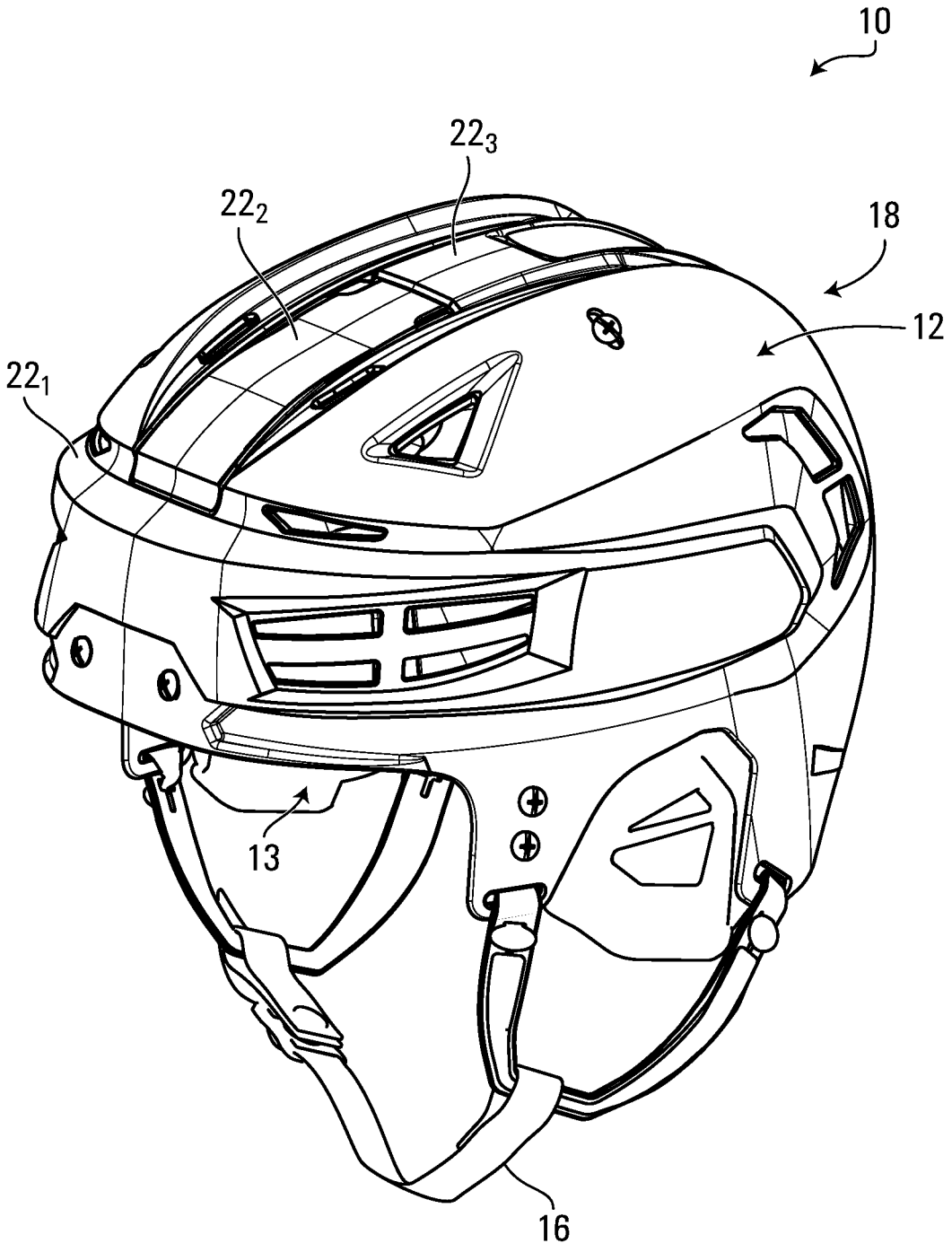
FIG. 1 shows an example of an embodiment of a helmet for protecting a head of a user.
Figure 2:
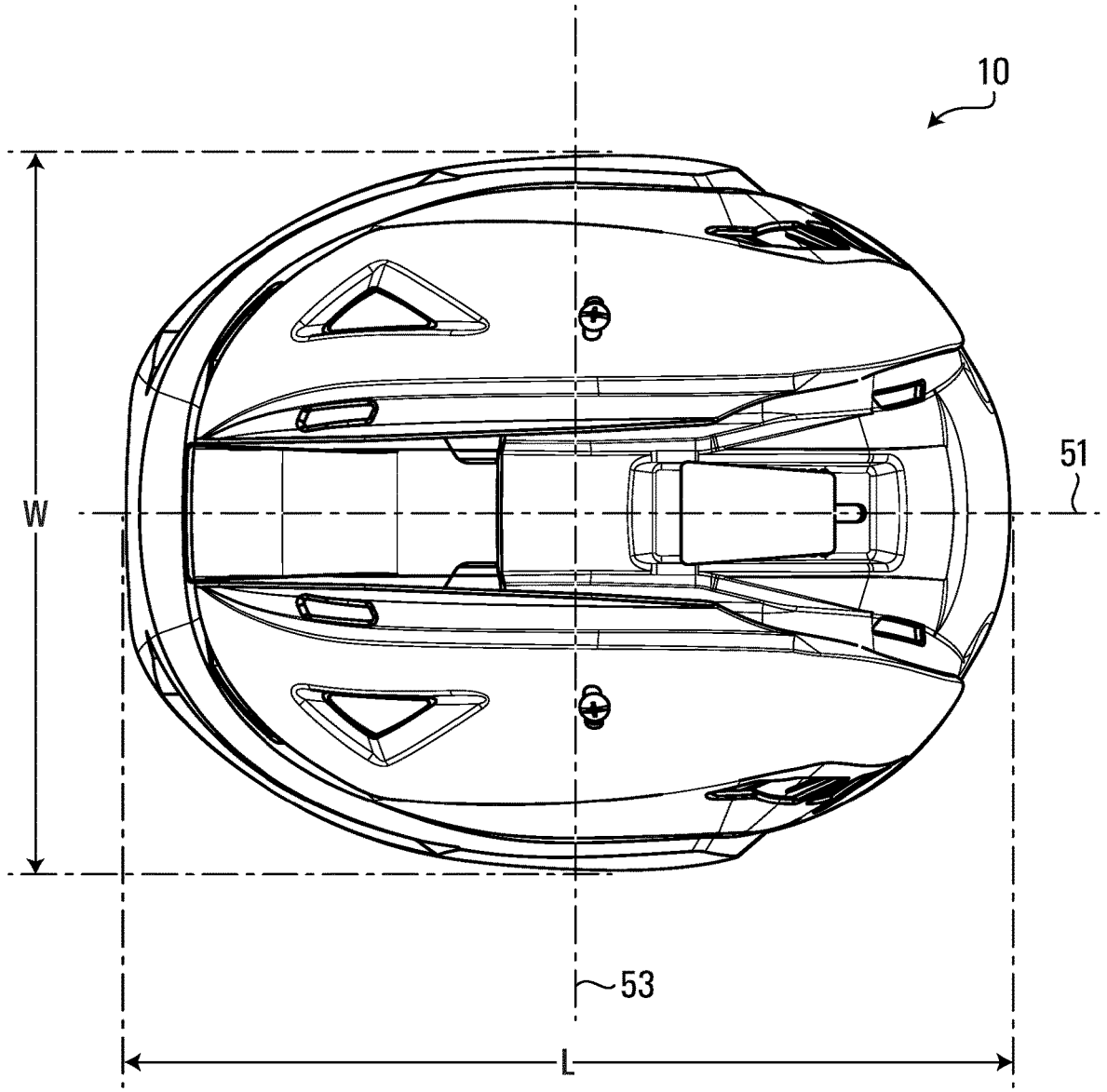
FIGS. 2 to 5 show a top, front, rear and rear perspective views of the helmet.
Figure 3:
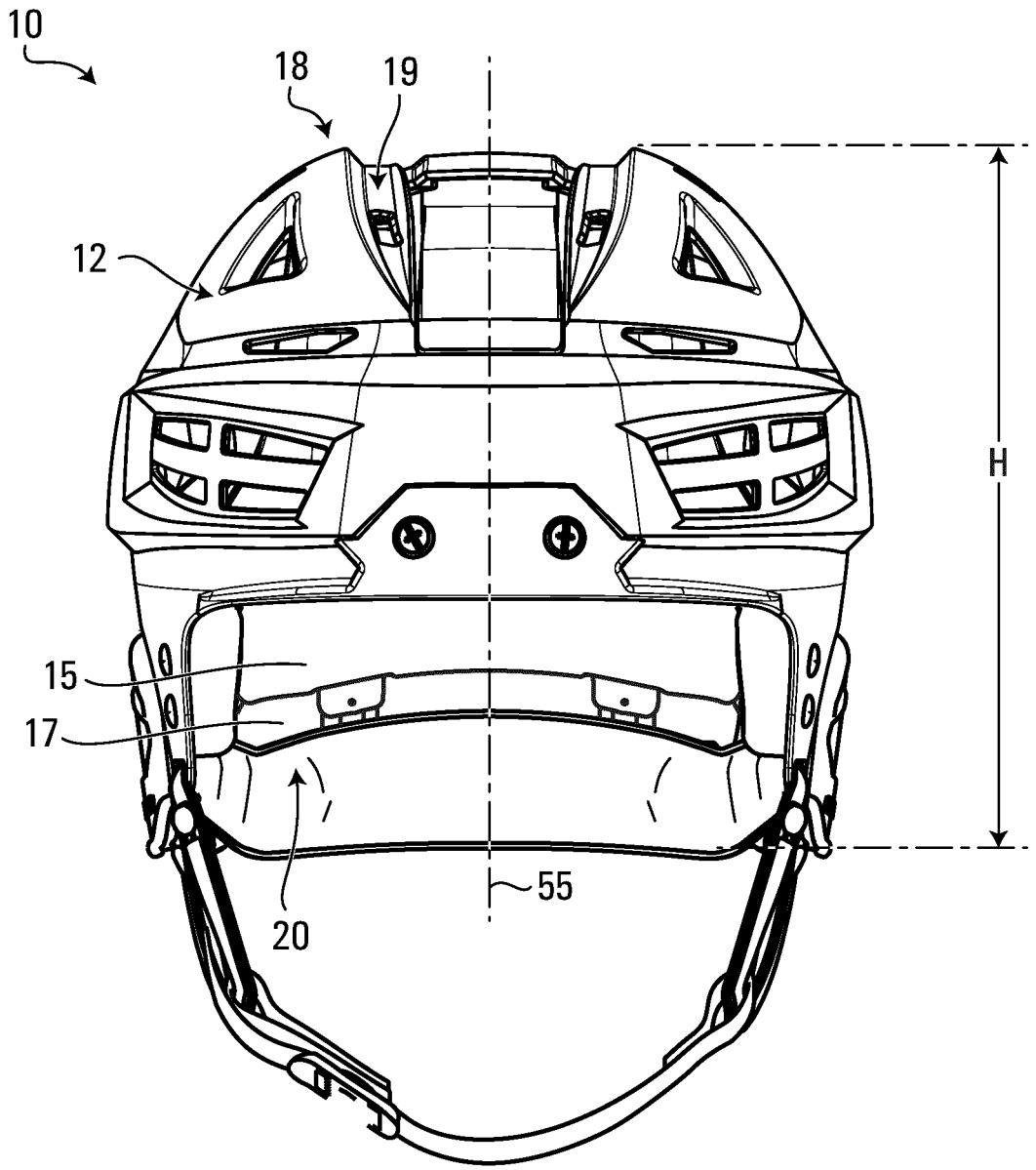
Figure 4:
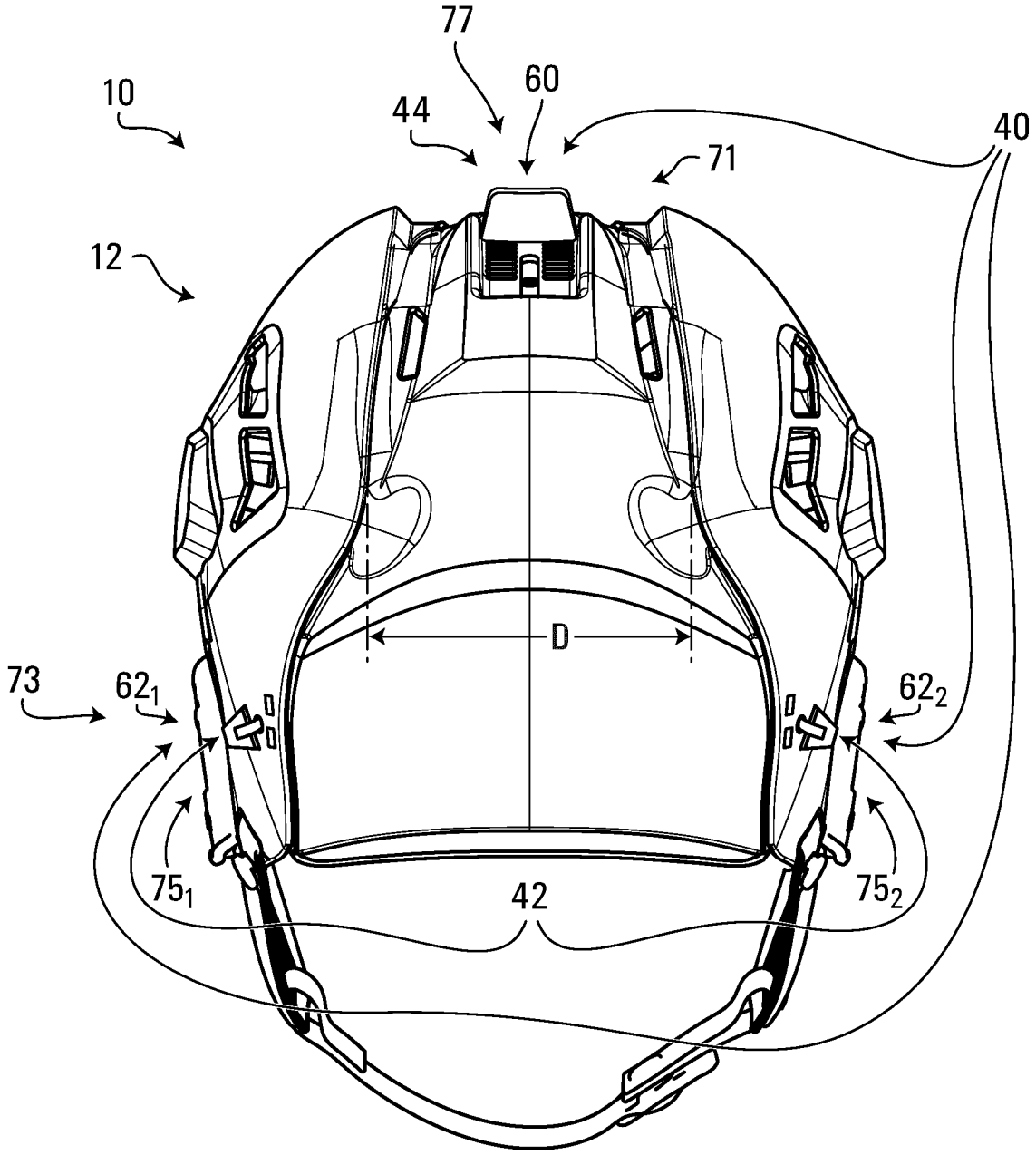
Figure 5:
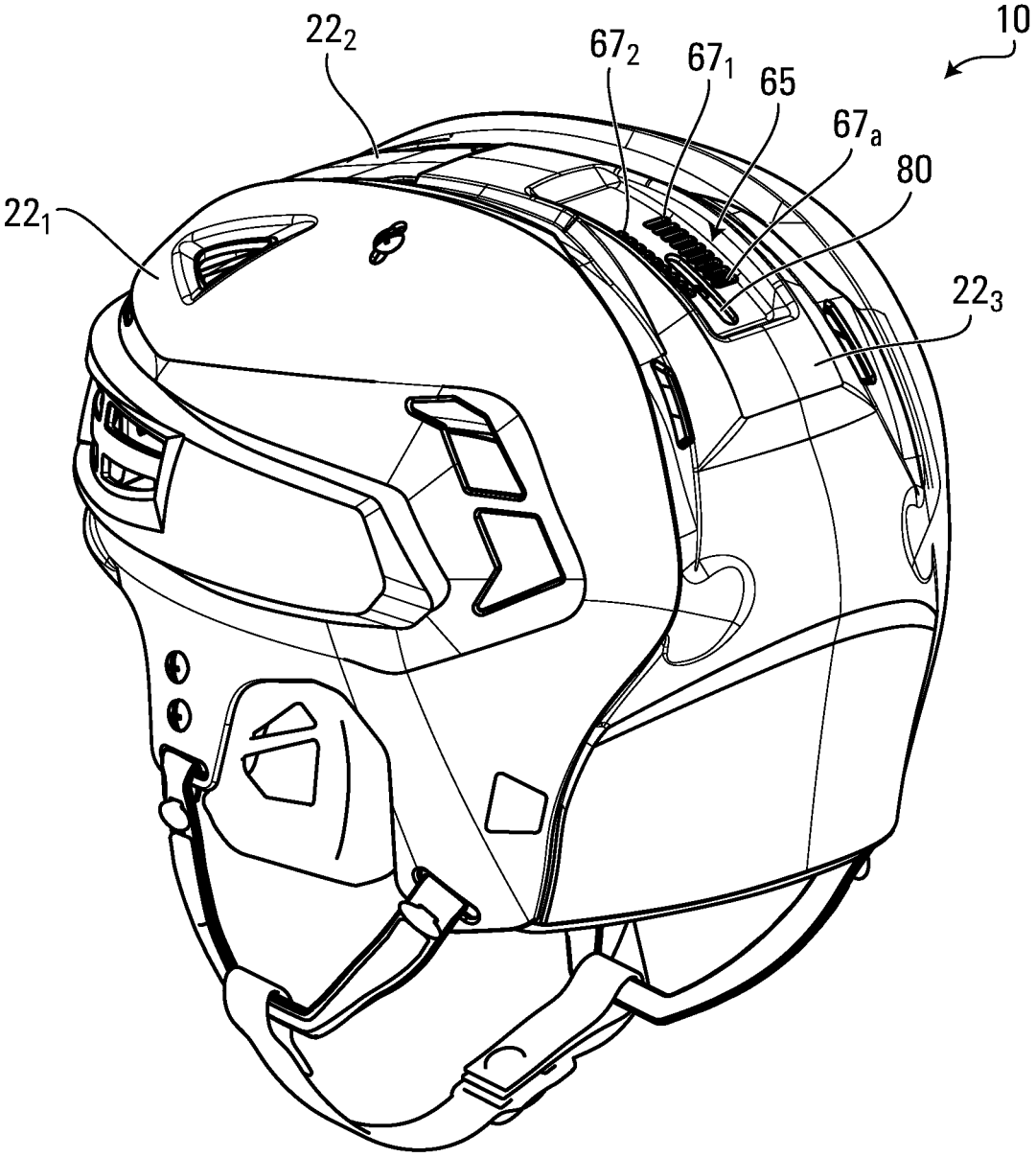
Figure 6:
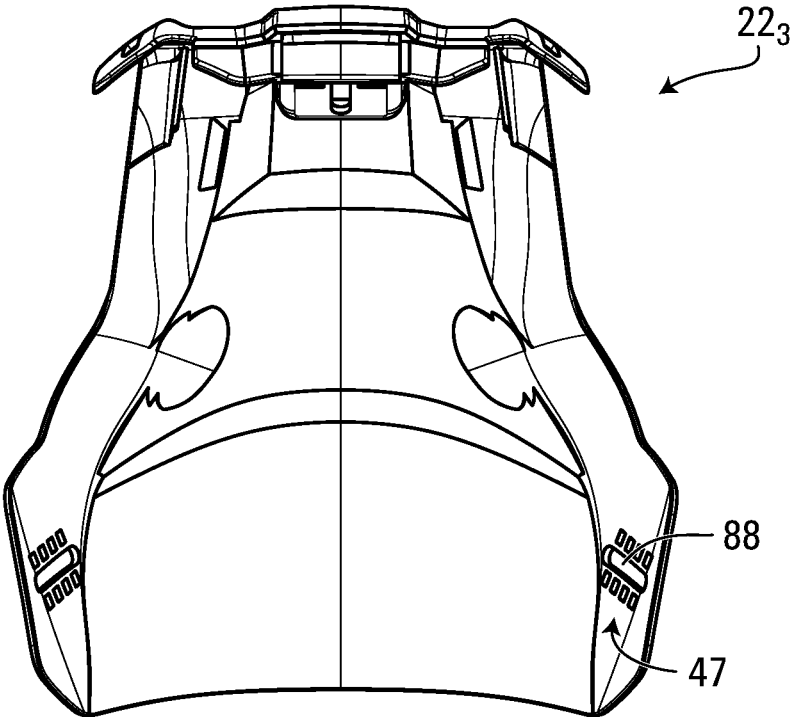
FIGS. 6 to 16 show different views of an example of shell members of an outer shell of the helmet.
Figure 7:
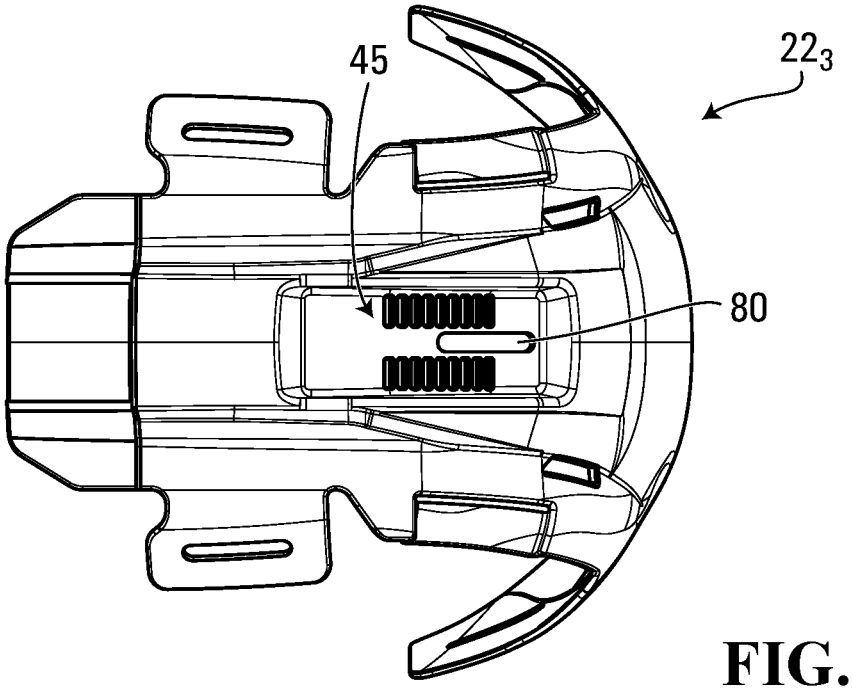
Figure 8:
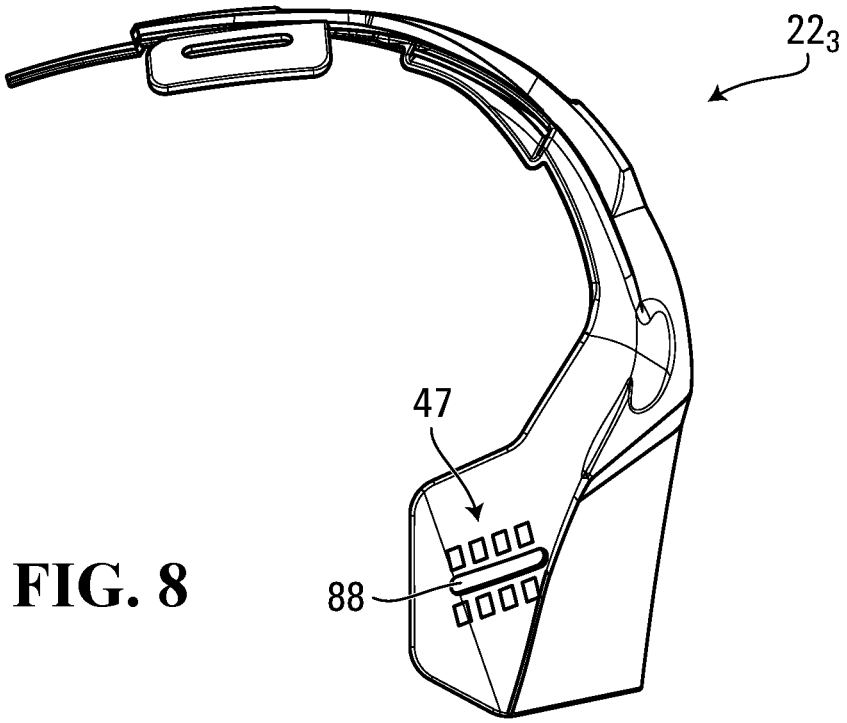
Figure 9:
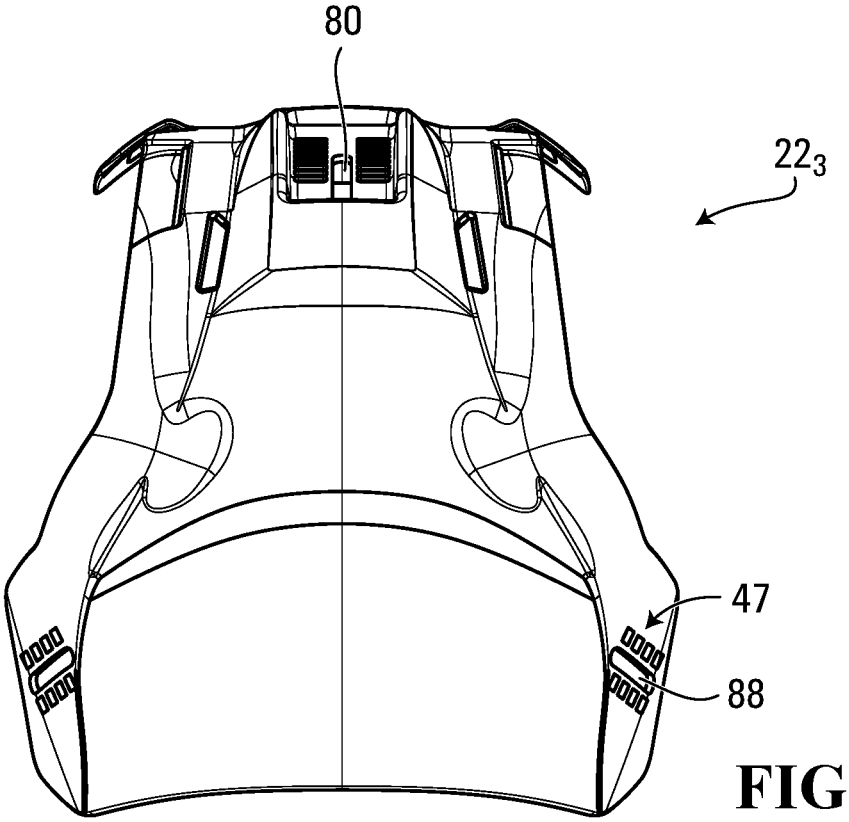
Figure 10:
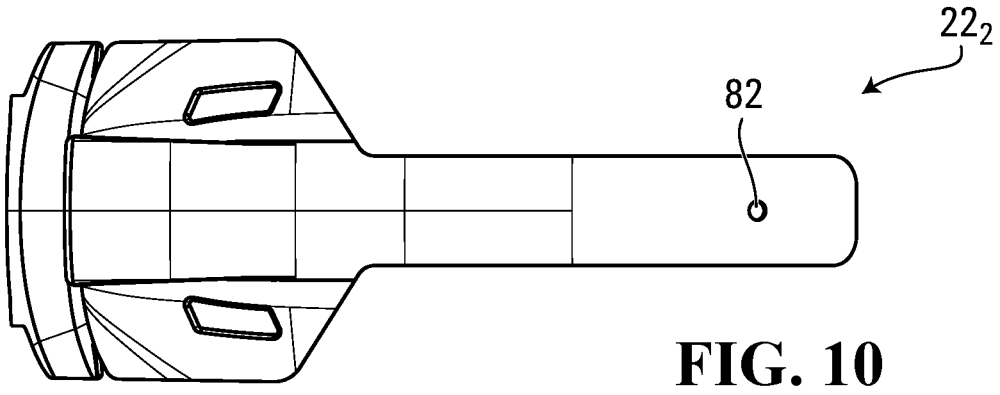
Figure 11:
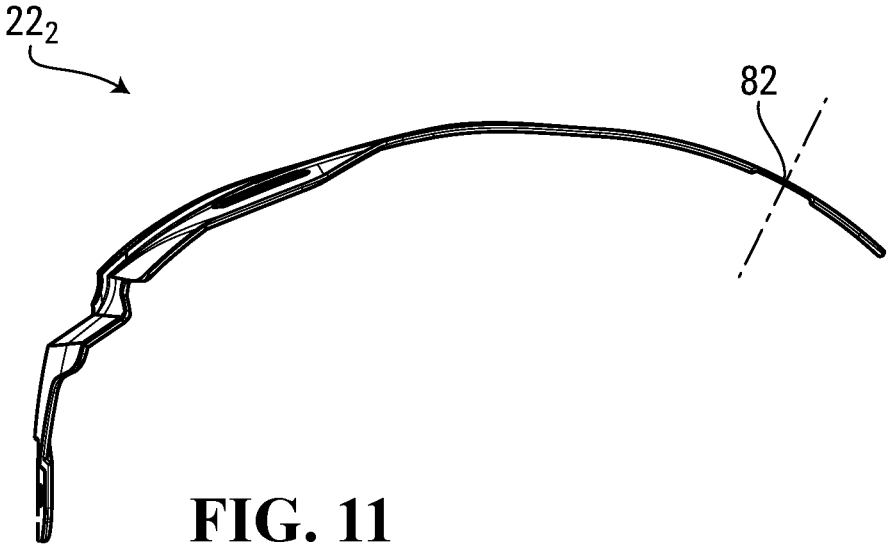
Figure 12:
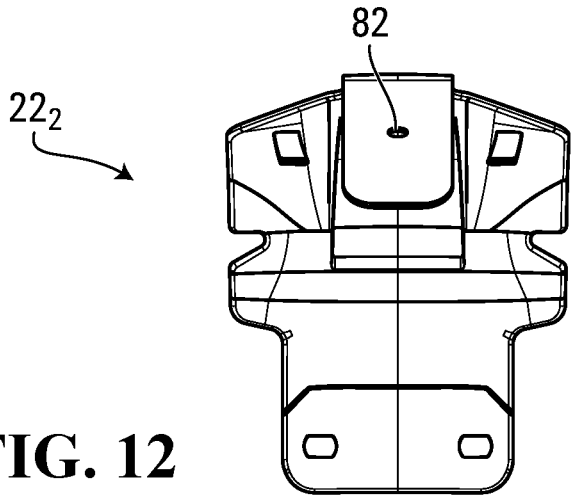
Figure 13:
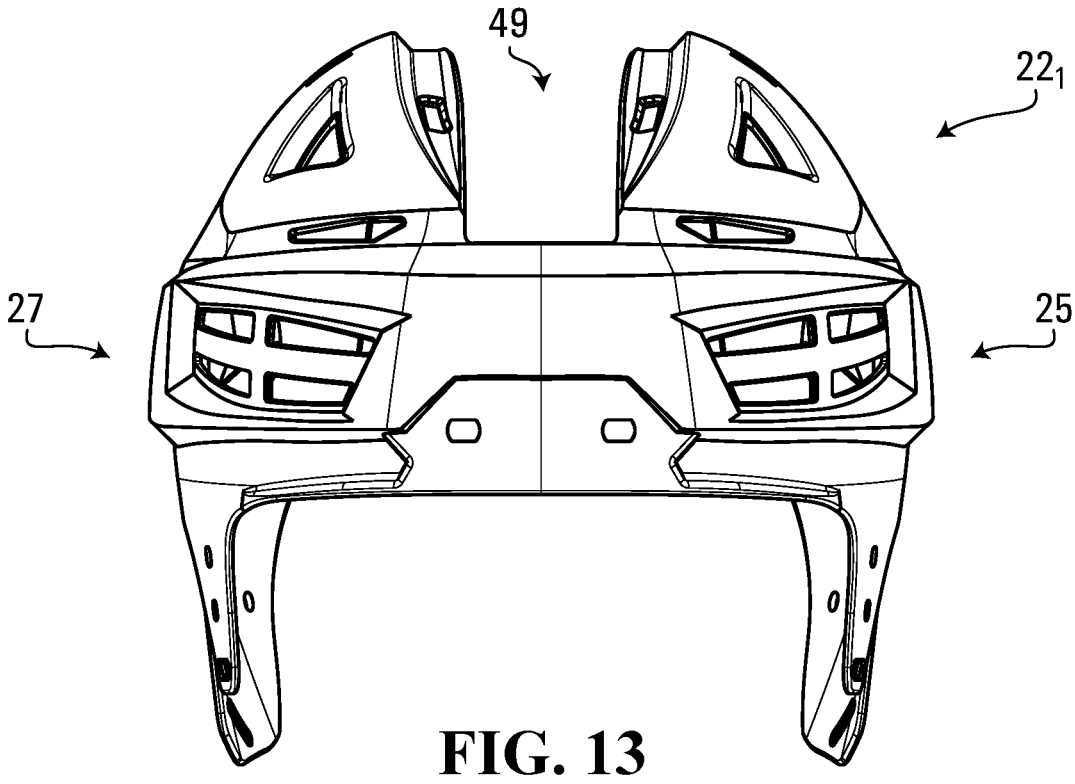
Figure 14:
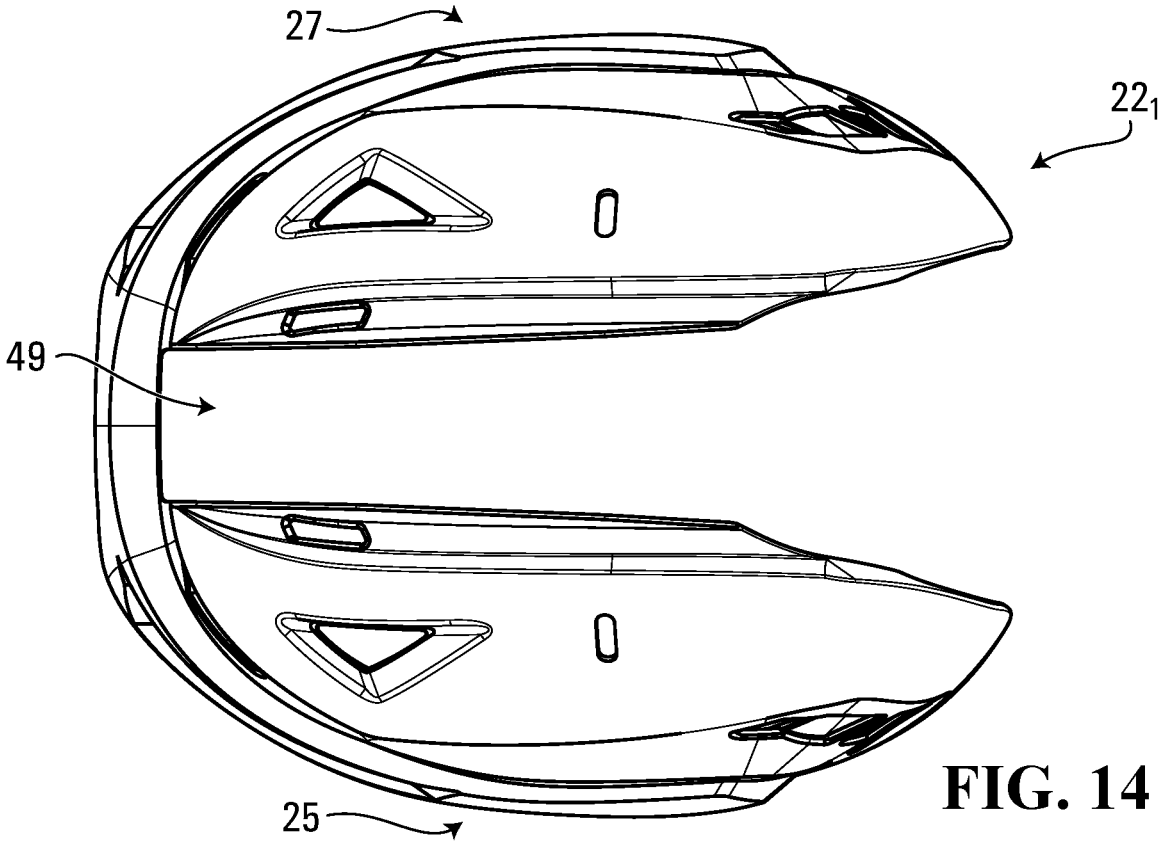
Figure 15:
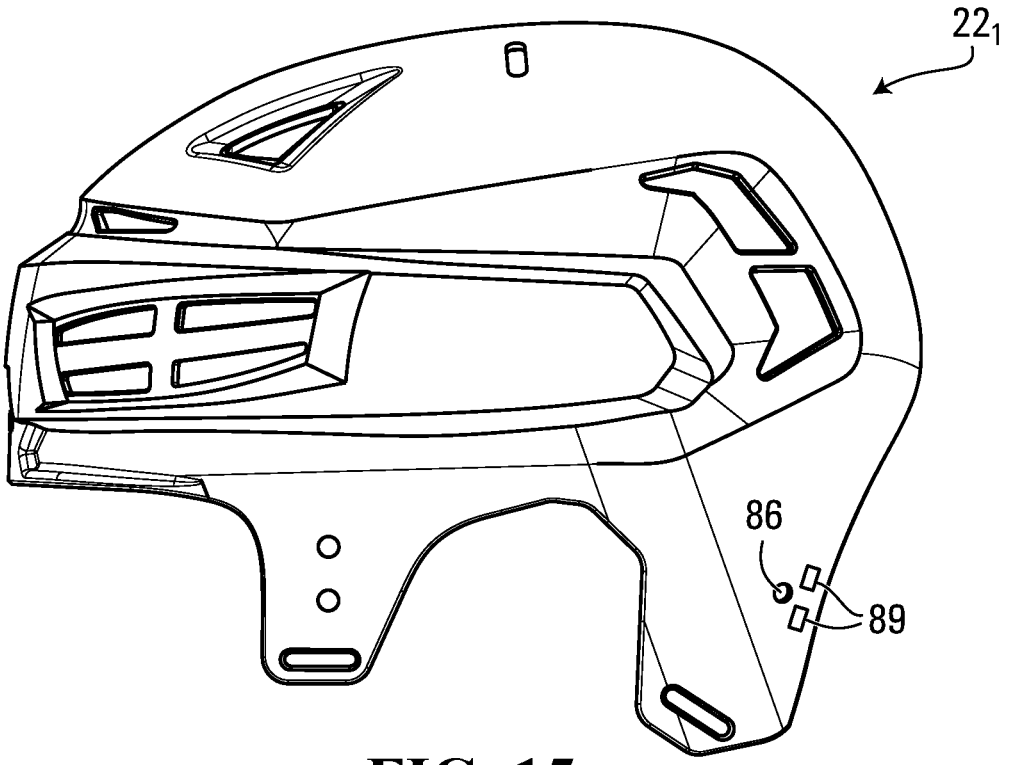
Figure 16:
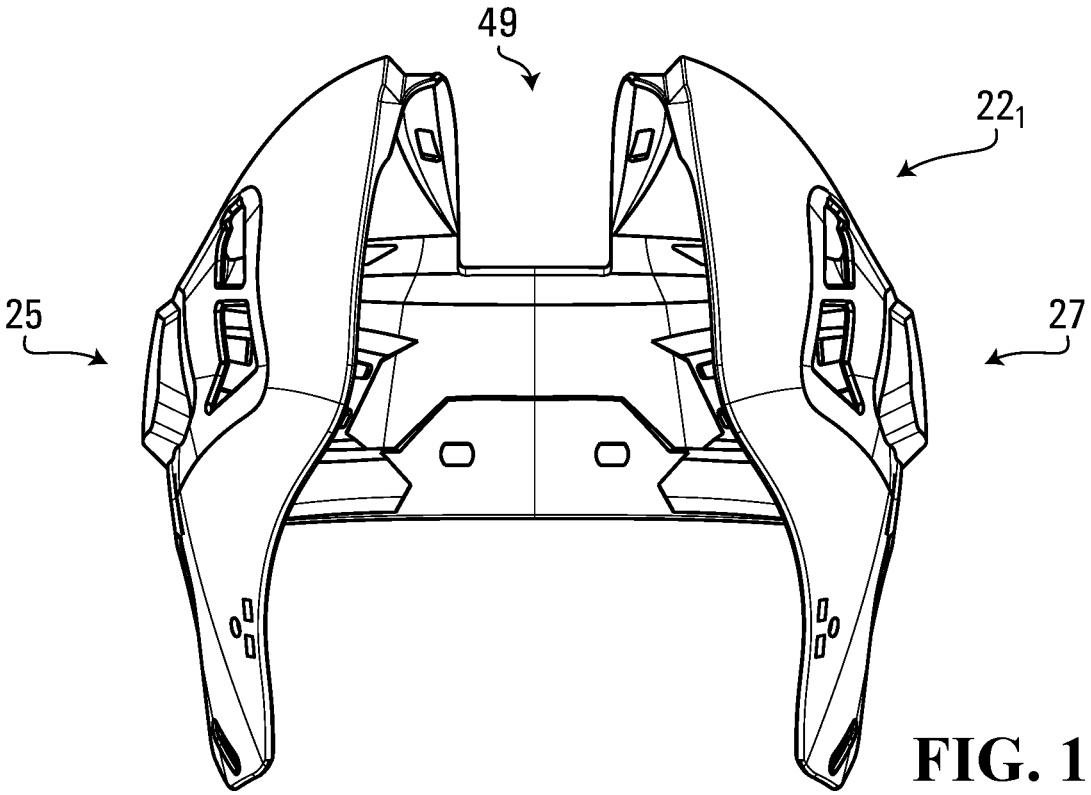
Figure 17:
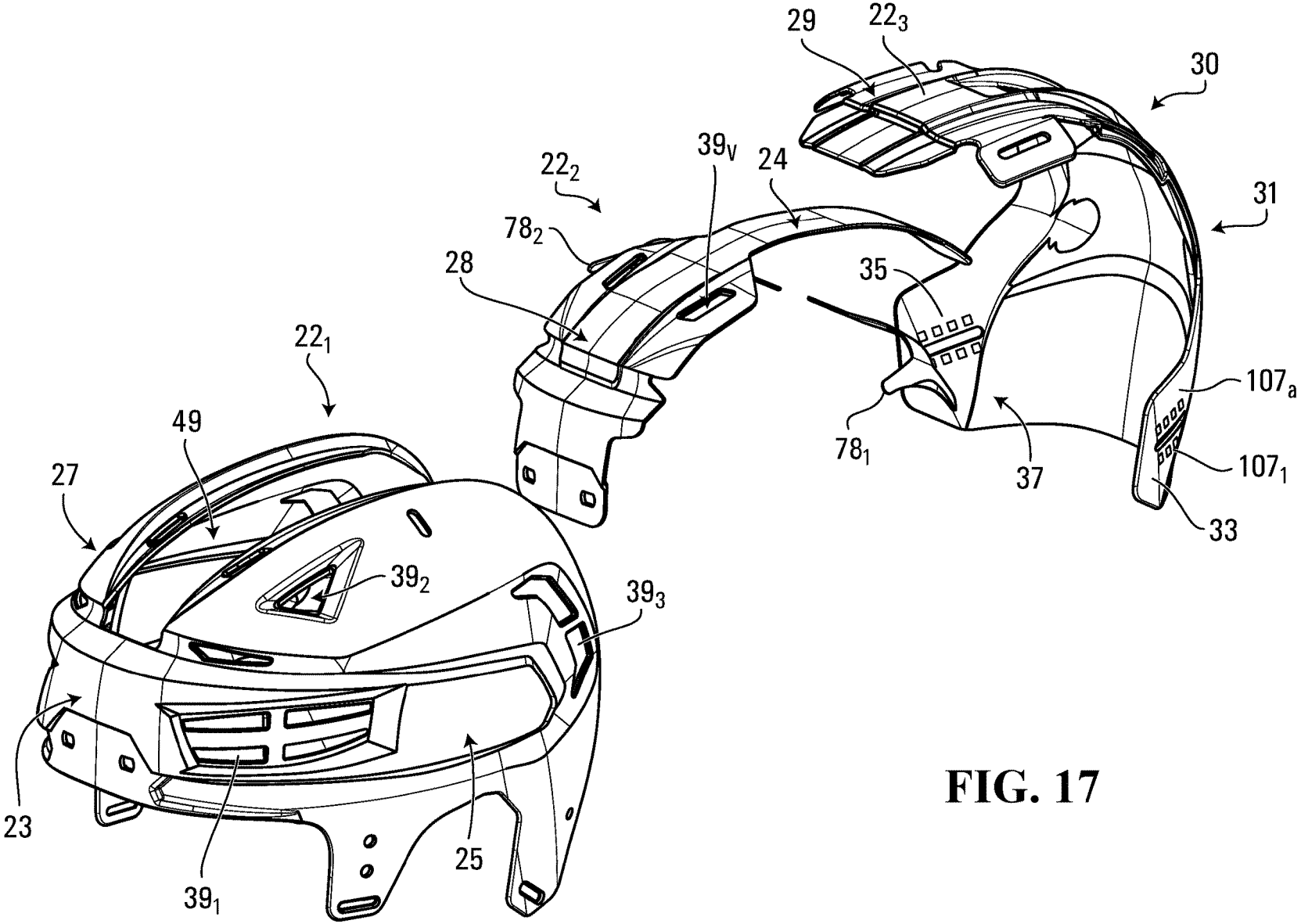
FIGS. 17 and 18 show a front and back perspective exploded view of the shell members of the helmet.
Figure 18:
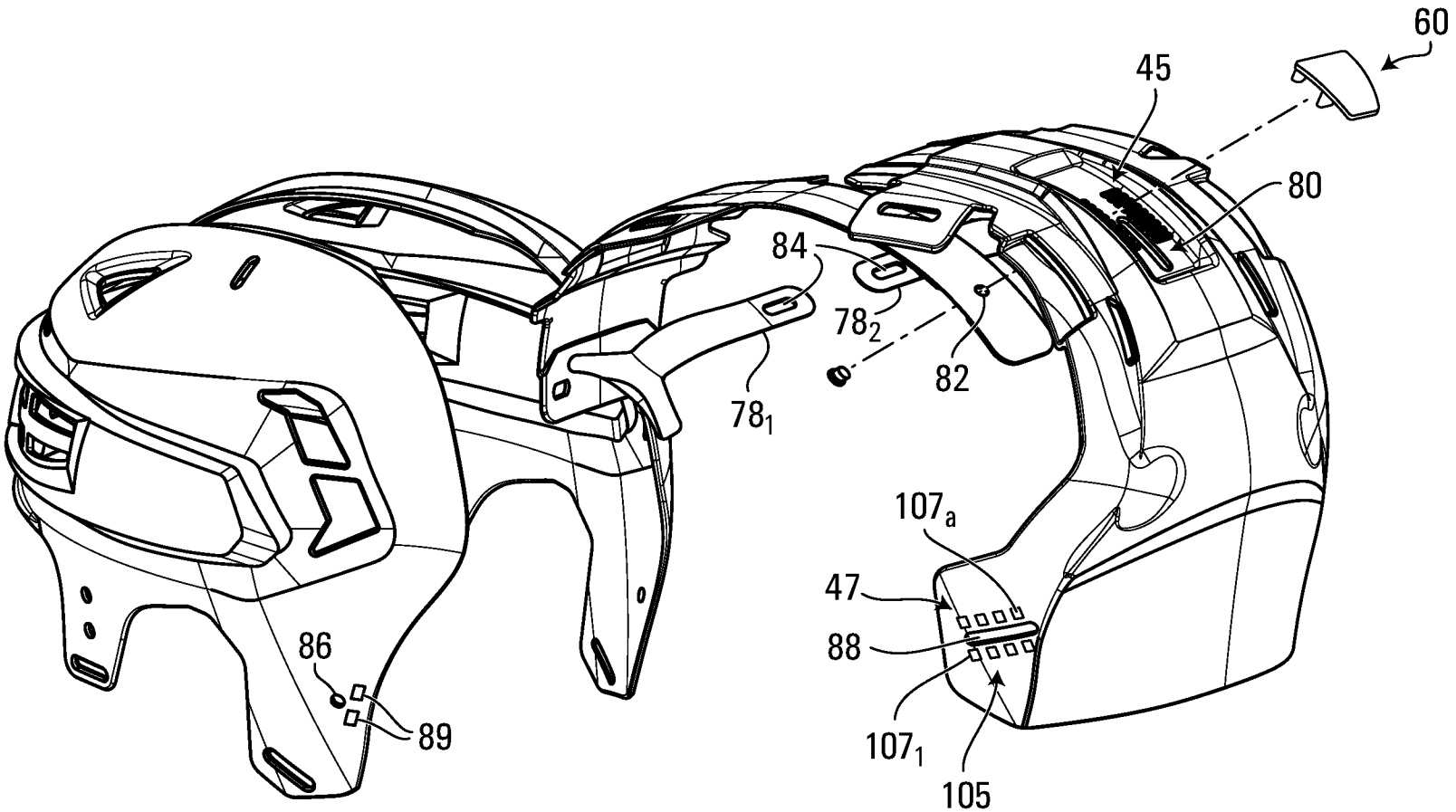

With continued reference to FIGS. 17 and 18, in this embodiment, the lock-engaging part 45 comprises a plurality of connectors $\mathbf{78}_1$, $\mathbf{78}_2$ movable relative to one another and interconnecting the lateral side portions 25, 27 of the front shell member $\mathbf{22}_1$. In this embodiment, the connectors $\mathbf{78}_1$, $\mathbf{78}_2$ are elongated, such that each of the connectors $\mathbf{78}_1$, $\mathbf{78}_2$ constitutes a strap. The connectors $\mathbf{78}_1$, $\mathbf{78}_2$ are configured such that they overlap each other. Each elongated connector $\mathbf{78}_1$, $\mathbf{78}_2$ includes an opening 84 (e.g. a slot) extending longitudinally along part of a length of the elongated connector $\mathbf{78}_1$, $\mathbf{78}_2$, and interacts with the lateral adjustment subsystem 44, as will be discussed later.

In this embodiment, the locking void 65 of the lock-engaging part 45 is part of the rear shell member $\mathbf{22}_3$ for receiving the locking projections $\mathbf{66}_1$, $\mathbf{66}_2$ of the lock 61 when the lock 61 is in the locked position. More particularly, in this embodiment, the locking void 65 of the lock-engaging part 45 includes a plurality of apertures $\mathbf{67}_1$-$\mathbf{67}_a$ disposed longitudinally on both sides of the opening 80 in the rear shell member $\mathbf{22}_3$. In other embodiments, the locking void 65 can be implemented in other ways. For instance, instead of having pairs of apertures disposed longitudinally on both sides of the opening 80 in the rear shell member $\mathbf{22}_3$, the locking void 65 may include a plurality of slots intersecting the opening 80 of the rear shell member $\mathbf{22}_3$ for receiving the locking projections $\mathbf{66}_1$, $\mathbf{66}_2$ of the lock 61 when the lock 61 is in the locked position.

In this example, the elongated connectors $\mathbf{78}_1$, $\mathbf{78}_2$ interact with the lateral adjustment subsystem 44. More particularly, the cam post 74 extends through the opening 84 of each of the elongated connectors $\mathbf{78}_1$, $\mathbf{78}_2$ that are overlapping and the opening 80 of the rear shell member $\mathbf{22}_3$, and thus moves within the openings 80, 84 when the elongated connectors $\mathbf{78}_1$, $\mathbf{78}_2$ move relative to the rear shell member $\mathbf{22}_3$ and/or the top shell member $\mathbf{22}_2$. The elongated connectors $\mathbf{78}_1$, $\mathbf{78}_2$ extend between the cam plate 76, which is attached to an end of the cam post 74, and an inner surface 17 of the outer shell 12 (e.g. the elongated connectors $\mathbf{78}_1$, $\mathbf{78}_2$ are sandwiched between the cam plate 76 and the inner surface 17 of the rear shell member $\mathbf{22}_3$ or the top shell member $\mathbf{22}_2$ of the helmet).

The handle 72 of the lock 61 pivots between the unlocked position, wherein it extends away from the outer surface 19 of the rear shell member $\mathbf{22}_3$, and the locked position, wherein it extends adjacent to the outer surface 19 of the rear shell member $\mathbf{22}_3$. When in the unlocked position, the handle 72 urges the cam post 74 towards the interior of the helmet, hence pushing the cam plate 76 away from the elongated connectors $\mathbf{78}_1$, $\mathbf{78}_2$ and releasing the elongated connectors $\mathbf{78}_1$, $\mathbf{78}_2$ to allow movement of the elongated connectors $\mathbf{78}_1$, $\mathbf{78}_2$ relative to the cam plate 76. Also, in this position, the locking projection $\mathbf{66}_1$, $\mathbf{66}_2$ of the lock 61 is outside of the locking void 65 of the lock-engaging part 45 of the helmet 10. When in the locked position, the handle 72 urges the cam post 74 toward the exterior of the helmet 10 and pulls the cam plate 76 against the elongated connectors $\mathbf{78}_1$, $\mathbf{78}_2$, thereby applying sufficient amount of pressure on the elongated connectors $\mathbf{78}_1$, $\mathbf{78}_2$ against the inner surface 17 of the rear shell member $\mathbf{22}_3$ (or on an intermediary component such as a shim between the elongated connectors 78$_1$, 78$_2$ and the inner surface 17 of the rear shell member 22$_3$, for instance) to prevent the elongated connectors 78$_1$, 78$_2$ from moving (i.e. sliding) relative to the cam plate 76 and the rear shell member 22$_3$. Also, the locking projection 66$_1$, 66$_2$ of the lock 61 is received in the locking void 65 of the lock-engaging part 45. This may allow even more retention force of the lock 61 on the lock-engaging part 45. In this position, the lock 61 is in the locked position and movement between the cam plate 76 (i.e. in this case implemented by the rearmost portion of the top shell member 22$_2$), the elongated connectors 78$_1$, 78$_2$ and the rear shell member 22$_3$ is prevented, and thus the adjustment of the lateral dimension $D_{TS}$ of the outer shell 12 and/or the lateral dimension $D_{TC}$ of the cavity 13 of the helmet 10 is prevented.

Also, in this embodiment, each of the locks 63$_1$, 63$_2$ is movable by the user between its locked position, in which it engages a lock-engaging part 47 associated with a given one of the lateral portions 33, 35 of the rear shell member 22$_3$ to prevent an adjacent one of the lateral portions 25, 27 of the front shell member 22$_1$ and the given one of the lateral portions 33, 35 of rear shell member 22$_3$ from moving relative to one another, and its unlocked position, in which it is disengaged from the lock-engaging part 47 associated with the given one of the lateral portions 33, 35 of the rear shell member 22$_3$ to allow the adjacent one of the lateral portions 25, 27 of the front shell member 22$_1$ and the given one of the lateral portions 33, 35 of the rear shell member 22$_3$ to move relative to one another. When each of the locks 63$_1$, 63$_2$ is in its unlocked position, the user can manually move the front shell member 22$_1$ and the rear shell member 22$_3$ relative to one another by pushing or pulling on at least one of the front shell member 22$_1$ and the rear shell member 22$_3$ and thus the longitudinal dimension $D_{LS}$ of the outer shell 12 and/or the longitudinal dimension $D_{LC}$ of the cavity 13 of the helmet 10 can be adjusted.

In this embodiment, each of the locks 63$_1$, 63$_2$ resides on a given one of the lateral portions 25, 27 of the front shell member 22$_1$ and is associated with a given one of the lateral portions 33, 35 of the rear shell member 22$_3$ as follows. In this example, each of the locks 63$_1$, 63$_2$ is implemented similarly to the lock 61 discussed above. Notably, each of the locks 63$_1$, 63$_2$ comprises a pivotable handle 92 that is manually operable by the user to move each of the locks 63$_1$, 63$_2$ from its locked position to its unlocked position and vice versa. Also, in this embodiment, each of the locks 63$_1$, 63$_2$ comprises a cam 90. The handle 92 is mounted on a cam post 94 extending through an opening 86 in the lateral portions 25, 27 of the front shell member 22$_1$ and through an opening 88 (e.g. slot) in the lateral portions 33, 35 of the rear shell member 22$_3$. The cam post 94 is attached to a backing member 96 located beneath the rear shell member 22$_3$. The backing member 96 can be implemented in any suitable way. For instance, in this embodiment, the backing member 96 is attached (e.g. fastened, bonded) to an end of the cam post 94. In this embodiment, the backing member 96 is located inwardly relative to the given one of the lateral portions 33, 35 of the rear shell member 22$_3$ (i.e. the given one of the lateral portions 33, 35 of the rear shell member 22$_3$ is sandwiched between the backing member 96 and the inner surface 17 of the given one of the lateral portions 25, 27 of the front shell member 22$_1$).

In this embodiment, each of the locks 63$_1$, 63$_2$ also comprises a plurality of locking projections 106$_1$, 106$_2$ configured to be received in a locking void 105 of the lock-engaging part 47 of the helmet 10 when the locks 63$_1$, 63$_2$ are in the locked position, as will be discussed later. The locking projections 106$_1$, 106$_2$ of the locks 63$_1$, 63$_2$ may be viewed as locking teeth disposed side-by-side. In other embodiments, there may be more locking projections or a single locking projection such as the locking projections 106$_1$, 106$_2$.

In this embodiment, the lock-engaging part 47 comprises a locking void 105 on each of the lateral portions 33, 35 of the rear shell member 22$_3$ in overlapping regions of the lateral portions 25, 27 of the front shell member 22$_1$ and the lateral portions 33, 35 of the rear shell member 22$_3$ for receiving the locking projections 106$_1$, 106$_2$ of the locks 63$_1$, 63$_2$ when the locks 63$_1$, 63$_2$ are in the locked position. In this embodiment, the locking void 105 of the lock-engaging part 47 includes a plurality of apertures 107$_1$-107$_a$ disposed longitudinally on both sides of the opening 88 in the lateral portions 33, 35 of the rear shell member 22$_3$. In other embodiments, the locking void 105 can be implemented in other ways. For instance, instead of having pairs of apertures disposed longitudinally on both sides of the opening 88 in lateral portions 33, 35 of the rear shell member 22$_3$, the locking void 105 may include a plurality of slots intersecting the opening 88 of the lateral portions 33, 35 of the rear shell member 22$_3$ for receiving the locking projections 106$_1$, 106$_2$ of the locks 63$_1$, 63$_2$ when the locks 63$_1$, 63$_2$ are in the locked position.

The handle 92 of each of the locks 63$_1$, 63$_2$ pivots between the unlocked position, wherein it extends away from an outer surface 19 of the front shell member 22$_1$ of the outer shell 12, and the locked position, wherein it extends adjacent to the outer surface 19 of the front shell member 22$_1$ of the outer shell 12. When in the locked position, the handle 92 of each of the locks 63$_1$, 63$_2$ urges the cam post 94 toward the exterior of the helmet 10 and pulls the backing member 96 against a given one of the lateral portions 33, 35 of the rear shell member 22$_3$, thereby building pressure between the overlapping regions of the lateral portions 25, 27 of the front shell member 22$_1$ and the lateral portions 33, 35 of the rear shell member 22$_3$. Also, in this position, the locking projections 106$_1$, 106$_2$ of each of the locks 63$_1$, 63$_2$ extend in an opening 89 in a given one of the lateral portions 25, 27 of the front shell member 22$_1$ and received in the locking void 105 of the lock-engaging part 47. As such, the locks 63$_1$, 63$_2$ are in the locked position and prevent the given ones of the lateral portions 25, 27 of the front shell member 22$_1$ and the given ones of the lateral portions 33, 35 of the rear shell member 22$_3$ from moving relative to one another, and thus the adjustment of the longitudinal dimension $D_{LS}$ of the outer shell 12 and/or the longitudinal dimension $D_{LC}$ of the cavity 13 of the helmet 10 is prevented.

When the handle 92 of each of the locks 63$_1$, 63$_2$ is in the unlocked position, the locking projections 106$_1$, 106$_2$ of each of the locks 63$_1$, 63$_2$ are outside of the locking void 105 of the lock-engaging part 47. Also, the pressure between the overlapping regions of the lateral portions 25, 27 of the front shell member 22$_1$ and the lateral portions 33, 35 of the rear shell member 22$_3$ is released, hence relative movement between the lateral portions 25, 27 of the front shell member 22$_1$ and the lateral portions 33, 35 of the rear shell member 22$_3$ is allowed and thus the longitudinal dimension $D_{LS}$ of the outer shell 12 and/or the longitudinal dimension $D_{LC}$ of the cavity 13 of the helmet 10 can be adjusted.

In some variants, the locks 61, 63$_1$, 63$_2$ and the lock-engaging parts 45, 47 may be implemented in other ways. For instance, as shown in FIGS. 42 to 45, the locking projections 66$_1$, 66$_2$, 106$_1$, 106$_2$ of the locks 61, 63$_1$, 63$_2$ may be omitted, such that only pressure applied by the locks

61', $63_1$', $63_2$' may suffice to prevent adjacent ones of the shell members $22_1$-$22_3$ from moving relative to one another when the locks 61', $63_1$', $63_2$' are in the locked position. Also, in some variants, the locks 61, $63_1$, $63_2$ may comprise more than one cam post. In such case, some modifications to the shell members would be envisioned to accommodate the additional cam post(s), but the locks 61, $63_1$, $63_2$ would function essentially the same way as discussed above.

FIGS. 46 to 49 show another example of implementation of the longitudinal adjustment subsystem 42 and features thereof. In this example of implementation, the actuators $162_1$, $162_2$ the longitudinal adjustment subsystem 42, which in this example is denoted 42', comprises locks $63_1$', $63_2$', which in this example are denoted $163_1$, $163_2$, that function essentially the same way as discussed above. In this example, each of the locks $163_1$, $163_2$ comprises a pivotable handle 192 and a cam 190. The handle 192 of each of the locks $163_1$, $163_2$ is mounted on a cam post 194 extending through the opening 86 in the lateral portions 25, 27 of the front shell member $22_1$ and through the opening 88 (e.g. slot) in the lateral portions 33, 35 of the rear shell member $22_3$. The cam post 194 is attached to a backing member 196 located beneath the rear shell member $22_3$. In this example, each of the backing member 196 comprises a series of locking projections $198_{1-p}$ that are configured to engage in its locked position a lock-engaging part 147 of the helmet 10 when the locks $163_1$, $163_2$ are in the locked position.

In this example, the lock-engaging part 147 comprises a locking void 200, in this case a series of recesses, on each of the lateral portions 33, 35 of the rear shell member $22_3$ in overlapping regions of the lateral portions 25, 27 of the front shell member $22_1$ and the lateral portions 33, 35 of the rear shell member $22_3$ for receiving the locking projections $198_1$-$198_b$ of the backing member 196 when the locks $163_1$, $163_2$ are in the locked position.

When in the locked position, the handle 192 of each of the locks $163_1$, $163_2$ urges the cam post 194 towards the exterior of the helmet 10 and pulls the backing member 196 against a given one of the lateral portions 33, 35 of the rear shell member $22_3$, thereby building pressure between the overlapping regions of the given one of the lateral portions 33, 35 of the rear shell member $22_3$ and the adjacent one of the lateral portions 25, 27 of the front shell member $22_1$ and engaging the projections $198_1$-$198_b$ of the backing member 196 with the locking void 200 on the given one of the lateral portions 33, 35 of the rear shell member $22_3$. As such, the locks $163_1$, $163_2$ are in the locked position and prevent the given one of the lateral portions 33, 35 of the rear shell member $22_3$ and the adjacent one of the lateral portions 25, 27 of the front shell member $22_1$ from moving relative to one another, and thus the adjustment of the longitudinal dimension $D_{LS}$ of the outer shell 12 and/or the longitudinal dimension $D_{LC}$ of the cavity 13 of the helmet 10 is prevented.

FIGS. 50 to 54 show yet another example of implementation of the longitudinal adjustment subsystem 42 and features thereof. In this example of implementation, the actuators $262_1$, $262_2$ of the longitudinal adjustment subsystem 42, which in this example is denoted 42", functions similarly to the actuators $162_1$, $162_2$ of the longitudinal adjustment subsystem 42' discussed above, but for the differences discussed below.

In this example, each of the locks $263_1$, $263_2$ comprises a pivotable handle 292 and a cam 290. The handle 292 of each of the locks $263_1$, $263_2$ is mounted on the cam post 294 extending through the opening 86 in the lateral portions 25, 27 of the front shell member $22_1$ and through the opening 88 (e.g. slot) in the lateral portions 33, 35 of the rear shell member $22_3$. The cam post 294 is attached to a backing member 296 located beneath the rear shell member $22_3$. Contrary to the example of implementation discussed above, the backing member 296 is free (i.e. without) of locking projections. Each backing member 296 is configured to frictionally engage the lateral portions 33, 35 of the rear shell member $22_3$ when the locks $263_1$, $263_2$ are in the locked position, as discussed later.

In this example, the helmet 10 still comprises a lock-engaging part 47. More particularly, in this example, the lock-engaging part 47, which in this example is denoted 247, is located in overlapping regions of the lateral portions 25, 27 of the front shell member $22_1$ and the lateral portions 33, 35 of the rear shell member $22_3$. The lock-engaging part 47 comprises a series of projections $249_1$-$249_p$ and recesses $251_1$-$251_r$ formed on a given one of the lateral portions 25, 27 of the front shell member $22_1$ and on an adjacent one of the lateral portions 33, 35 of the rear shell member $22_3$. The series of locking projections $249_1$-$249_p$ and recesses $251_1$-$251_r$ of the given one of the lateral portions 25, 27 of the front shell member $22_1$ and the adjacent one of the lateral portions 33, 35 of the rear shell member $22_3$ are configured to register with each other when the locks $263_1$, $263_2$ are in the locked position.

When in the locked position, the pivotable handle 292 of each of the locks $263_1$, $263_2$ urges the cam post 294 towards the exterior of the helmet 10 and pulls the backing member 296 against, and thus frictionally engages, the given one of the lateral portions 33, 35 of the rear shell member $22_3$, thereby building pressure between the overlapping regions of the lateral portions 25, 27 of the front shell member $22_1$ and the lateral portions 33, 35 of the rear shell member $22_3$. Additionally, in the locked position, the series of locking projections $249_1$-$249_p$ and recesses $251_1$-$251_r$ of the given one of the lateral portions 25, 27 of the front shell member $22_1$ and the adjacent one of the lateral portions 33, 35 of the rear shell member $22_3$ register with one another. This may create even more retention force between the given one of the lateral portions 33, 35 of the rear shell member $22_3$ and the adjacent one of the lateral portions 25, 27 of the front shell member $22_1$ and better prevent relative movement between each other. That is, the locks $263_1$, $263_2$ are in the locked position and prevent the given one of the lateral portions 33, 35 of the rear shell member $22_3$ and the adjacent one of the lateral portions 25, 27 of the front shell member $22_1$ from moving relative to one another, and thus the adjustment of the longitudinal dimension $D_{LS}$ of the outer shell 12 and/or the longitudinal dimension $D_{LC}$ of the cavity 13 of the helmet 10 is prevented.

In some examples of implementation, the lateral adjustment subsystem 44 may be implemented similarly to the longitudinal adjustment subsystem 42' or 42" discussed above to allow and prevent the shell members $22_1$-$22_3$ from moving one relative to the other, thereby allowing or preventing the adjustment of the lateral dimension $D_{TS}$ of the outer shell 12 and/or the lateral dimension $D_{TC}$ of the cavity 13 of the helmet 10.

In this embodiment, the helmet 10 comprises an occipital pad mechanism 300 comprising an occipital pad 310 that is configured to engage the occipital region OR of the user's head 11. The occipital pad 340 is configured to be biased away from the inner surface 17 of the outer shell 12 and towards the occipital region OR of the user's head 11 and manually adjustable relative to the outer shell 12 to adjust how it engages the occipital region OR of the user's head 11.

In this example of implementation, as shown in FIGS. 55 to 62, the occipital pad mechanism 300 comprises a pad support 320 supporting the occipital pad 310 and mounted to the outer shell 12 to bias the occipital pad 310 away from the inner surface 17 of the rear shell member $\mathbf{22}_3$ of the outer shell 12 and towards the occipital region of the user's head 11 and to allow manual adjustment of a position of the occipital pad 310 relative to the outer shell 12. In this case, biasing of the occipital pad 310 away from the inner surface 17 of the outer shell 12 and towards the occipital region of the user's head 11 and manual adjustability of the position of the occipital pad 310 relative to the outer shell 12 are independent from one another.

More particularly, in this embodiment, the occipital pad 310 comprises a shock-absorbing material 150. The shock-absorbing material 150 may include any suitable materials, such as expanded polypropylene (EPP) or expanded polyethylene (EPE) or polypropylene foam or polyethylene foam having two different densities. The shock-absorbing material 150 may include any suitable materials stated above (or a combination of those materials) with respect to the shock-absorbing material 50.

The occipital pad 310 may include one or more shock-absorbing material 150 (e.g. different layers of materials). The shock-absorbing material 150 of the occipital pad 310 may include expanded polypropylene (EPP) or expanded polyethylene (EPE) or polypropylene foam or polyethylene foam having two different densities, or any other suitable materials as discussed above with respect to the inner padding 15. For instance, in this embodiment, the occipital pad 310 comprises a first material M1 and a second material M2 denser than the first material M1. In this embodiment, the first material M1 and the second material M2 are different foams with different density and/or stiffness. This may provide greater comfort for the user and/or better fit of the occipital pad 310 on the occipital region OR of the user's head 11.

The pad support 320 defines an inner portion 322 to which the occipital pad 310 is mounted. For example, in this embodiment, the inner portion 321 comprises a transversal base wall 323, a central wall 324 projecting upwardly from the base wall 323 and left and right walls 325, 326 projecting upwardly from the base wall 323 and disposed on both sides of the central wall 324. A rear surface 312 of the occipital pad 310 comprises depressions corresponding to the base, central, left and right walls 323, 324, 325, 326 for registering with the inner portion 322 of the pad support 320. The occipital pad 310 may be secured to the inner portion 322 of the pad support 320 by fastening and/or stitching and/or bonding and/or overmolding the occipital pad 310 onto the inner portion 322. Alternatively, the inner portion 322 of the pad support 320 may simply define a single wall for receiving the occipital pad 310 that can be secured to the support pad 320 the same way as discussed above. In another example, the inner portion 322 may be attached to the occipital pad 310 by virtue of being integral, and therefore continuous, with the occipital pad 310.

The pad support 320 also comprises a biasing member 330 between the rear shell member $\mathbf{22}_3$ and the occipital pad 310, the biasing member 330 having a portion that abuts the inner surface 17 of the rear shell member $\mathbf{22}_3$ of the outer shell 12 such that the pad support 320 and the occipital pad 310 are movable between a first position wherein the pad support 320 is biased away from the inner surface 17 of the rear shell member $\mathbf{22}_3$ of the outer shell 12 and towards the occipital region OR of the user's head 11, and a second position when the user puts on the helmet 10 wherein the pad support 320 and the occipital pad 310 are deflected towards the inner surface 17 of the rear shell member $\mathbf{22}_3$ of the outer shell 12 while the pad support 320 and the occipital pad 310 maintain pressure on the occipital region OR of the user's head. The biasing member 330 may be made of a resilient material (e.g. resilient plastic or metallic strips). The resilient/spring-like effect of the biasing member 330 may help for better accommodating different user's head shape and/or providing a better fit of the helmet 10 on the user's head 11.

In this embodiment, the biasing member 330 comprises left and right end biasing components 332, 333 and left and right middle biasing components 334, 335, each of the biasing components 332, 333, 334, 335 extending rearwardly towards the inner surface 17 of the rear shell member $\mathbf{22}_3$ of the outer shell 12 along an acute angle Θ with respect to the inner portion 322 of the pad support 320, and having a distal end portion abutting the inner surface 17 such that the pad support 320 and the occipital pad 310 are movable between the first position and the second position while the occipital pad 310 is biased away from the inner surface 17 of the rear shell member $\mathbf{22}_3$ of the outer shell 12 and towards the occipital region OR of the user's head 11 (as discussed above). In other embodiments, the biasing member may comprise more or less biasing components. Yet in other embodiments, the biasing member may be configured differently or rely on additional components to provide resilient/spring-like effect of the occipital pad 310 towards the occipital region OR of the user's head 11.

As discussed above, the occipital pad 310 is manually adjustable relative to the outer shell 12. More particularly, the occipital pad 310 is adjustable relative to the outer shell 12 in a heightwise direction of the helmet 10. To that end, the pad support 320 is interconnected with a supporting frame 340 via connectors $\mathbf{350}_1$, $\mathbf{350}_2$. The supporting frame 340 is attached (e.g. welded, fastened, bonded) to the outer shell 12. In this embodiment, each connector $\mathbf{350}_1$, $\mathbf{350}_2$ includes a female connecting member 352 (e.g. a slot) of the pad support 320 that receives a male connecting member 354 (e.g. a post or protrusion) of the supporting frame 340 to allow the occipital pad 310 to be moved vertically relative to the supporting frame 340 for adjusting its position. Each connector $\mathbf{350}_1$, $\mathbf{350}_2$ also includes a lock 357, which in this case comprises recesses 358 of the pad support 320 and projections 359 of the supporting frame 340 that engage one another for locking the occipital pad 310 in relation to the supporting frame 340.

The occipital pad mechanism 300 can be implemented in other suitable ways. For instance, the occipital pad mechanism may comprise more than one occipital pad (e.g. multi-pieces occipital pad), or more than one pad support and supporting frame. In some cases, the occipital pad mechanism can be omitted from the helmet 10, such that the occipital pad 310 may not move relative to the rear shell member $\mathbf{22}_3$.

FIGS. 71 to 82 show yet another example of implementation of the outer shell 12, which in this example is denoted 12', and the longitudinal adjustment subsystem 42 and the lateral adjustment subsystem 44 of the helmet 10. In this example, the longitudinal adjustment subsystem 42 and the lateral adjustment subsystem 44 operate similarly to that of other embodiments discussed above, but for some differences discussed below. The configuration of the lateral adjustment subsystem 44, which in this example is denoted 44''', and the shell members $\mathbf{22}_1$, $\mathbf{22}_2$, $\mathbf{22}_3$, which in this example are denoted $\mathbf{22}_1'$, $\mathbf{22}_2'$, $\mathbf{22}_3'$, allow for a better interconnection between the shell members $\mathbf{22}_1$, $\mathbf{22}_2$, $\mathbf{22}_3$ and help in guiding the movement of the shell members $22_1$, $22_2$, $22_3$ during the adjustment of their relative position.

In this example, components of the lateral adjustment subsystem 44 are configured to guide the movement of portions of shell members, in this case the top shell member $22_2$ and the front shell member $22_1$, while their relative position is adjusted. More particularly, in this example, the top shell member $22_2$ comprises lateral extensions $422_1$, $422_2$ that extend transversally to the longitudinal axis 51 of the helmet 10. These lateral extensions $422_1$, $422_2$ are configured to interact with the lateral side portions 25, 27 of the front shell member $22_1$ and components of the lateral adjustment subsystem 44 as discussed below. This improves the overall structural integrity of the outer shell 12 while at the same time allowing relative movement between respective shell members $22_1$, $22_2$, and $22_3$ during the adjustment of the helmet 10.

More particularly, the lock-engaging part 45, which in this example is denoted 45', of the lateral adjustment subsystem 44 comprises a plurality of connectors $78_1$, $78_2$, which are denoted $78_1$', $78_2$', movable relative to one another and interconnecting the lateral side portions 25, 27 of the front shell member $22_1$. Each one of the connectors $78_1$, $78_2$ implements a guide portion 480 configured to overlap a given one of the lateral extension $422_1$, $422_2$ of the top shell member $22_2$ so as to guide the movement of the given one of the lateral extension $422_1$, $422_2$ and maintain them close to the lateral side portions 25, 27 of the front shell member $22_1$ while the relative position of the shell members is adjusted. That is, each one of the lateral extension $422_1$, $422_2$ of the top shell member $22_2$ engages the guide portion 480 of one of the connectors $78_1$, $78_2$ and moves relative to that connector $78_1$, $78_2$ while the front shell member $22_1$ and the top shell member $22_2$ are moved relative to one another. The interaction between the guide portion 480 of each one of the connectors $78_1$, $78_2$ and a given one of the lateral extensions $422_1$, $422_2$ of the top shell member $22_2$ may help to better connect the top shell member $22_2$ to the front shell member $22_1$, notably to ensure that the top shell member $22_2$ and the front shell member $22_1$ remain structurally rigid, i.e. attached together such as to provide structural integrity to the rigid outer shell 12 (i.e. such that the shell members do not distance from each other or substantially move relative to each other when they are locked in place and intended to remain still relative from each other) while at the same time allowing relative movement of the front shell member $22_1$ and the top shell member $22_2$ during the adjustment of the helmet 10.

In this example, the connectors $78_1$, $78_2$ are elongated and each constitutes a strap and are configured such that they overlap each other. Each connector $78_1$, $78_2$ is connected at one or more locations to a respective one of the lateral side portions 25, 27 of the front shell member $22_1$. In this example, the connectors $78_1$, $78_2$ are connected to the lateral side portions 25, 27 of the front shell member $22_1$ by high-frequency (i.e. ultrasonic) welding. This may allow reducing the number of separate components and fasteners on the helmet 10, thereby contributing to the reduction of the overall weight of the helmet 10. In other cases, the connectors $78_1$, $78_2$ may also be connected to the front shell member $22_1$ in any other suitable ways, including with fasteners and/or adhesives.

Figure 75:
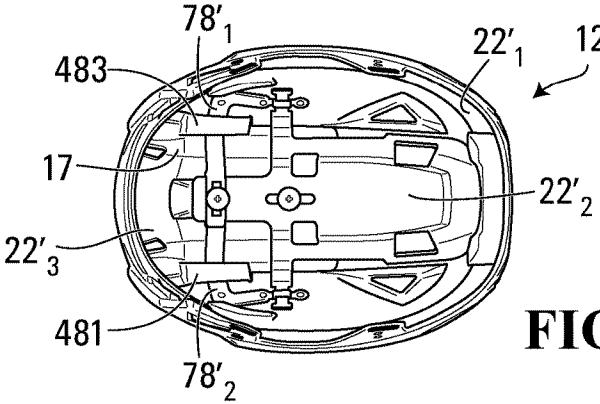
Figure 76:
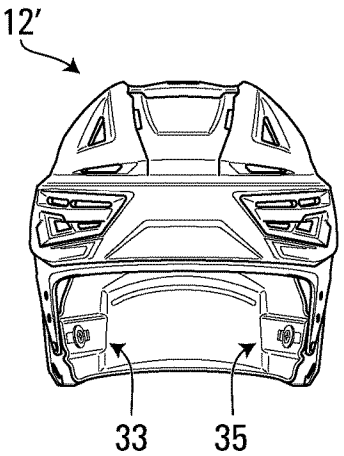
Figure 72:
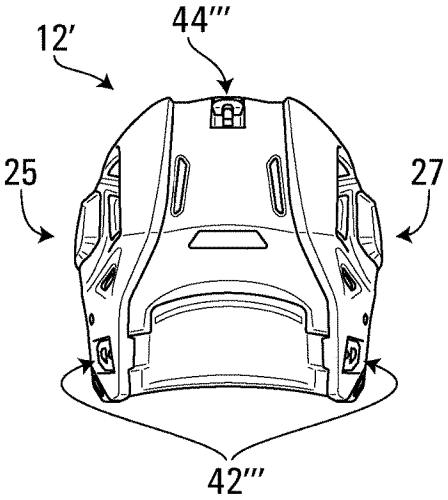
Figure 77:
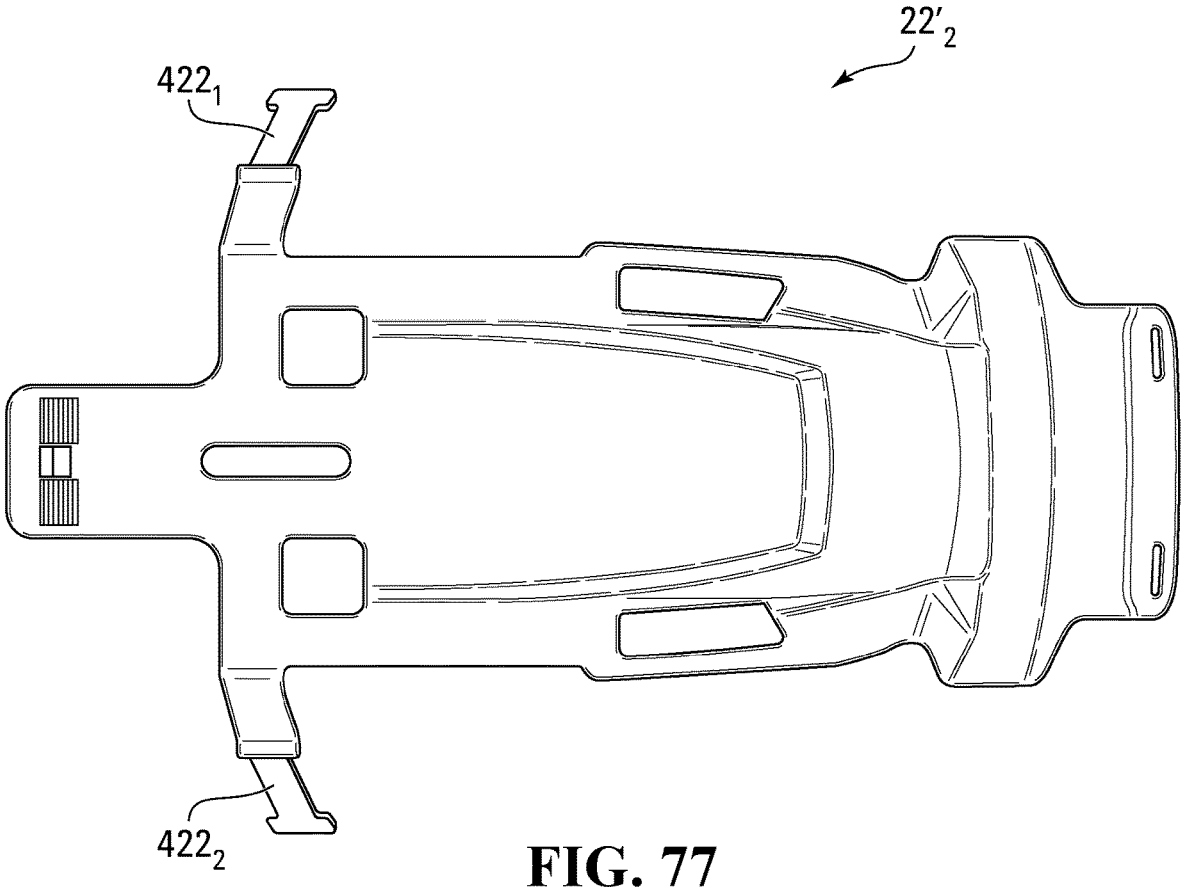
FIGS. 77 and 78 show respectively a top view and a front view of a top shell member of the shell members according to the example shown in FIG. 71.
Figure 78:
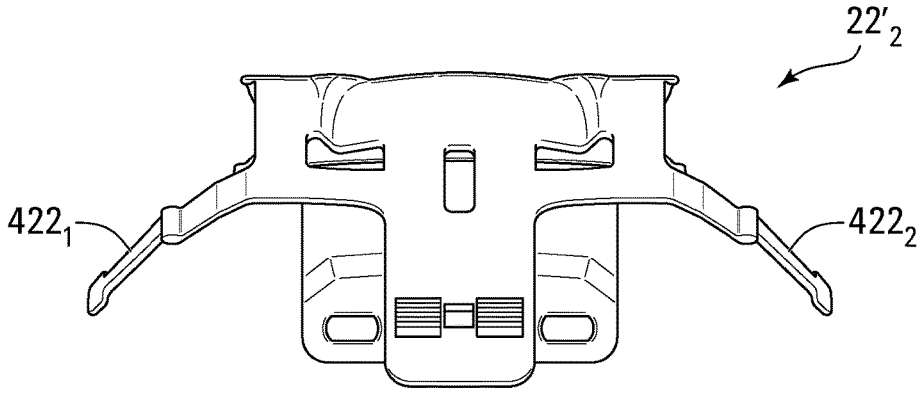
Figure 79:
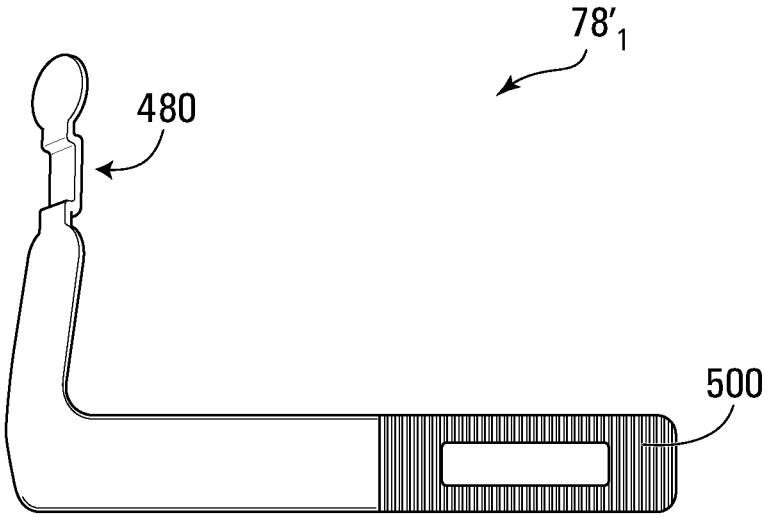
FIGS. 79 and 80 show respectively a top view and a bottom view of one connector of the lateral adjustment subsystem of the example of implementation of the adjustment system shown in FIG. 71.
Figure 80:
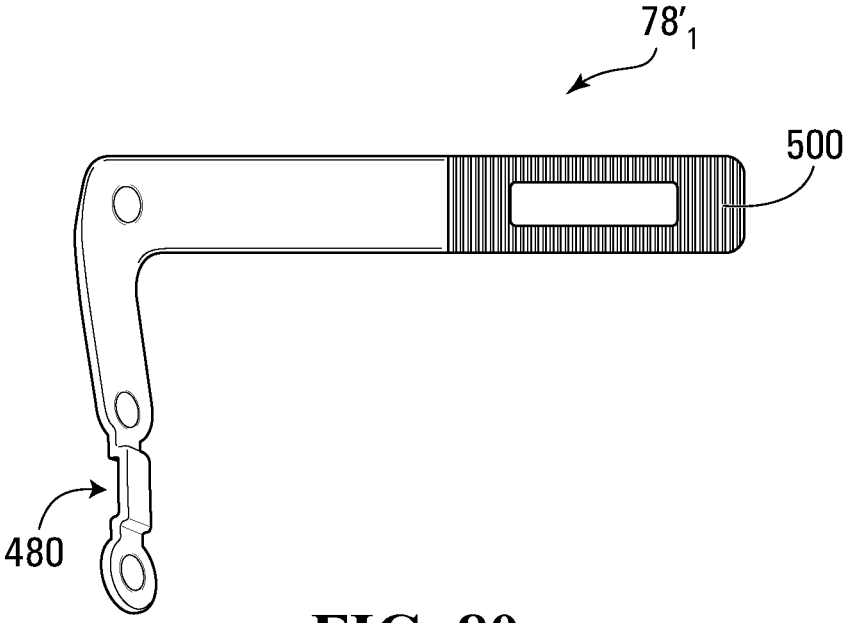
Figure 81:
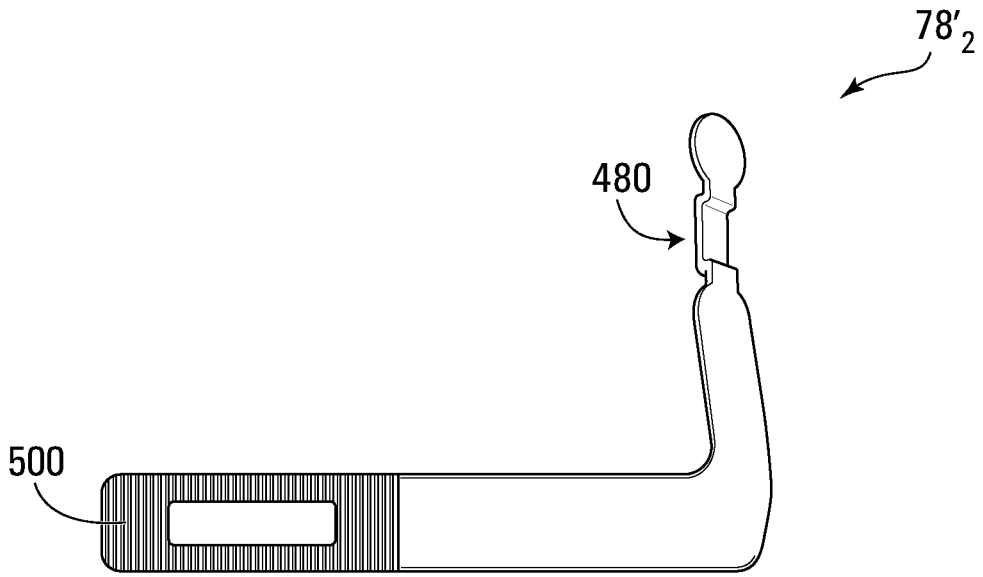
FIGS. 81 and 82 show respectively a top view and a bottom view of another connector of the lateral adjustment subsystem of the example of implementation of the adjustment system shown in FIG. 71.
Figure 82:
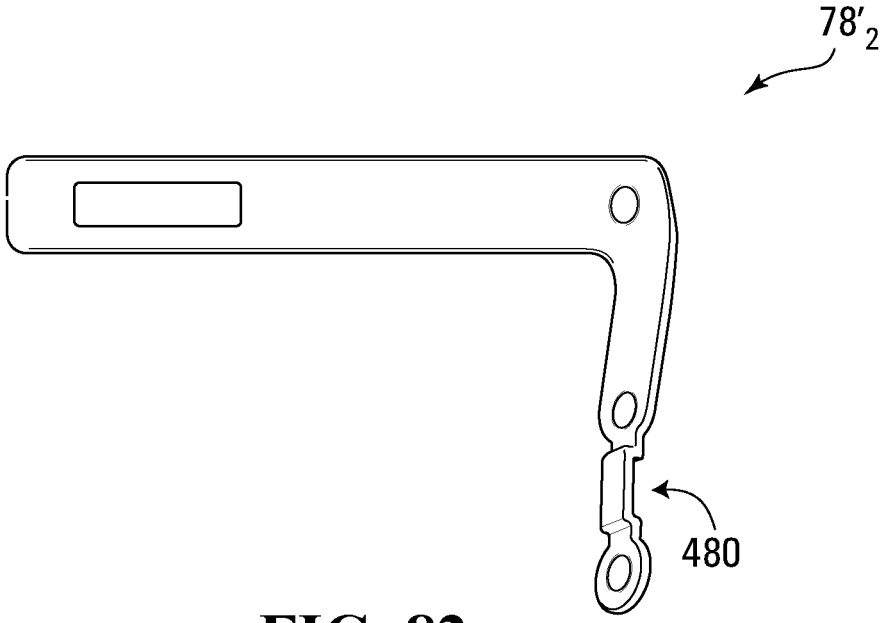

Also, with reference to FIG. 75, connector guides 481, 483 are attached to the inner surface 17 of the outer shell 12. Each connector guide 481, 483 defines an aperture in which one of the connectors $78_1$, $78_2$ is engaged. Each one of the connector guides 481, 483 are configured to guide a respective one of the connectors $78_1$, $78_2$ and to maintain it close to the inner surface 17 of the outer shell 12 while the shell members $22_1$,$22_2$, $22_3$ move relative to each other.

In this example, the lateral adjustment subsystem 44 functions generally the same way as the lateral adjustment subsystem 44" discussed above and shown in FIGS. 50 to 54. In particular, the lateral adjustment subsystem 44 in this example of implementation also has an actuator 60, which in this example is denoted 60', with a lock 61, which in this example is denoted 461, similar to the lock 61' and functions essentially the same way as discussed above. In this example, the lock 61 resides in a recess 424 formed in the rear shell member $22_3$ such that it may recede in the recess 424 while being in the locked position.

In this embodiment, the lock 61 is movable by the user between its locked position, in which it engages the lock-engaging part 45 to prevent the lateral side portions 25, 27 of the front shell member $22_1$ and the top shell member $22_2$ from moving relative to one another, and its unlocked position, in which it is disengaged from the lock-engaging part 45 to allow the lateral side portions 25, 27 of the front shell member $22_1$ and the top shell member $22_2$ to move relative to one another. When the lock 61 is in its unlocked position, the user can manually move the lateral side portions 25, 27 of the front shell member $22_1$ towards and away from the top shell member $22_2$ relative to one another by pushing or pulling on at least one of the lateral side portions 25, 27 of the front shell member $22_1$ towards and away from each other. While the lateral side portions 25, 27 of the front shell member $22_1$ and the top shell member $22_2$ are moving relative to one another, a distance between the rearmost portions of the lateral side portions 25, 27 of the front shell member $22_1$ may vary to adjust the lateral dimension $D_{TS}$ of the outer shell 12 and the lateral dimension $D_{TC}$ of the cavity 13 of the helmet 10.

More particularly, in this example, the lock-engaging part 45 comprises a series of projections and recesses forming an indentation 500 disposed on each one of the connectors $78_1$, $78_2$, on opposing surfaces 485, 487 of the top shell member $22_2$, and on an inner surface of the rear shell member $22_3$, where the connectors $78_1$, $78_2$, a rearmost portion of the top shell member $22_2$ and the rear shell member $22_3$ overlap. The indentation 500 on each of the aforementioned surfaces is configured to register with the indentation 500 disposed on an adjacent one of one of the connectors $78_1$, $78_2$, on the rearmost portion of the top shell member $22_2$ or on the rear shell member $22_3$ when the lock 61 of the longitudinal adjustment subsystem 42 is in the locked position, thereby mechanically engaging the indentation 500 of the connectors $78_1$, $78_2$, of the rearmost portion of the top shell member $22_2$ and of the rear shell member $22_3$ respectively in the overlapping regions thereof. The presence of the indentation 500 on each one of these components where they overlap may create even more retention force and may better prevent relative movement therebetween when they are locked in position using the lateral adjustment subsystem 44 of this example of implementation.

Yet in this example of implementation, the longitudinal adjustment subsystem 42, which in this example is denoted 42'", functions generally the same way as the longitudinal adjustment subsystem 42" discussed above and shown in FIGS. 50 to 54 to allow and prevent the lateral side portions 25, 27 of the front shell member $22_1$ and the rear shell member $22_3$ from moving one relative to the other. For instance, in this example of implementation, the longitudinal adjustment subsystem 42 comprises actuators $62_1$, $62_2$, that comprise locks $63_1$, $63_2$, which in this example are denoted $463_1$, $463_2$. Also, in this example, the lock-engaging part 47, which in this example is denoted 47', comprises a series of projections and recesses forming an indentation 502 similar to the indentation 500 of the lock-engaging part 45' discussed above, formed on a given one of the lateral portions 25, 27 of the front shell member $22_1$ and on an adjacent one of the lateral portions 33, 35 of the rear shell member $22_3$. The indentation 502 on the given one of the lateral side portions 25, 27 of the front shell member $22_1$ and the adjacent one of the lateral portions 33, 35 of the rear shell member $22_3$ are configured to register with each other when the locks $63_1$, $63_2$ are in the locked position. When the locks $63_1$, $63_2$ are in their unlocked position, the user can manually adjust the longitudinal dimension $D_{LS}$ of the outer shell 12 and the longitudinal dimension $D_{LC}$ of the cavity 13 of the helmet 10 by pushing or pulling on the rear shell member $22_3$.

Also, with additional reference to FIGS. 71 to 76, each one of the locks $63_1$, $63_2$ in this example of implementation resides in a recess 426 formed in the lateral side portions 25, 27 of the front shell member $22_1$ such that each one of the locks $63_1$, $63_2$ may recede in its respective recess 426 while being in the locked position. This may help to prevent accidental actuation of the locks $63_1$, $63_2$ by the user or by an object that may come in contact with the helmet (e.g. puck, stick, or other equipment) during use (e.g. playing hockey).

FIGS. 65 to 70 show another embodiment of the inner padding 15 of the helmet 10, in which at least part of the inner padding 15 is self-adjustable to conform to at least part of the user's head 11 when the helmet 10 is donned. This helps the helmet 10 to better fit on the user's head 11 solely by putting on the helmet 10.

In this embodiment, respective ones of the pads $36_1$-$36_N$, namely the pads $36_1$, $36_2$, are self-adjustable pads that adjust themselves relative to the outer shell 12 and/or other ones of the pads $36_1$-$36_N$ when the helmet 10 is donned in order to conform to regions $41_1$, $41_2$ of the user's head 11 that contact the self-adjustable pads $36_1$, $36_2$.

In this example, the self-adjustable pads $36_1$, $36_2$ are respectively front and rear self-adjustable pads mounted to the front shell member $22_1$ and the rear shell member $22_3$, so that the regions $41_1$, $41_2$ of the user's head 11 are respectively front and rear regions FR, RR of the user's head 11. Also, in this example, the self-adjustable pads $36_1$, $36_2$ respectively overlie and are affixed to underlying ones of the ones of the pads $36_1$-$36_N$, namely the pads $36_3$, $36_4$.

More particularly, in this embodiment, each self-adjustable pad $36_i$ comprises an inner side 504 for contacting that region $41_i$ of the user's head 11 that it is configured to engage and an outer side 506 for facing away from the user's head 11. The inner side 504 of the self-adjustable pad $36_i$ is concave to define a concavity 508 towards the user's head 11. The inner side 504 of the self-adjustable pad $36_i$ may be concave by being at least partly curved and/or at least partly straight (i.e., having one or more curved parts and/or one or more straight parts) such that the concavity 508 may be at least partly curved and/or at least partly straight (i.e., have one or more curved parts and/or one or more straight parts).

The concavity 508 of the inner side 504 of the self-adjustable pad $36_i$ is configured such that the self-adjustable pad $36_i$ deflects when the helmet 10 is donned. This deflection of the self-adjustable pad $36_i$ allows it to better engage the user's head 11. For example, in this embodiment, the self-adjustable pad $36_i$ is configured such that a radius of curvature $R_p$ of the concavity 508 of the inner side 504 of the self-adjustable pad $36_i$ increases when the self-adjustable pad $36_i$ engages the region $41_i$ of the user's head 11 as the helmet 10 is donned. The radius of curvature $R_p$ of the concavity 508 of the inner side 504 of the self-adjustable pad $36_i$ can be taken in a curved part of the concavity 508 or from an imaginary circle tangent to two adjacent straight parts of the concavity 508 in embodiments where such straight parts are present. For instance, in some embodiments, the radius of curvature $R_p$ of the concavity 508 of the inner side 504 of the self-adjustable pad $36_i$ may increase by at least 15%, in some cases at least 25% and in some cases at least 35% when the self-adjustable pad $36_i$ engages the region $41_i$ of the user's head 11 as the helmet 10 is donned. For example, in some embodiments, the radius of curvature $R_p$ at rest (e.g. when the helmet is not donned) of the concavity 508 of the inner side 504 of the self-adjustable pad $36_i$ may be approximately 85 mm (approx. 3.35 inches) and a periphery of the inner side 504 of the self-adjustable pad $36_i$ may be displaceable outwardly by approximately 4 mm (approx. 0.157 inch) to bring the radius of curvature $R_p$ to approximately 107.5 mm (approx. 4.21 inches) so that it increases by 26.4% when the helmet is donned.

In this embodiment, the radius of curvature $R_p$ of the concavity 508 of the inner side 504 of the self-adjustable pad $36_i$ is smaller than a radius of curvature $R_h$ of a convexity $C_h$ of the region $41_i$ of the user's head 11. Thus, when the helmet 10 is donned, the convexity $C_h$ of the region $41_i$ of the user's head 11 forces the radius of curvature $R_p$ of the concavity 508 of the inner side 504 of the self-adjustable pad $36_i$ to increase.

In this example of implementation, the self-adjustable pad $36_i$ is configured to be compressed to conform to the region $41_i$ of the user's head 11 when the helmet 10 is donned. Pressure applied by the user's head 11 compresses the self-adjustable pad $36_i$ so as to increase the radius of curvature $R_p$ of the concavity 508 of its inner side 504.

The self-adjustable pad $36_i$ may have any suitable shape. In this embodiment, the self-adjustable pad $36_i$ comprises a plurality of padding parts $67_1$-$67_3$ that are arranged to define the concavity 508 of the inner side 504 of the self-adjustable pad $36_i$. In this example, the padding parts $67_1$-$67_3$ of the self-adjustable pad $36_i$ are padding "lobes" that intersect centrally of the self-adjustable pad $36_i$.

In this embodiment, the self-adjustable pad $36_i$ comprises a plurality of padding layers $57_1$, $57_2$ that include materials $M_1$, $M_2$ different from one another. More particularly, in this embodiment, each of the padding lobes $67_1$-$67_3$ of the self-adjustable pad $36_i$ includes a portion of the padding layer $57_1$ and a portion of the padding layer $57_2$. In this case, the portion of the padding layer $57_1$ of each of the padding lobes $67_1$-$67_3$ is aligned with and overlies the portion of the padding layer $57_2$ of that padding lobe. In this example, the portion of the padding layer $57_1$ of each of the padding lobes $67_1$-$67_3$ includes a recess 509 on a backside thereof that receives the portion of the padding layer $57_2$ of that padding lobe.

The materials $M_1$, $M_2$ of the padding layers $57_1$, $57_2$ of the self-adjustable pad $36_i$ may differ in one or more properties such as density, stiffness, resilience, etc.

For example, in this embodiment, the materials $M_1$, $M_2$ differ in density. More particularly, in this embodiment, a density of the material $M_1$ making up at least a majority, in this case an entirety, of the portion of the padding layer $57_1$ is less than a density of the material $M_2$ making up at least a majority, in this case an entirety, of the portion of the padding layer $57_2$. This may help to provide shock absorption and comfort for the player's head. For instance, in some embodiments, the density of the material $M_1$ may be no more than 80%, in some cases no more than 50%, in some cases no more than 20%, and in some cases an even lesser fraction of the density of the material $M_2$.

Each of the density of the material $M_1$ and the density of the material $M_2$ may have any suitable value. For instance, in some embodiments, the density of the material $M_1$ may be between 1.5 lb/ft$^3$ (0.02 g/cm$^3$) and 9.5 lb/ft$^3$ (0.15 g/cm$^3$) and the density of the material $M_2$ may be between 8 lb/ft$^3$ (0.128 g/cm$^3$) and 13 lb/ft$^3$ (0.21 g/cm$^3$). More particularly, in some cases, the density of the material $M_1$ may be no more than 9.5 lb/ft$^3$ (0.15 g/cm$^3$), in some cases no more than 7 lb/ft$^3$ (0.11 g/cm$^3$) and no more than 2.5 lb/ft$^3$ (0.04 g/cm$^3$), and/or the density of the material $M_2$ may be no more than 13 lb/ft$^3$ (0.21 g/cm$^3$), in some cases no more than 11 lb/ft$^3$ (0.18 g/cm$^3$), and in some cases no more than 9 lb/ft$^3$ (0.14 g/cm$^3$), and in some cases even less.

The materials $M_1$, $M_2$ of the padding layers $\mathbf{57}_1$, $\mathbf{57}_2$ of the self-adjustable pad $\mathbf{36}_i$ may differ in one or more other properties in addition to or instead of density.

As another example, in some embodiments, a resilience of the material $M_1$ making up at least a majority, in this case an entirety, of the portion of the padding layer $\mathbf{57}_1$ may be less than a resilience of the material $M_2$ making up at least a majority, in this case an entirety, of the portion of the padding layer $\mathbf{57}_2$. For instance, in some embodiments, the resilience of the material $M_1$ may be no more than 60%, in some cases no more than 40%, in some cases no more than 20%, and in some cases an even less fraction of the resilience of the material $M_2$ according to ASTM D2632-01 which measures resilience by vertical rebound. Alternatively, in other embodiments, the resilience of the material $M_1$ may be greater than the resilience of the material $M_2$ Each of the resilience of the material $M_1$ and the resilience of the material $M_2$ may have any suitable value.

As another example, in some embodiments, an elongation at break of the material $M_1$ making up at least a majority, in this case an entirety, of the portion of the padding layer $\mathbf{57}_1$ may be greater than an elongation at break of the material $M_2$ making up at least a majority, in this case an entirety, of the portion of the padding layer $\mathbf{57}_2$. For instance, in some embodiments, the elongation at break of the material $M_1$ may be at least 110%, in some cases at least 130%, and in some cases at least 150% of the elongation at break of the material $M_2$ according to ASTM D-638 or ASTM D-412, and in some cases even more.

As another example, in some embodiments, a hardness (e.g., Shore OO hardness) of the material $M_1$ making up at least a majority, in this case an entirety, of the portion of the padding layer $\mathbf{57}_1$ may be less than a hardness of the material $M_2$ making up at least a majority, in this case an entirety, of the portion of the padding layer $\mathbf{57}_2$. For instance, in some embodiments, on a Shore OO hardness scale, a ratio of the hardness of the material $M_1$ over the hardness of the material $M_2$ may be no more than 0.9, in some cases no more than 0.6, in some cases no more than 0.4, and in some cases an even lesser ratio. In some cases, the hardness may be evaluated according to ASTM D2240. For example, in some cases, the Shore OO hardness of the material $M_1$ may be approximately between 35 and 50, and/or the Shore OO hardness of the material $M_2$ may be approximately between 40 and 60. More particularly, in some cases, the Shore OO hardness of the material $M_1$ may be no more than 50, in some cases no more than 40, in some cases no more than 35, and/or the Shore OO hardness of the material $M_2$ may be no more than 60, in some cases no more than 50, in some cases no more than 40. Alternatively, in other embodiments, the hardness of the material $M_1$ may be greater than the hardness of the material $M_2$. For instance, in some cases, the Shore OO hardness of the material $M_1$ may be approximately 85, and the Shore OO hardness of the material $M_2$ may be in the range discussed above.

In this example, the materials $M_1$, $M_2$ of the padding layers $\mathbf{57}_1$, $\mathbf{57}_2$ of the self-adjustable pad $\mathbf{36}_i$ are respectively thermoformable polymeric foam (e.g. elastomeric ethylene-vinyl acetate foam) and polyurethane foam (e.g., PORON XRD foam commercialized by Rogers Corporation, or any other suitable polyurethane foam). The materials $M_1$, $M_2$ may include any other suitable foam in other embodiments (e.g., polyvinyl chloride (PVC) foam, vinyl nitrile (VN) foam, polyethylene (PE) foam, ethylene-vinyl acetate (EVA) foam, polypropylene (PP) foam, etc.).

The padding layers $\mathbf{57}_1$, $\mathbf{57}_2$ of the self-adjustable pad $\mathbf{36}_i$ may be affixed to one another in any suitable way. In this embodiment, the padding layers $\mathbf{57}_1$, $\mathbf{57}_2$ of the self-adjustable pad $\mathbf{36}_i$ are adhesively bonded to one another. More particularly, in this embodiment, the portion of the padding layer $\mathbf{57}_1$ of each of the padding lobes $\mathbf{67}_1$-$\mathbf{67}_3$ is adhesively bonded to the portion of the padding layer $\mathbf{57}_2$ of that padding lobe.

In this embodiment, the self-adjustable pad $\mathbf{36}_i$ is also affixed to that underlying pad $\mathbf{36}_j$ that it overlies. More particularly, in this embodiment, the self-adjustable pad $\mathbf{36}_i$ is adhesively bonded to the underlying pad $\mathbf{36}_j$. In this case, a central part 510 of the self-adjustable pad $\mathbf{36}_i$ between the padding lobes $\mathbf{67}_1$-$\mathbf{67}_3$ of the self-adjustable pad $\mathbf{36}_i$ is adhesively bonded to the underlying pad $\mathbf{36}_j$.

In this example of implementation, a material $M_3$ of the underlying pad $\mathbf{36}_j$ is different from the materials $M_1$, $M_2$ of the padding layers $\mathbf{57}_1$, $\mathbf{57}_2$ of the self-adjustable pad $\mathbf{36}_i$. The material $M_3$ of the underlying pad $\mathbf{36}_j$ and the materials $M_1$, $M_2$ of the padding layers $\mathbf{57}_1$, $\mathbf{57}_2$ of the self-adjustable pad $\mathbf{36}_i$ differ in one or more properties such as density, stiffness, resilience, etc. In this example, the material $M_3$ of the underlying pad $\mathbf{36}_j$ is expanded microspheres (e.g., Expancel™ microspheres commercialized by Akzo Nobel). The material $M_3$ may be other suitable materials in other embodiments.

In this embodiment, a central one of the pads $\mathbf{36}_1$-$\mathbf{36}_N$, namely the pad $\mathbf{36}_5$, is configured to contact the top region TR of the user's head 11 and affixed to the self-adjustable pads $\mathbf{36}_1$, $\mathbf{36}_2$.

More particularly, in this embodiment, the central pad $\mathbf{36}_5$ is thin, extends for a majority of the length L of the helmet 10 and a majority of the width W of the helmet 10, and provides impact protection when the helmet 10 is impacted. For example, in this embodiment, the central pad $\mathbf{36}_5$ comprises foam (e.g., elastomeric EVA foam or any other suitable foam).

In this example, the central pad $\mathbf{36}_5$ generally conforms to the contour of adjacent ones of the pads $\mathbf{36}_1$-$\mathbf{36}_N$ and interconnects the front and rear self-adjustable pads $\mathbf{36}_1$, $\mathbf{36}_2$ and other adjacent ones of the pads $\mathbf{36}_1$-$\mathbf{36}_N$ that conform to the lateral side regions LS, RS of the user's head 11. The central pad $\mathbf{36}_5$ includes spaced apart segments extending from the top portion 24 of the top shell member $\mathbf{22}_2$ towards the front portion 23 of the front shell member $\mathbf{22}_1$ and towards the lower rear portion 37 of the rear shell member $\mathbf{22}_3$. In this example, the spaced apart segments of the central pad $\mathbf{36}_5$ are connected, in this case bonded, to adjacent ones of the pads $\mathbf{36}_1$-$\mathbf{36}_N$.

In this example, the central pad $\mathbf{36}_5$ facilitates adjustment of the helmet 10 by the adjustment system 40. More particularly, in this example, the central pad $\mathbf{36}_5$ is elastically deformable (e.g., stretchable) when the shells members $\mathbf{22}_1$, $22_2$, $22_3$ are moved relative to one another by operating the adjustment system 40. This may allow the central pad $36_5$ to keep properly protecting and providing comfort to the top region TR of the user's head 11 (e.g., instead of leaving gaps that could otherwise appear when the shells members $22_1$, $22_2$, $22_3$ are moved away from one another). Also, in this example, the central pad $36_5$ includes a plurality of voids (e.g. recess, opening, a combination of recesses and openings) that may help to facilitate deforming (e.g. stretching) of the central pad $36_5$ when the shell members $22_1$, $22_2$, $22_3$ are moved relative to one another by operating the adjustment system 40.

In other variants of the self-adjustable pad $36_i$, the portion of the padding layer $57_1$ of each of the padding lobes $67_1$-$67_3$ of the self-adjustable pad $36_i$ is spaced from and movable relative to, including towards and away from, the portion of the padding layer $57_2$ of that padding lobe. Notably, in such variants, the portion of the padding layer $57_1$ of each of the padding lobes $67_1$-$67_3$ of the self-adjustable pad $36_i$ is movable towards the portion of the padding layer $57_2$ of that padding lobe when the helmet 10 is donned, and movable away from the portion of the padding layer $57_2$ of that padding lobe when the helmet 10 is doffed. In such variants, only the central part 510 of the padding layer $57_1$ between the padding lobes $67_1$-$67_3$ of the self-adjustable pad $36_i$ is adhesively bonded to the underlying pad $36_j$.

Also, in some variants, other ones of the pads $36_1$-$36_N$ can be self-adjustable pads in addition to or instead of the front and rear self-adjustable pads $36_1$, $36_2$. For instance, in some cases, respective ones of the pads $36_1$-$36_N$ conforming to the lateral side regions LS, RS of the user's head 11 can also be self-adjustable pads just as the front and rear self-adjustable pads $36_1$, $36_2$.

Any feature of any embodiment discussed herein may be combined with any feature of any other embodiment discussed herein in some examples of implementation.

Although in embodiments considered above the helmet 10 is a hockey helmet for protecting the head of a hockey player, in other embodiments, a helmet constructed using principles described herein in respect of the helmet 10 may be another type of sport helmet. For instance, a helmet constructed using principles described herein in respect of the helmet 10 may be for protecting a head of a player of another type of contact sport (sometimes referred to as "full-contact sport" or "collision sport") in which there are significant impact forces on the player due to player-to-player and/or player-to-object contact. For example, in some embodiments, a helmet constructed using principles described herein in respect of the helmet 10 may be a lacrosse helmet for protecting a head of a lacrosse player. As another example, in some embodiments, a helmet constructed using principles described herein in respect of the helmet 10 may be a football helmet for protecting a head of a football player. As another example, in some embodiments, a helmet constructed using principles described herein in respect of the helmet 10 may be a baseball helmet for protecting a head of a baseball player (e.g., a batter or catcher). Furthermore, a helmet constructed using principles described herein in respect of the helmet 10 may be for protecting a head of a user involved in a sport other than a contact sport (e.g., bicycling, skiing, snowboarding, horseback riding or another equestrian activity, etc.).

Also, while in the embodiments considered above the helmet 10 is a sport helmet, a helmet constructed using principles described herein in respect of the helmet 10 may be used in an activity other than sport in which protection against head injury is desired. For example, in some embodiments, a helmet constructed using principles described herein in respect of the helmet 10 may be a motorcycle helmet for protecting a head of a user riding a motorcycle. As another example, in some embodiments, a helmet constructed using principles described herein in respect of the helmet 10 may be an industrial or military helmet for protecting a head of a user in an industrial or military application.

Although various embodiments and examples have been presented, this was for purposes of describing, but this is not limiting. Various modifications and enhancements will become apparent to those of ordinary skill in the art.

The invention claimed is:

1. A helmet for protecting a head of a user, the helmet comprising:

a) an outer shell comprising a plurality of shell members movable relative to one another;

b) an inner padding disposed within the outer shell; and c) an adjustment system configured to adjust a fit of the helmet on the user's head, wherein the adjustment system is operable to move respective ones of the shell members relative to one another to adjust the fit of the helmet on the user's head, the adjustment system comprising:

a longitudinal adjustment subsystem configured to adjust a longitudinal dimension of the outer shell in a longitudinal direction of the helmet; and a lateral adjustment subsystem configured to move respective ones of the shell members relative to one another to adjust a lateral dimension of the outer shell in a lateral direction of the helmet;

the longitudinal adjustment subsystem and the lateral adjustment subsystem being operable independently from one another to adjust the longitudinal dimension of the outer shell and the lateral dimension of the outer shell independently from one another over at least part of a range of adjustability of the longitudinal dimension of the outer shell and at least part of a range of adjustability of the lateral dimension of the outer shell.

2. The helmet of claim 1, wherein: the longitudinal dimension of the outer shell is at least primarily adjustable by operating the longitudinal adjustment subsystem; and the lateral dimension of the outer shell is at least primarily adjustable by operating the lateral adjustment subsystem.

3. The helmet of claim 1, wherein: the longitudinal dimension of the outer shell is at least primarily adjustable by operating the longitudinal adjustment subsystem; and the lateral dimension of the outer shell is at least primarily adjustable by operating the lateral adjustment subsystem.

4. The helmet of claim 1, wherein the inner padding comprises a plurality of pads mounted to the shell members and movable relative to one another when the shell members move relative to one another.

5. The helmet of claim 1, wherein the longitudinal dimension of the outer shell and the lateral dimension of the outer shell are adjustable independently from one another over at least 20% of the range of adjustability of the longitudinal dimension of the outer shell.

6. The helmet of claim 5, wherein the longitudinal dimension of the outer shell and the lateral dimension of the outer shell are adjustable independently from one another over at least 20% of the range of adjustability of the lateral dimension of the outer shell.

7. The helmet of claim 1, wherein the longitudinal dimension of the outer shell and the lateral dimension of the outer shell are adjustable independently from one another over at least 40% of the range of adjustability of the longitudinal dimension of the outer shell.

8. The helmet of claim 7, wherein the longitudinal dimension of the outer shell and the lateral dimension of the outer shell are adjustable independently from one another over at least 40% of the range of adjustability of the lateral dimension of the outer shell.

9. The helmet of claim 1, wherein the longitudinal dimension of the outer shell and the lateral dimension of the outer shell are adjustable independently from one another over at least 20% of the range of adjustability of the lateral dimension of the outer shell.

10. The helmet of claim 1, wherein the longitudinal dimension of the outer shell and the lateral dimension of the outer shell are adjustable independently from one another over at least 40% of the range of adjustability of the lateral dimension of the outer shell.

11. The helmet of claim 1, wherein operation of the longitudinal adjustment subsystem and the lateral adjustment subsystem causes the longitudinal dimension of the outer shell and the lateral dimension of the outer shell to be adjusted simultaneously and dependently on one another over at least part of the range of adjustability of the longitudinal dimension of the outer shell and at least part of the range of adjustability of the lateral dimension of the outer shell.

12. The helmet of claim 11, wherein the longitudinal dimension of the outer shell and the lateral dimension of helmet are adjustable simultaneously and dependently on one another over no more than 20% of the range of adjustability of the longitudinal dimension of the outer shell.

13. The helmet of claim 12, wherein the longitudinal dimension of the outer shell and the lateral dimension of helmet are adjustable simultaneously and dependently on one another over no more than 20% of the range of adjustability of the lateral dimension of the outer shell.

14. The helmet of claim 11, wherein the longitudinal dimension of the outer shell and the lateral dimension of helmet are adjustable simultaneously and dependently on one another over no more than 20% of the range of adjustability of the lateral dimension of the outer shell.

15. The helmet of claim 1, wherein the adjustment system comprises a plurality of actuators manually operable independently from one another to adjust the fit of the helmet on the user's head, wherein each actuator of the plurality of actuators is part of either the lateral adjustment subsystem or the longitudinal adjustment subsystem.

16. The helmet of claim 15, wherein a first one of the actuators is disposed in an upper portion of the helmet and a second one of the actuators is disposed in a lower portion of the helmet.

17. The helmet of claim 16, wherein: the first one of the actuators is a central one of the actuators disposed in a central region of the upper portion of the helmet; and the second one of the actuators is a lateral one of the actuators disposed in a lateral region of the lower portion of the helmet.

18. The helmet of claim 17, wherein: the central one of the actuators is operable to adjust the lateral dimension of the outer shell such that the lateral dimension of the outer shell is at least primarily adjustable by operating the central one of the actuators; and the lateral one of the actuators is operable to adjust the longitudinal dimension of the outer shell such that the longitudinal dimension of the outer shell is at least primarily adjustable by operating the lateral one of the actuators.

19. The helmet of claim 16, wherein a third one of the actuators is disposed in the lower portion of the helmet and spaced from the second one of the actuators.

20. The helmet of claim 19, wherein: the first one of the actuators is a central one of the actuators disposed in a central region of the upper portion of the helmet; the second one of the actuators is a first lateral one of the actuators disposed in a first lateral region of the lower portion of the helmet; and the third one of the actuators is a second lateral one of the actuators disposed in a second lateral region of the lower portion of the helmet opposite to the first lateral region of the lower portion of the helmet.

21. The helmet of claim 20, wherein: the central one of the actuators is operable to adjust the lateral dimension of the outer shell such that the lateral dimension of the outer shell is at least primarily adjustable by operating the central one of the actuators; and the first lateral one of the actuators and the second lateral one of the actuators are operable to adjust the longitudinal dimension of the outer shell such that the longitudinal dimension of the outer shell is at least primarily adjustable by operating the first lateral one of the actuators and the second lateral one of the actuators.

22. The helmet of claim 15, wherein: a first one of the actuators is operable to adjust the lateral dimension of the outer shell such that the lateral dimension of the outer shell is at least primarily adjustable by operating the first one of the actuators; and a second one of the actuators is operable to adjust the longitudinal dimension of the outer shell such that the longitudinal dimension of the outer shell is at least primarily adjustable by operating the second one of the actuators.

23. The helmet of claim 1, wherein the adjustment system comprises a plurality of actuators manually operable independently from one another to adjust the fit of the helmet on the user's head, wherein each actuator of the plurality of actuators is part of either the lateral adjustment subsystem or the longitudinal adjustment subsystem.

24. The helmet of claim 23, wherein the actuators comprise a plurality of locks operable to selectively lock and unlock the shell members relative to one another in order to selectively allow and prevent movement of the shell members relative to one another.

25. The helmet of claim 24, wherein a given one of the locks is manually movable between a locked position, in which the given one of the locks engages a lock-engaging part of the helmet to prevent adjacent ones of the shell members from moving relative to one another, and an unlocked position, in which the given one of the locks is disengaged from the lock-engaging part of the helmet to allow the user to manually move the adjacent ones of the shell members relative to one another.

26. The helmet of claim 24, wherein a given one of the locks is manually pivotable between a locked position, in which the given one of the locks engages a lock-engaging part of the helmet to prevent adjacent ones of the shell members from moving relative to one another, and an unlocked position, in which the given one of the locks is disengaged from the lock-engaging part of the helmet to allow the adjacent ones of the shell members to move relative to one another.

27. The helmet of claim 26, wherein the given one of the locks comprises a cam to apply pressure when moving to the locked position.

28. The helmet of claim 24, wherein: a given one of the locks is movable between a locked position, in which the given one of the locks engages a lock-engaging part of the helmet to prevent adjacent ones of the shell members from moving relative to one another, and an unlocked position, in which the given one of the locks is disengaged from the lock-engaging part of the helmet to allow the adjacent ones of the shell members to move relative to one another; the given one of the locks comprises a locking projection; the lock-engaging part of the helmet comprises a locking void; the locking projection of the given one of the locks is received in the locking void of the lock-engaging part of the helmet when the lock is in the locked position; and the locking projection of the given one of the locks is outside of the locking void of the lock-engaging part of the helmet when the lock is in the unlocked position.

29. The helmet of claim 28, wherein: the given one of the locks is mounted to a first one of the adjacent ones of the shell members; and a second one of the adjacent ones of the shell members comprises the lock-engaging part of the helmet.

30. The helmet of claim 29, wherein the first one of the adjacent ones of the shell members comprises an opening allowing the locking projection of the given one of the locks to pass through the opening when the given one of the locks is moved between the locked position and the unlocked position.

31. The helmet of claim 24, wherein:

each lock of the plurality of locks is movable between a locked position, in which the lock engages a corresponding lock-engaging part of the helmet to prevent adjacent ones of the shell members from moving relative to one another, and an unlocked position, in which the lock is disengaged from the corresponding lock-engaging part of the helmet to allow the adjacent ones of the shell members to move relative to one another;

each lock of the plurality of locks comprises a locking projection;

for each lock of the plurality of locks, the corresponding lock-engaging part of the helmet comprises a locking void;

for each lock of the plurality of locks, the locking projection of the lock is received in the locking void of the corresponding lock-engaging part of the helmet when the lock is in the locked position, and the locking projection of the lock is outside of the locking void of the corresponding lock-engaging part of the helmet when the lock is in the unlocked position.

32. The helmet of claim 1, wherein a front one of the shell members is configured to face a front of the user's head and lateral sides of the user's head; and a rear one of the shell members is configured to face a rear of the user's head.

33. The helmet of claim 32, wherein a top one of the shell members is configured to face a top of the user's head and is disposed between the front one of the shell members and the rear one of the shell members.

34. The helmet of claim 33, wherein: the front one of the shell members comprises a front portion configured to face the front of the user's head, a first lateral portion extending rearwardly from the front portion of the front one of the shell members and configured to face a first one of the lateral sides of the user's head, and a second lateral portion extending rearwardly from the front portion of the front one of the shell members and configured to face a second one of the lateral sides of the user's head, and a gap between the first lateral portion and the second lateral portion of the front one of the shell members; the rear one of the shell members overlies the gap of the front one of the shell members; and the top one of the shell members overlies the gap of the front one of the shell members.

35. The helmet of claim 34, wherein the adjustment system comprises: a plurality of locks operable to selectively lock and unlock the shell members relative to one another in order to selectively allow and prevent movement of the shell members relative to one another, wherein each lock of the plurality of locks is part of either the lateral adjustment subsystem or the longitudinal adjustment subsystem; and a plurality of connectors interconnecting the first lateral portion and the second lateral portion of the front one of the shell members, movable relative to one another, and interacting with a given one of the locks.

36. The helmet of claim 33, wherein the adjustment system comprises a plurality of locks operable to selectively lock and unlock the shell members relative to one another in order to selectively allow and prevent movement of the shell members relative to one another, wherein each lock of the plurality of locks is part of either the lateral adjustment subsystem or the longitudinal adjustment subsystem.

37. The helmet of claim 36, wherein: a first one of the locks is operable to selectively lock and unlock the top one of the shell members and the rear one of the shell members relative to one another in order to selectively allow and prevent movement of the top one of the shell members and the rear one of the shell members relative to one another; and a second one of the locks is operable to selectively lock and unlock the front one of the shell members and the rear one of the shell members relative to one another in order to selectively allow and prevent movement of the front one of the shell members and the rear one of the shell members relative to one another.

38. The helmet of claim 37, wherein the second one of the locks comprises a pivotable handle being manually operable by the user, the handle being connected to a backing member located beneath the rear one of the shell member, the backing member comprising a series of locking projections configured to engage a lock-engaging part of the helmet when the second one of the locks is in a locked position to prevent the front one of the shell member and the rear one of the shell member from moving relative to one another.

39. The helmet of claim 37, wherein the second one of the locks comprises a pivotable handle being manually operable by the user, the handle being connected to a backing member located beneath the rear one of the shell member, the backing member being configured to frictionally engage the rear one of the shell member when the second one of the locks is in a locked position in order to prevent the front one of the shell member and the rear one of the shell member from moving relative to one another.

40. The helmet of claim 32, wherein the adjustment system is operable to move an upper part of the front one of the shell members and an upper part of the rear one of the shell members relative to one another in the longitudinal direction of the helmet while a lower part of the front one of the shell members and a lower part of the rear one of the shell members substantially remain fixed relative to one another in the longitudinal direction of the helmet.

41. The helmet of claim 1, wherein the helmet is a sports helmet.

42. The helmet of claim 41, wherein the sports helmet is a hockey helmet.

* * * * *